US011155909B2

(12) United States Patent
Oishi et al.

(10) Patent No.: US 11,155,909 B2
(45) **Date of Patent: *Oct. 26, 2021**

(54) HIGH-STRENGTH FREE-CUTTING COPPER ALLOY AND METHOD FOR PRODUCING HIGH-STRENGTH FREE-CUTTING COPPER ALLOY

(71) Applicant: Mitsubishi Materials Corporation, Tokyo (JP)

(72) Inventors: Keiichiro Oishi, Osaka (JP); Kouichi Suzaki, Osaka (JP); Hiroki Goto, Osaka (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/548,257

(22) Filed: Aug. 22, 2019

(65) Prior Publication Data

US 2020/0040437 A1 Feb. 6, 2020

Related U.S. Application Data

(62) Division of application No. 16/488,028, filed as application No. PCT/JP2018/006218 on Feb. 21, 2018.

(30) Foreign Application Priority Data

| | | |
|---|---|---|
| Aug. 15, 2017 | (WO) | PCT/JP2017/029369 |
| Aug. 15, 2017 | (WO) | PCT/JP2017/029371 |
| Aug. 15, 2017 | (WO) | PCT/JP2017/029373 |
| Aug. 15, 2017 | (WO) | PCT/JP2017/029374 |
| Aug. 15, 2017 | (WO) | PCT/JP2017/029376 |

(51) Int. Cl.
*C22F 1/08* (2006.01)
*C22C 9/10* (2006.01)

(52) U.S. Cl.
CPC . *C22F 1/08* (2013.01); *C22C 9/10* (2013.01)

(58) Field of Classification Search
CPC ..... C22F 1/08; C22C 9/10
See application file for complete search history.

(56) References Cited

U.S. PATENT DOCUMENTS

| | | | | |
|---|---|---|---|---|
| 4,055,445 | A | 10/1977 | Pops | |
| 5,865,910 | A | 2/1999 | Bhargava | |
| 10,557,185 | B2 * | 2/2020 | Oishi | C22C 9/04 |
| 2002/0159912 | A1 | 10/2002 | Oishi | |
| 2007/0062615 | A1 | 3/2007 | Oishi | |
| 2007/0169854 | A1 | 7/2007 | Oishi | |
| 2007/0169855 | A1 | 7/2007 | Oishi | |
| 2009/0297390 | A1 | 12/2009 | Hidenobu et al. | |
| 2013/0276938 | A1 | 10/2013 | Oishi | |
| 2013/0315660 | A1 | 11/2013 | Oishi | |
| 2013/0319581 | A1 | 12/2013 | Oishi | |
| 2014/0251488 | A1 | 9/2014 | Oishi et al. | |
| 2016/0068931 | A1 | 3/2016 | Xu et al. | |
| 2017/0062615 | A1 | 3/2017 | Wang et al. | |
| 2017/0211169 | A1 | 7/2017 | Hanaoka et al. | |

FOREIGN PATENT DOCUMENTS

| | | | |
|---|---|---|---|
| CA | 2582972 | A1 | 4/2006 |
| EP | 1045041 | A1 | 10/2000 |
| EP | 2634275 | A1 | 9/2013 |
| JP | 07-508560 | A | 9/1995 |
| JP | 2000-119774 | A | 4/2000 |
| JP | 2000-119775 | A | 4/2000 |
| JP | 2004-263301 | A | 9/2004 |
| JP | 2008-516081 | A | 5/2008 |
| JP | 2008-214760 | | 9/2008 |
| JP | 2009-509031 | A | 3/2009 |
| JP | 2013-104071 | A | 5/2013 |
| JP | 2016-511792 | A | 4/2016 |
| WO | 94/01591 | A1 | 1/1994 |
| WO | 2006/016442 | A1 | 2/2006 |
| WO | 2006/016624 | A2 | 2/2006 |

(Continued)

OTHER PUBLICATIONS

Extended European Search Report issued in co-pending application 18846602.3 completed on Jun. 15, 2020 and dated Jun. 26, 2020.
Office Action issued in co-pending U.S. Appl. No. 16/274,622 dated Aug. 26, 2019.
International Search Report issued in application PCT/JP2018/006203 dated May 15, 2018.
International Search Report issued in application PCT/JP2017/029369 dated Nov. 7, 2017.
International Search Report issued in application PCT/JP2017/029376 dated Nov. 7, 2017.
Office Action issued in Japanese patent application No. 2017-567267 dated Apr. 3, 2018, (Machine translation obtained by Global Dossier on Dec. 14, 2018).
International Search Report issued in application PCT/JP2017/029371 dated Nov. 7, 2017.

(Continued)

*Primary Examiner* — Jessee R Roe
(74) *Attorney, Agent, or Firm* — Merchant & Gould P.C.

(57) ABSTRACT

This high-strength free-cutting copper alloy comprises 75.4-78.0% Cu, 3.05-3.55% Si, 0.05-0.13% P and 0.005-0.070% Pb, with the remainder comprising Zn and inevitable impurities, wherein the amount of Sn existing as inevitable impurities is at most 0.05%, the amount of Al is at most 0.05%, and the total amount of Sn and Al is at most 0.06%. The composition satisfies the following relations: $78.0 \leq f1 = Cu + 0.8 \times Si + P + Pb \leq 80.8$; and $60.2 \leq f2 = Cu - 4.7 \times Si - P + 0.5 \times Pb \leq 61.5$. The area percentage (%) of respective constituent phases satisfies the following relations: $29 \leq \kappa \leq 60$; $0 \leq \gamma \leq 0.3$; $\beta = 0$; $0 \leq \mu \leq 1.0$; $98.6 \leq f3 = \alpha + \kappa$; $99.7 \leq f4 = \alpha + \kappa + \gamma + \mu$; $0 \leq f5 = \gamma + \mu \leq 1.2$; and $30 \leq f6 = \kappa + 6 \times \gamma^{1/2} + 0.5 \times \mu \leq 62$. The long side of the γ phase is at most 25 μm, the long side of the μ phase is at most 20 μm, and the κ phase is present within the α phase.

4 Claims, 2 Drawing Sheets

(56) References Cited

FOREIGN PATENT DOCUMENTS

| | | | |
|---|---|---|---|
| WO | 2007/034571 | A1 | 3/2007 |
| WO | 2008/081947 | A1 | 7/2008 |
| WO | 2012/057055 | A1 | 5/2012 |
| WO | 2013/065830 | A1 | 5/2013 |
| WO | 2015/166998 | A1 | 11/2015 |
| WO | 2018/034280 | A1 | 2/2018 |
| WO | 2018/034281 | A1 | 2/2018 |
| WO | 2018/034282 | A1 | 2/2018 |
| WO | 2018/034283 | A1 | 2/2018 |
| WO | 2018/034284 | A1 | 2/2018 |
| WO | 2019/035224 | A1 | 2/2019 |
| WO | 2019/035226 | A1 | 2/2019 |

OTHER PUBLICATIONS

Office Action issued in Japanese patent application No. 2017-567265 dated Apr. 3, 2018, (Machine translation obtained by Global Dossier on Dec. 14, 2018).

International Search Report issued in application PCT/JP2017/029374 dated Nov. 7, 2017.

Office Action issued in Japanese patent application No. 2017-567262 dated Apr. 10, 2018 (Machine translation obtained by Global Dossier on Dec. 13, 2018).

International Search Report issued in application PCT/JP2017/029373 dated Nov. 7, 2017.

International Search Report issued in application PCT/JP2018/006245 dated May 15, 2018.

International Search Report issued in application PCT/JP2018/006218 dated May 15, 2018.

Office Action issued in Japanese patent application No. 2018-530923 dated Aug. 7, 2018 (Machine translation obtained by Global Dossier on May 8, 2019).

Opposition issued in Japanese patent application No. 2017-567267 dated Mar. 5, 2019 (w/machine translation).

Opposition issued in Japanese patent application No. 2017-567265 dated Mar. 27, 2019 (w/machine translation).

Opposition issued in Japanese patent application No. 2017-567266 dated Mar. 27, 2019 (w/machine translation).

Genjiro Mima, Masaharu Hasegawa, Journal of the Japan Copper and Brass ResearchAssociation, 2 (1963), p. 62-77 (w/partial translation).

JCBAT204 : 2005 "Lead-less free-cutting brass bar", Japan Copper and Brass Association technical standard (w/machine translation).

Office Action issued in Indian Patent Application 201917005548 dated Jan. 6, 2021.

Office Action issued in U.S. Appl. No. 16/324,684 dated Dec. 22, 2020.

Office Action issued in co-pending related U.S. Appl. No. 16/325,029 dated Oct. 27, 2020.

* cited by examiner

HIGH-STRENGTH FREE-CUTTING COPPER ALLOY AND METHOD FOR PRODUCING HIGH-STRENGTH FREE-CUTTING COPPER ALLOY

This application is a division of U.S. application Ser. No. 16/488,028, filed Aug. 22, 2019, which is a National Phase Application in the United States of International Patent Application No. PCT/JP2018/006218 filed Feb. 21, 2018, which claims priority on International Patent Application Nos. PCT/JP2017/029369, PCT/JP2017/029371, PCT/JP2017/029373, PCT/JP2017/029374, and PCT/JP2017/029376, filed Aug. 15, 2017. The entire disclosures of the above patent applications are hereby incorporated by reference.

TECHNICAL FIELD

The present invention relates to a high-strength free-cutting copper alloy having high strength, high-temperature strength, excellent ductility and impact resistance as well as good corrosion resistance, in which the lead content is significantly reduced, and a method of manufacturing the high-strength free-cutting copper alloy. In particular, the present invention relates to a high-strength free-cutting copper alloy used in a harsh environment for valves, fittings, pressure vessels and the like for electrical uses, automobiles, machines, and industrial plumbing, vessels, valves, and fittings involving hydrogen as well as for devices used for drinking water such as faucets, valves, and fittings, and a method of manufacturing the high-strength free-cutting copper alloy.

Priority is claimed on PCT International Patent Application Nos. PCT/JP2017/29369, PCT/JP2017/29371, PCT/JP2017/29373, PCT/JP2017/29374, and PCT/JP2017/29376, filed on Aug. 15 2017, the content of which is incorporated herein by reference.

BACKGROUND ART

Conventionally, as a copper alloy that is used in devices for drinking water and valves, fittings, pressure vessels and the like for electrical uses, automobiles, machines, and industrial plumbing, a Cu—Zn—Pb alloy including 56 to 65 mass % of Cu, 1 to 4 mass % of Pb, and a balance of Zn (so-called free-cutting brass), or a Cu—Sn—Zn—Pb alloy including 80 to 88 mass % of Cu, 2 to 8 mass % of Sn, 2 to 8 mass % of Pb, and a balance of Zn (so-called bronze: gunmetal) was generally used.

However, recently, Pb's influence on a human body or the environment is a concern, and a movement to regulate Pb has been extended in various countries. For example, a regulation for reducing the Pb content in drinking water supply devices to be 0.25 mass % or lower has come into force from January, 2010 in California, the United States and from January, 2014 across the United States. It is said that a regulation for limiting the amount of Pb to about 0.05 mass % will come into force in the near future considering its influence on infants and the like. In countries other than the United States, a movement of the regulation has become rapid, and the development of a copper alloy material corresponding to the regulation of the Pb content has been required.

In addition, in other industrial fields such as automobiles, machines, and electrical and electronic apparatuses industries, for example, in ELV Directives and RoHS Directives of the Europe, free-cutting copper alloys are exceptionally allowed to contain 4 mass % Pb. However, as in the field of drinking water, strengthening of regulations on Pb content including elimination of exemptions has been actively discussed.

Under the trend of the strengthening of the regulations on Pb in free-cutting copper alloys, copper alloys that includes Bi or Se having a machinability improvement function instead of Pb, or Cu—Zn alloys including a high concentration of Zn in which the amount of β phase is increased to improve machinability have been proposed.

For example, Patent Document 1 discloses that corrosion resistance is insufficient with mere addition of Bi instead of Pb, and proposes a method of slowly cooling a hot extruded rod to 180° C. after hot extrusion and further performing a heat treatment thereon in order to reduce the amount of β phase to isolate β phase.

In addition, Patent Document 2 discloses a method of improving corrosion resistance by adding 0.7 to 2.5 mass % of Sn to a Cu—Zn—Bi alloy to precipitate γ phase of a Cu—Zn—Sn alloy.

However, the alloy including Bi instead of Pb as disclosed in Patent Document 1 has a problem in corrosion resistance. In addition, Bi has many problems in that, for example, Bi may be harmful to a human body as with Pb, Bi has a resource problem because it is a rare metal, and Bi embrittles a copper alloy material. Further, even in cases where β phase is isolated to improve corrosion resistance by performing slow cooling or a heat treatment after hot extrusion as disclosed in Patent Documents 1 and 2, corrosion resistance is not improved at all in a harsh environment.

In addition, even in cases where γ phase of a Cu—Zn—Sn alloy is precipitated as disclosed in Patent Document 2, this γ phase has inherently lower corrosion resistance than α phase, and corrosion resistance is not improved at all in a harsh environment. In addition, in Cu—Zn—Sn alloys, γ phase including Sn has a low machinability improvement function, and thus it is also necessary to add Bi having a machinability improvement function.

On the other hand, regarding copper alloys including a high concentration of Zn, β phase has a lower machinability function than Pb. Therefore, such copper alloys cannot be replacement for free-cutting copper alloys including Pb. In addition, since the copper alloy includes a large amount of β phase, corrosion resistance, in particular, dezincification corrosion resistance or stress corrosion cracking resistance is extremely poor. In addition, these copper alloys have a low strength, in particular, under high temperature (for example, about 150° C.), and thus cannot realize a reduction in thickness and weight, for example, in automobile components used under high temperature near the engine room when the sun is blazing, or in valves and plumbing used under high temperature and high pressure. Further, for example, pressure vessels, valves, and plumbing relating to high pressure hydrogen have low tensile strength and thus can be used only under low normal operation pressure.

Further, Bi embrittles copper alloy, and when a large amount of β phase is contained, ductility deteriorates. Therefore, copper alloy including Bi or a large amount of β phase is not appropriate for components for automobiles or machines, or electrical components or for materials for drinking water supply devices such as valves. Regarding brass including γ phase in which Sn is added to a Cu—Zn alloy, Sn cannot improve stress corrosion cracking, strength under normal temperature and high temperature is low, and impact resistance is poor. Therefore, the brass is not appropriate for the above-described uses.

On the other hand, for example, Patent Documents 3 to 9 disclose Cu—Zn—Si alloys including Si instead of Pb as free-cutting copper alloys.

The copper alloys disclosed in Patent Documents 3 and 4 have an excellent machinability without containing Pb or containing only a small amount of Pb that is mainly realized by superb machinability-improvement function of γ phase. Addition of 0.3 mass % or higher of Sn can increase and promote the formation of γ phase having a function to improve machinability. In addition, Patent Documents 3 and 4 disclose a method of improving corrosion resistance by forming a large amount of γ phase.

In addition, Patent Document 5 discloses a copper alloy including an extremely small amount (0.02 mass % or less) of Pb having excellent machinability that is mainly realized by simply defining the total area of γ phase and κ phase considering the Pb content. Here, Sn functions to form and increase γ phase such that erosion-corrosion resistance is improved.

Further, Patent Documents 6 and 7 propose a Cu—Zn—Si alloy casting. The documents disclose that in order to refine crystal grains of the casting, extremely small amounts of P and Zr are added, and the P/Zr ratio or the like is important.

In addition, in Patent Document 8, proposes a copper alloy in which Fe is added to a Cu—Zn—Si alloy is proposed.

Further, Patent Document 9, proposes a copper alloy in which Sn, Fe, Co, Ni, and Mn are added to a Cu—Zn—Si alloy.

Here, in Cu—Zn—Si alloys, it is known that, even when looking at only those having Cu concentration of 60 mass % or higher, Zn concentration of 30 mass % or lower, and Si concentration of 10 mass % or lower as described in Patent Document 10 and Non-Patent Document 1, 10 kinds of metallic phases including matrix α phase, β phase, γ phase, δ phase, ε phase, ζ phase, η phase, κ phase, μ phase, and χ phase, in some cases, 13 kinds of metallic phases including α', β', and γ' in addition to the 10 kinds of metallic phases are present. Further, it is empirically known that, as the number of additive elements increases, the metallographic structure becomes complicated, or a new phase or an intermetallic compound may appear. In addition, it is also empirically known that there is a large difference in the constitution of metallic phases between an alloy according to an equilibrium diagram and an actually produced alloy. Further, it is well known that the composition of these phases may change depending on the concentrations of Cu, Zn, Si, and the like in the copper alloy and processing heat history.

Apropos, γ phase has excellent machinability but contains high concentration of Si and is hard and brittle. Therefore, when a large amount of γ phase is contained, problems arise in corrosion resistance, ductility, impact resistance, high-temperature strength (high temperature creep), normal temperature strength, and cold workability in a harsh environment. Therefore, use of Cu—Zn—Si alloys including a large amount of γ phase is also restricted like copper alloys including Bi or a large amount of β phase.

Incidentally, the Cu—Zn—Si alloys described in Patent Documents 3 to 7 exhibit relatively satisfactory results in a dezincification corrosion test according to ISO-6509. However, in the dezincification corrosion test according to ISO-6509, in order to determine whether or not dezincification corrosion resistance is good or bad in water of ordinary quality, the evaluation is merely performed after a short period of time of 24 hours using a reagent of cupric chloride which is completely unlike water of actual water quality. That is, the evaluation is performed for a short period of time using a reagent which only provides an environment that is different from the actual environment, and thus corrosion resistance in a harsh environment cannot be sufficiently evaluated.

In addition, Patent Document 8 proposes that Fe is added to a Cu—Zn—Si alloy. However, Fe and Si form an Fe—Si intermetallic compound that is harder and more brittle than γ phase. This intermetallic compound has problems like reduced tool life of a cutting tool during cutting and generation of hard spots during polishing such that the external appearance is impaired. In addition, since Si is consumed when the intermetallic compound is formed, the performance of the alloy deteriorates.

Further, in Patent Document 9, Sn, Fe, Co, and Mn are added to a Cu—Zn—Si alloy. However, each of Fe, Co, and Mn combines with Si to form a hard and brittle intermetallic compound. Therefore, such addition causes problems during cutting or polishing as disclosed by Document 8. Further, according to Patent Document 9, β phase is formed by addition of Sn and Mn, but β phase causes serious dezincification corrosion and causes stress corrosion cracking to occur more easily.

RELATED ART DOCUMENT

Patent Document

[Patent Document 1] JP-A-2008-214760
[Patent Document 2] WO2008/081947
[Patent Document 3] JP-A-2000-119775
[Patent Document 4] JP-A-2000-119774
[Patent Document 5] WO2007/034571
[Patent Document 6] WO2006/016442
[Patent Document 7] WO2006/016624
[Patent Document 8] JP-T-2016-511792
[Patent Document 9] JP-A-2004-263301
[Patent Document 10] U.S. Pat. No. 4,055,445
[Patent Document 11] WO2012/057055
[Patent Document 12] JP-A-2013-104071

Non-Patent Document

[Non-Patent Document 1] Genjiro MIMA, Masaharu HASEGAWA, Journal of the Japan Copper and Brass Research Association, 2 (1963), pages 62 to 77

SUMMARY OF THE INVENTION

Problem that the Invention is to Solve

The present invention has been made in order to solve the above-described problems of the conventional art, and an object thereof is to provide a high-strength free-cutting copper alloy having excellent strength under normal temperature and high temperature, excellent impact resistance and ductility, as well as good corrosion resistance in a harsh environment, and a method of manufacturing the high-strength free-cutting copper alloy. In this specification, unless specified otherwise, corrosion resistance refers to both dezincification corrosion resistance and stress corrosion cracking resistance. In addition, a hot worked material refers to a hot extruded material, a hot forged material, or a hot rolled material. Cold workability refers to workability of cold working such as swaging or bending. High temperature properties refer to high temperature creep and tensile strength at about 150° C. (100° C. to 250° C.). Cooling rate refers to an average cooling rate in a given temperature range.

Means for Solving the Problem

In order to achieve the object by solving the problems, a high-strength free-cutting copper alloy according to the first aspect of the present invention includes:

75.4 mass % to 78.0 mass % of Cu;

3.05 mass % to 3.55 mass % of Si;

0.05 mass % to 0.13 mass % of P;

0.005 mass % to 0.070 mass % of Pb; and a balance including Zn and inevitable impurities, wherein a content of Sn present as inevitable impurity is 0.05 mass % or lower, a content of Al present as inevitable impurity is 0.05 mass % or lower, and a total content of Sn and Al present as inevitable impurity is 0.06 mass % or lower, when a Cu content is represented by [Cu] mass %, a Si content is represented by [Si] mass %, a Pb content is represented by [Pb] mass %, and a P content is represented by [P] mass %, the relations of $$78.0 \leq f1=[Cu]+0.8\times[Si]+[P]+[Pb] \leq 80.8 \text{ and}$$

$$60.2 \leq f2=[Cu]-4.7\times[Si]-[P]+0.5\times[Pb] \leq 61.5$$

are satisfied, in constituent phases of metallographic structure, when an area ratio of α phase is represented by (α) %, an area ratio of β phase is represented by (β) %, an area ratio of γ phase is represented by (γ) %, an area ratio of κ phase is represented by (κ) %, and an area ratio of μ phase is represented by (μ) %, the relations of $$29 \leq (\kappa) \leq 60,$$

$$0 \leq (\gamma) \leq 0.3,$$

$$(\beta)=0,$$

$$0 \leq (\mu) \leq 1.0,$$

$$98.6 \leq f3=(\alpha)+(\kappa),$$

$$99.7 \leq f4=(\alpha)+(\kappa)+(\gamma)+(\mu),$$

$$0 \leq f5=(\gamma)+(\mu) \leq 1.2, \text{ and}$$

$$30 \leq f6=(\kappa)+6\times(\gamma)^{1/2}+0.5\times(\mu) \leq 62$$

are satisfied, the length of the long side of γ phase is 25 μm or less, the length of the long side of μ phase is 20 μm or less, and κ phase is present in α phase.

According to the second aspect of the present invention, the high-strength free-cutting copper alloy according to the first aspect further includes:

one or more element(s) selected from the group consisting of 0.01 mass % to 0.07 mass % of Sb, 0.02 mass % to 0.07 mass % of As, and 0.005 mass % to 0.10 mass % of Bi.

A high-strength free-cutting copper alloy according to the third aspect of the present invention includes:

75.6 mass % to 77.8 mass % of Cu;

3.15 mass % to 3.5 mass % of Si;

0.06 mass % to 0.12 mass % of P;

0.006 mass % to 0.045 mass % of Pb; and a balance including Zn and inevitable impurities, wherein a content of Sn present as inevitable impurity is 0.03 mass % or lower, a content of Al present as inevitable impurity is 0.03 mass % or lower, and a total content of Sn and Al present as inevitable impurity is 0.04 mass % or lower, when a Cu content is represented by [Cu] mass %, a Si content is represented by [Si] mass %, a Pb content is represented by [Pb] mass %, and a P content is represented by [P] mass %, the relations of $$78.5 \leq f1=[Cu]+0.8\times[Si]+[P]+[Pb] \leq 80.5 \text{ and}$$

$$60.4 \leq f2=[Cu]-4.7\times[Si]-[P]+0.5\times[Pb] \leq 61.3$$

are satisfied, in constituent phases of metallographic structure, when an area ratio of α phase is represented by (α) %, an area ratio of β phase is represented by (β) %, an area ratio of γ phase is represented by (γ) %, an area ratio of κ phase is represented by (κ) %, and an area ratio of μ phase is represented by (μ) %, the relations of $$33 \leq (\kappa) \leq 58,$$

$$(\gamma)=0,$$

$$(\beta)=0,$$

$$0 \leq (\mu) \leq 0.5,$$

$$99.3 \leq f3=(\alpha)+(\kappa),$$

$$99.8 \leq f4=(\alpha)+(\kappa)+(\gamma)+(\mu),$$

$$0 \leq f5=(\gamma)+(\mu) \leq 0.5, \text{ and}$$

$$33 \leq f6=(\kappa)+6\times(\gamma)^{1/2}+0.5\times(\mu) \leq 58$$

are satisfied,

κ phase is present in α phase, and the length of the long side of μ phase is 15 μm or less.

According to the fourth aspect of the present invention, the high-strength free-cutting copper alloy according to the third aspect further includes:

one or more element(s) selected from the group consisting of 0.012 mass % to 0.05 mass % of Sb, 0.025 mass % to 0.05 mass % of As, and 0.006 mass % to 0.05 mass % of Bi, wherein a total content of Sb, As, and Bi is 0.09 mass % or lower.

According to the fifth aspect of the present invention, in the high-strength free-cutting copper alloy according to any one of the first to fourth aspects of the present invention, a total amount of Fe, Mn, Co, and Cr as the inevitable impurities is lower than 0.08 mass %.

According to the sixth aspect of the present invention, in the high-strength free-cutting copper alloy according to any one of the first to fifth aspects of the present invention, a Charpy impact test value when a U-notched specimen is used is 12 J/cm$^2$ to 50 J/cm$^2$, a tensile strength at normal temperature is 550 N/mm$^2$ or higher, and a creep strain after holding the copper alloy at 150° C. for 100 hours in a state where a load corresponding to 0.2% proof stress at room temperature is applied is 0.3% or lower.

Incidentally, the Charpy impact test value is a value obtained when a specimen with a U-shaped notch is used.

According to the seventh aspect of the present invention, the high-strength free-cutting copper alloy according to any one of the first to fifth aspects of the present invention is a hot worked material, wherein a tensile strength S (N/mm$^2$) is 550 N/mm$^2$ or higher, an elongation E (%) is 12% or higher, a Charpy impact test value I (J/cm$^2$) when a U-notched specimen is used is 12 J/cm$^2$ or higher, and $$675 \leq f8 = S \times \{(E+100)/100\}^{1/2} \text{ or } 700 \leq f9 = S \times \{(E+100)/100\}^{1/2} + I$$

is satisfied.

According to the eighth aspect of the present invention, the high-strength free-cutting copper alloy according to any one of the first to seventh aspects of the present invention is for use in a water supply device, an industrial plumbing component, a device that comes in contact with liquid or gas, a pressure vessel, a fitting, an automobile component, or an electric appliance component.

The method of manufacturing a high-strength free-cutting copper alloy according to the ninth aspect of the present invention is a method of manufacturing the high-strength free-cutting copper alloy according to any one of the first to eighth aspects of the present invention which includes:

any one or both of a cold working step and a hot working step; and an annealing step that is performed after the cold working step or the hot working step, wherein in the annealing step, the copper alloy is heated or cooled under any one of the following conditions (1) to (4):

(1) the copper alloy is held at a temperature of 525° C. to 575° C. for 15 minutes to 8 hours;

(2) the copper alloy is held at a temperature of 505° C. or higher and lower than 525° C. for 100 minutes to 8 hours;

(3) the maximum reaching temperature is 525° C. to 620° C. and the copper alloy is held in a temperature range from 575° C. to 525° C. for 15 minutes or longer; or (4) the copper alloy is cooled in a temperature range from 575° C. to 525° C. at an average cooling rate of 0.1° C./min to 3° C./min, and subsequently, the copper alloy is cooled in a temperature range from 450° C. to 400° C. at an average cooling rate of 3° C./min to 500° C./min.

The method of manufacturing a high-strength free-cutting copper alloy according to the tenth aspect of the present invention is a method of manufacturing the high-strength free-cutting copper alloy according to any one of the first to sixth aspects of the present invention which includes:

a casting step, and an annealing step that is performed after the casting step, wherein in the annealing step, the copper alloy is heated or cooled under any one of the following conditions (1) to (4):

(1) the copper alloy is held at a temperature of 525° C. to 575° C. for 15 minutes to 8 hours;

(2) the copper alloy is held at a temperature of 505° C. or higher and lower than 525° C. for 100 minutes to 8 hours;

(3) the maximum reaching temperature is 525° C. to 620° C. and the copper alloy is held in a temperature range from 575° C. to 525° C. for 15 minutes or longer; or (4) the copper alloy is cooled in a temperature range from 575° C. to 525° C. at an average cooling rate of 0.1° C./min to 3° C./min, and subsequently, the copper alloy is cooled in a temperature range from 450° C. to 400° C. at an average cooling rate of 3° C./min to 500° C./min.

The method of manufacturing a high-strength free-cutting copper alloy according to the eleventh aspect of the present invention is a method of manufacturing the high-strength free-cutting copper alloy according to any one of the first to eighth aspects of the present invention which includes:

a hot working step, wherein the material's temperature during hot working is 600° C. to 740° C., and in the process of cooling after hot plastic working, the material is cooled in a temperature range from 575° C. to 525° C. at an average cooling rate of 0.1° C./min to 3° C./min and subsequently is cooled in a temperature range from 450° C. to 400° C. at an average cooling rate of 3° C./min to 500° C./min.

The method of manufacturing a high-strength free-cutting copper alloy according to the twelfth aspect of the present invention is a method of manufacturing the high-strength free-cutting copper alloy according to any one of the first to eighth aspects of the present invention which includes:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C.;

the heating time is in a range of 10 minutes to 300 minutes; and when the material's temperature is represented by T° C. and the heating time is represented by t min, $150 \leq (T-220) \times (t)^{1/2} \leq 1200$ is satisfied.

Advantage of the Invention

According to the aspects of the present invention, a metallographic structure in which γ phase that has an excellent machinability-improving function but has poor corrosion resistance, ductility, impact resistance and high-temperature strength (high temperature creep) is reduced as much as possible or is entirely removed, μ phase that is effective for machinability is reduced as much as possible or is entirely removed, and also, κ phase, which is effective to improve strength, machinability, and corrosion resistance, is present in α phase is defined. Further, a composition and a manufacturing method for obtaining this metallographic structure are defined. Therefore, according to the aspects of the present invention, it is possible to provide a high-strength free-cutting copper alloy having high normal-temperature strength and high-temperature strength, excellent impact resistance, ductility, wear resistance, pressure-resistant properties, cold workability such as facility of swaging or bending, and corrosion resistance, and a method of manufacturing the high-strength free-cutting copper alloy.

BEST MODE FOR CARRYING OUT THE INVENTION

Figure 1:
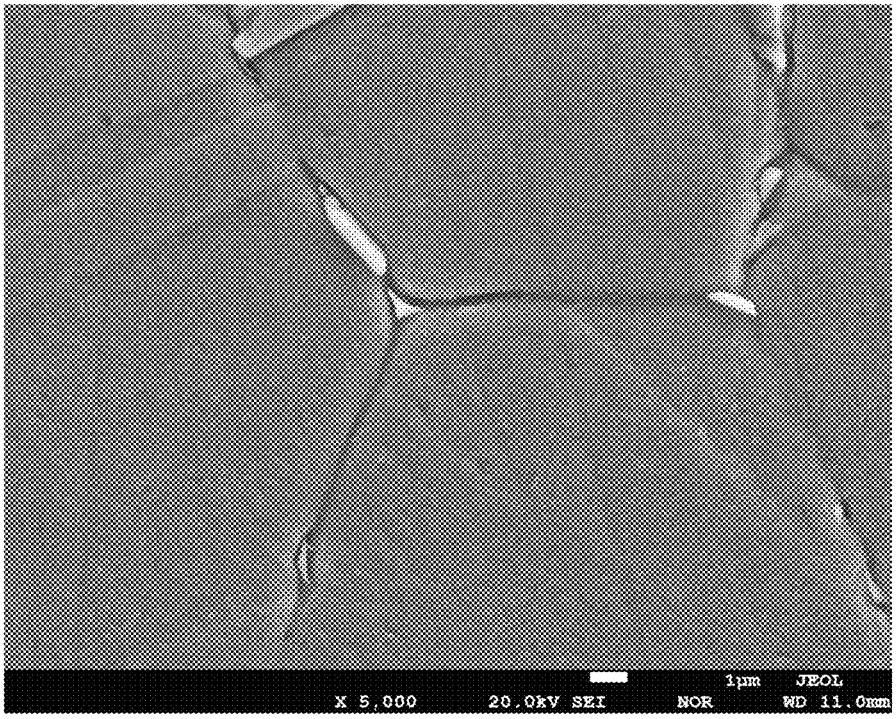
FIG. 1 is an electron micrograph of a metallographic structure of a high-strength free-cutting copper alloy (Test No. T05) according to Example 1.

Below is a description of high-strength free-cutting copper alloys according to the embodiments of the present invention and the methods of manufacturing the high-strength free-cutting copper alloys.

The high-strength free-cutting copper alloys according to the embodiments are for use in components for electrical uses, automobiles, machines and industrial plumbing such as valves, fittings, or sliding components, devices, components, pressure vessels, or fittings that come in contact with liquid or gas, and devices such as faucets, valves, or fittings to supply drinking water for daily human consumption.

Here, in this specification, an element symbol in parentheses such as [Zn] represents the content (mass %) of the element.

In the embodiment, using this content expressing method, a plurality of composition relational expressions are defined as follows.

$$f1=[Cu]+0.8\times[Si]+[P]+[Pb] \quad \text{Composition Relational Expression}$$

$$f2=[Cu]-4.7\times[Si]-[P]+0.5\times[Pb] \quad \text{Composition Relational Expression}$$

Further, in the embodiments, in constituent phases of metallographic structure, an area ratio of α phase is represented by (α) %, an area ratio of β phase is represented by (β) %, an area ratio of γ phase is represented by (γ) %, an area ratio of κ phase is represented by (κ) %, and an area ratio of μ phase is represented by (μ) %. Constituent phases of metallographic structure refer to α phase, γ phase, κ phase, and the like and do not include intermetallic compound, precipitate, non-metallic inclusion, and the like. In addition, κ phase present in α phase is included in the area ratio of α phase. The sum of the area ratios of all the constituent phases is 100%.

In the embodiments, a plurality of metallographic structure relational expressions are defined as follows.

$$f3=(\alpha)+(\kappa) \quad \text{Metallographic Structure Relational Expression}$$

$$f4=(\alpha)+(\kappa)+(\gamma)+(\mu) \quad \text{Metallographic Structure Relational Expression}$$

$$f5=(\gamma)+(\mu) \quad \text{Metallographic Structure Relational Expression}$$

$$f6=(\kappa)+6\times(\gamma)^{1/2}+0.5\times(\mu) \quad \text{Metallographic Structure Relational Expression}$$

A high-strength free-cutting copper alloy according to the first embodiment of the present invention includes: 75.4 mass % to 78.0 mass % of Cu; 3.05 mass % to 3.55 mass % of Si; 0.05 mass % to 0.13 mass % of P; 0.005 mass % to 0.070 mass % of Pb; and a balance including Zn and inevitable impurities. A content of Sn present as inevitable impurity is 0.05 mass % or lower, a content of Al present as inevitable impurity is 0.05 mass % or lower, and a total content of Sn and Al present as inevitable impurity is 0.06 mass % or lower. The composition relational expression f1 is in a range of $78.0\leq f1\leq 80.8$, and the composition relational expression f2 is in a range of $60.2\leq f2\leq 61.5$. The area ratio of κ phase is in a range of $29\leq(\kappa)\leq 60$, the area ratio of γ phase is in a range of $0\leq(\gamma)\leq 0.3$, the area ratio of β phase is zero ((β)=0), and the area ratio of μ phase is in a range of $0\leq(\mu)\leq 1.0$. The metallographic structure relational expression f3 is $98.6\leq f3$, the metallographic structure relational expression f4 is $99.7\leq f4$, the metallographic structure relational expression f5 is in a range of $0\leq f5\leq 1.2$, and the metallographic structure relational expression f6 is in a range of $30\leq f6\leq 62$. The length of the long side of γ phase is 25 μm or less, the length of the long side of μ phase is 20 μm or less, and κ phase is present in α phase.

A high-strength free-cutting copper alloy according to the second embodiment of the present invention includes: 75.6 mass % to 77.8 mass % of Cu; 3.15 mass % to 3.5 mass % of Si; 0.06 mass % to 0.12 mass % of P; 0.006 mass % to 0.045 mass % of Pb; and a balance including Zn and inevitable impurities. A content of Sn present as inevitable impurity is 0.03 mass % or lower, a content of Al present as inevitable impurity is 0.03 mass % or lower, and a total content of Sn and Al present as inevitable impurity is 0.04 mass % or lower. The composition relational expression f1 is in a range of $78.5\leq f1\leq 80.5$, and the composition relational expression f2 is in a range of $60.4\leq f2\leq 61.3$. The area ratio of κ phase is in a range of $33\leq(\kappa)\leq 58$, the area ratios of γ phase and β phase is zero ((γ)=0, (β)=0), and the area ratio of μ phase is in a range of $0\leq(\mu)\leq 0.5$. The metallographic structure relational expression f3 is $99.3\leq f3$, the metallographic structure relational expression f4 is $99.8\leq f4$, the metallographic structure relational expression f5 is in a range of $0\leq f5\leq 0.5$, and the metallographic structure relational expression f6 is in a range of $33\leq f6\leq 58$. κ phase is present in α phase, and the length of the long side of μ phase is 15 μm or less.

In addition, the high-strength free-cutting copper alloy according to the first embodiment of the present invention may further include one or more element(s) selected from the group consisting of 0.01 mass % to 0.07 mass % of Sb, 0.02 mass % to 0.07 mass % of As, and 0.005 mass % to 0.10 mass % of Bi.

In addition, the high-strength free-cutting copper alloy according to the second embodiment of the present invention may further include one or more element(s) selected from the group consisting of 0.012 mass % to 0.05 mass % of Sb, 0.025 mass % to 0.05 mass % of As, and 0.006 mass % to 0.05 mass % of Bi, but the total content of Sb, As, and Bi needs to be 0.09 mass % or less.

In the high-strength free-cutting copper alloy according to the first and second embodiments of the present invention, it is preferable that a total amount of Fe, Mn, Co, and Cr as the inevitable impurities is lower than 0.08 mass %.

In addition, in the high-strength free-cutting copper alloy according to the first or second embodiment of the present invention, it is preferable that a Charpy impact test value when a U-notched specimen is used is 12 J/cm$^2$ or higher and 50 J/cm$^2$ or lower, and it is preferable that a tensile strength at room temperature (normal temperature) is 550 N/mm$^2$ or higher, and a creep strain after holding the copper alloy at 150° C. for 100 hours in a state where 0.2% proof stress (load corresponding to 0.2% proof stress) at room temperature is applied is 0.3% or lower.

Regarding a relation between a tensile strength S (N/mm$^2$), an elongation E (%), a Charpy impact test value I (J/cm$^2$) in the high-strength free-cutting copper alloy (hot worked material) having undergone hot working according to the first or second embodiment of the present invention, it is preferable the tensile strength S is 550 N/mm$^2$ or higher, the elongation E is 12% or higher, the Charpy impact test value I (J/cm$^2$) when a U-notched specimen is used is 12 J/cm$^2$ or higher, and the value of $f8=S\times\{(E+100)/100\}^{1/2}$, which is the product of the tensile strength (S) and the value of {(Elongation (E)+100)/100} raised to the power ½, is 675 or higher or $f9=S\times\{(E+100)/100\}^{1/2}+I$, which is the sum of f8 and I, is 700 or higher.

The reason why the component composition, the composition relational expressions f1 and f2, the metallographic structure, the metallographic structure relational expressions f3, f4, f5, and f6, and the mechanical properties are defined as above is explained below.

<Component Composition>

(Cu)

Cu is a main element of the alloys according to the embodiments. In order to achieve the object of the present invention, it is necessary to add at least 75.4 mass % or higher amount of Cu. When the Cu content is lower than 75.4 mass %, the proportion of γ phase is higher than 0.3% although depending on the contents of Si, Zn, Sn, and Pb and the manufacturing process, corrosion resistance, impact resistance, ductility, normal-temperature strength, and high-temperature property (high temperature creep) deteriorate. In some cases, β phase may also appear. Accordingly, the lower limit of the Cu content is 75.4 mass % or higher, preferably 75.6 mass % or higher, more preferably 75.8 mass % or higher, and most preferably 76.0 mass % or higher.

On the other hand, when the Cu content is higher than 78.0 mass %, the effects on corrosion resistance, normal-temperature strength, and high-temperature strength are saturated, and the proportion of κ phase may become excessively high even though γ phase decreases. In addition, μ phase having a high Cu concentration, in some cases, ζ phase and χ phase are more likely to precipitate. As a result, machinability, ductility, impact resistance, and hot workability may deteriorate although depending on the conditions of the metallographic structure. Accordingly, the upper limit of the Cu content is 78.0 mass % or lower, preferably 77.8 mass % or lower, 77.5 mass % or lower if ductility and impact resistance are important, and more preferably 77.3 mass % or lower.

(Si)

Si is an element necessary for obtaining most of excellent properties of the alloy according to the embodiment. Si contributes to the formation of metallic phases such as κ phase, γ phase, μ phase, β phase, or ζ phase. Si improves machinability, corrosion resistance, strength, high temperature properties, and wear resistance of the alloy according to the embodiment. In the case of α phase, inclusion of Si does not substantially improve machinability. However, due to α phase such as γ phase, κ phase, or μ phase that is formed by inclusion of Si and is harder than α phase, excellent machinability can be obtained without including a large amount of Pb. However, as the proportion of the metallic phase such as γ phase or μ phase increases, a problem of deterioration in ductility, impact resistance, or cold workability, a problem of deterioration of corrosion resistance in a harsh environment, and a problem in high temperature properties for withstanding long-term use arise. κ phase is useful for improving machinability or strength. However, if the amount of κ phase is excessive, ductility, impact resistance, and workability deteriorates and, in some cases, machinability also deteriorates. Therefore, it is necessary to define κ phase, γ phase, μ phase, and β phase to be in an appropriate range.

In addition, Si has an effect of significantly suppressing evaporation of Zn during melting or casting. Further, as the Si content increases, the specific gravity can be reduced.

In order to solve these problems of a metallographic structure and to satisfy all the properties, it is necessary to contain 3.05 mass % or higher of Si although depending on the contents of Cu, Zn, and the like. The lower limit of the Si content is preferably 3.1 mass % or higher, more preferably 3.15 mass % or higher, and still more preferably 3.2 mass % or higher. In particular, when strength is important, the lower limit of the Si content is preferably 3.25 mass % or higher. It may look as if the Si content should be reduced in order to reduce the proportion of γ phase or μ phase having a high Si concentration. However, as a result of a thorough study on a mixing ratio between Si and another element and the manufacturing process, it was found that it is necessary to define the lower limit of the Si content as described above. In addition, although largely depending on the contents of other elements, the composition relational expressions f1 and f2, and the manufacturing process, once Si content reaches about 3.0 mass %, elongated acicular κ phase starts to be present in a phase, and when the Si content is about 3.15 mass % or higher, the amount of acicular κ phase further increases, and when the Si content reaches about 3.25 mass %, the presence of acicular κ phase becomes remarkable. Due to the presence of κ phase in α phase, machinability, tensile strength, high temperature properties, impact resistance, and wear resistance are improved without deterioration in ductility. Hereinafter, κ phase present in α phase will also be referred to as κ1 phase.

On the other hand, when the Si content is excessively high, the amount of κ phase is excessively large. Concurrently, the amount of κ1 phase present in α phase also becomes excessive. When the amount of κ phase is excessively large, originally, problems related to ductility, impact resistance, and machinability of the alloy arise since κ phase has lower ductility and is harder than α phase. In addition, when the amount of κ1 phase is excessively large, the ductility of α phase itself is impaired, and the ductility of the alloy deteriorates. The embodiment aims primarily to obtain not only high strength but also excellent ductility (elongation) and impact resistance. Therefore, the upper limit of the Si content is 3.55 mass % or lower and preferably 3.5 mass % or lower. In particular, when ductility, impact resistance, or cold workability of swaging or the like is important, the upper limit of the Si content is more preferably 3.45 mass % or lower and still more preferably 3.4 mass % or lower.

(Zn)

Zn is a main element of the alloy according to the embodiments together with Cu and Si and is required for improving machinability, corrosion resistance, strength, and castability. Zn is included in the balance, but to be specific, the upper limit of the Zn content is about 21.5 mass % or lower, and the lower limit thereof is about 17.5 mass % or higher.

(Pb)

Inclusion of Pb improves the machinability of the copper alloy. About 0.003 mass % of Pb is solid-solubilized in the matrix, and the amount of Pb in excess of 0.003 mass % is present in the form of Pb particles having a diameter of about 1 μm. Pb has an effect of improving machinability even with a small amount of inclusion. In particular, when the Pb content is 0.005 mass % or higher, a significant effect starts to be exhibited. In the alloy according to the embodiment, the proportion of γ phase having excellent machinability is limited to be 0.3% or lower. Therefore, even a small amount of Pb can be replacement for γ phase. The lower limit of the Pb content is preferably 0.006 mass % or higher.

On the other hand, Pb is harmful to a human body and affects ductility, impact resistance, normal temperature strength, high temperature strength, and cold workability although such influence can vary depending on the composition and the metallographic structure of the alloy. Therefore, the upper limit of the Pb content is 0.070 mass % or lower, preferably 0.045 mass % or lower, and most preferably lower than 0.020 mass % in view of its influence on human body and environment.

(P)

P significantly improves corrosion resistance in a harsh environment. At the same time, if a small amount of Pb is contained, machinability, tensile strength, and ductility improve.

In order to exhibit the above-described effects, the lower limit of the P content is 0.05 mass % or higher, preferably 0.055 mass % or higher, and more preferably 0.06 mass % or higher.

On the other hand, when P content exceeds 0.13 mass %, the effect of improving corrosion resistance is saturated. In addition, impact resistance, ductility, and cold workability suddenly deteriorate, and machinability also deteriorates instead of improves. Therefore, the upper limit of the P content is 0.13 mass % or lower, preferably 0.12 mass % or lower, and more preferably 0.115 mass % or lower.

(Sb, As, Bi)

As in the case of P and Sn, Sb and As significantly improve dezincification corrosion resistance, in particular, in a harsh environment.

In order to improve corrosion resistance due to inclusion of Sb, it is necessary to contain 0.01 mass % or higher of Sb, and it is preferable to contain 0.012 mass % or higher of Sb. On the other hand, even when the Sb content exceeds 0.07 mass %, the effect of improving corrosion resistance is saturated, and the proportion of γ phase increases instead. Therefore, Sb content is 0.07 mass % or lower and preferably 0.05 mass % or lower.

In addition, in order to improve corrosion resistance due to inclusion of As, it is necessary to contain 0.02 mass % or higher of As, and it is preferable to contain 0.025 mass % or higher of As. On the other hand, even when the As content exceeds 0.07 mass %, the effect of improving corrosion resistance is saturated. Therefore, the As content is 0.07 mass % or lower and preferably 0.05 mass % or lower.

Bi further improves the machinability of the copper alloy. For Bi to exhibits the effect, it is necessary to contain 0.005 mass % or higher of Bi, and it is preferable to contain 0.006 mass % or higher of Bi. On the other hand, whether Bi is harmfulness to human body is uncertain. However, considering the influence on impact resistance, high temperature properties, hot workability, and cold workability, the upper limit of the Bi content is 0.10 mass % or lower and preferably 0.05 mass % or lower.

The embodiment aims to obtain not only high strength but also excellent ductility, cold workability, and toughness. Sb, As, and Bi are elements that improve corrosion resistance and the like, but if their contents are excessively high, the effect of improving corrosion resistance is saturated, and also, ductility, cold workability, and toughness are impaired. Accordingly, the total content of Sb, As, and Bi is preferably 0.10 mass % or lower and more preferably 0.09 mass % or lower.

(Sn, Al, Fe, Cr, Mn, Co, and Inevitable Impurities)

Examples of the inevitable impurities in the embodiment include Al, Ni, Mg, Se, Te, Fe, Mn, Sn, Co, Ca, Zr, Cr, Ti, In, W, Mo, B, Ag, and rare earth elements.

Conventionally, a free-cutting copper alloy is not mainly formed of a good-quality raw material such as electrolytic copper or electrolytic zinc but is mainly formed of a recycled copper alloy. In a subsequent step (downstream step, working step) of the related art, almost all the members and components are machined, and a large amount of a copper alloy is wasted at a proportion of 40 to 80%. Examples of the wasted copper include chips, ends of an alloy material, burrs, runners, and products having manufacturing defects. This wasted copper alloy is the main raw material. If chips and the like are insufficiently separated, alloy becomes contaminated by Pb, Fe, Mn, Se, Te, Sn, P, Sb, As, Bi, Ca, Al, Zr, Ni, or rare earth elements of other free-cutting copper alloys. In addition, the chips include Fe, W, Co, Mo, and the like that originate in tools. The wasted materials include plated product, and thus are contaminated with Ni, Cr, and Sn. Mg, Fe, Cr, Ti, Co, In, Ni, Se, and Te are mixed into pure copper-based scrap. From the viewpoints of reuse of resources and costs, scrap such as chips including these elements is used as a raw material to the extent that such use does not have any adverse effects to the properties at least.

Empirically speaking, a large part of Ni that is mixed into the alloy comes from a scrap and the like, and Ni may be contained in an amount lower than 0.06 mass %, but it is preferable if the content is lower than 0.05 mass %.

Fe, Mn, Co, or Cr forms an intermetallic compound with Si and, in some cases, forms an intermetallic compound with P and affect machinability, corrosion resistance, and other properties. Although depending on the content of Cu, Si, Sn, or P and the relational expression f1 or f2, Fe is likely to combine with Si, and inclusion of Fe may consume the same amount of Si as that of Fe and promotes the formation of a Fe—Si compound that adversely affects machinability. Therefore, the amount of each of Fe, Mn, Co, and Cr is preferably 0.05 mass % or lower and more preferably 0.04 mass % or lower. In particular, the total content of Fe, Mn, Co, and Cr is preferably lower than 0.08 mass %, more preferably 0.06 mass % or lower, and still more preferably 0.05 mass % or lower.

On the other hand, Sn and Al mixed in from other free-cutting copper alloys, plated wasted products, or the like promotes the formation of γ phase in the alloy according to the embodiment. Further, in α phase boundary between α phase and κ phase where γ phase is mainly formed, the concentration of Sn and Al may be increased even when the formation of γ phase does not occur. An increase in the amount of γ phase and segregation of Sn and Al in an α-κ phase boundary (phase boundary between α phase and κ phase) deteriorates ductility, cold workability, impact resistance, and high temperature properties, which may lead to a decrease in tensile strength along with deterioration in ductility. Therefore, it is necessary to limit the amounts of Sn and Al as inevitable impurities. The content of each of Sn and Al is preferably 0.05 mass % or lower and more preferably 0.03 mass % or lower. In addition, the total content of Sn and Al needs to be 0.06 mass % or lower and is more preferably 0.04 mass % or lower.

The total amount of Fe, Mn, Co, Cr, Sn, and Al is preferably 0.10 mass % or lower.

On the other hand, it is not necessary to particularly limit the content of Ag because, in general, Ag can be considered as Cu and does not substantially affect various properties. However, the Ag content is preferably lower than 0.05 mass %.

Te and Se themselves have free-cutting nature, and can be mixed into an alloy in a large amount although it is rare. In consideration of influence on ductility or impact resistance, the content of each of Te and Se is preferably lower than 0.03 mass % and more preferably lower than 0.02 mass %.

The amount of each of Al, Mg, Ca, Zr, Ti, In, W, Mo, B, and rare earth elements as other elements is preferably lower than 0.03 mass %, more preferably lower than 0.02 mass %, and still more preferably lower than 0.01 mass %.

The amount of the rare earth elements refers to the total amount of one or more of Sc, Y, La, Ce, Pr, Nd, Pm, Sm, Eu, Gd, Tb, Dy, Ho, Er, Tm, Tb, and Lu.

In order to obtain particularly excellent ductility, impact resistance, normal-temperature and high-temperature strength, and workability in swaging or the like, it is desirable to manage and limit the amounts of the inevitable impurities.

(Composition Relational Expression f1)

The composition relational expression f1 is an expression indicating a relation between the composition and the metallographic structure. Even if the amount of each of the elements is in the above-described defined range, unless this composition relational expression f1 is satisfied, the properties that the embodiment targets cannot be obtained. When the value of the composition relational expression f1 is lower than 78.0, the proportion of γ phase increases regardless of any adjustment to the manufacturing process, and β phase appears in some cases. In addition, the long side of γ phase increases, and corrosion resistance, ductility, impact resistance, and high temperature properties deteriorate. Accordingly, the lower limit of the composition relational expression f1 is 78.0 or higher, preferably 78.2 or higher, more preferably 78.5 or higher, and still more preferably 78.8 or higher. As the range of the value of the composition relational expression f1 becomes more preferable, the area ratio of γ phase drastically decreases or is reduced to 0%, and ductility, cold workability, impact resistance, normal-temperature strength, high temperature properties, and corrosion resistance improve.

On the other hand, the upper limit of the composition relational expression f1 mainly affects the proportion of κ phase. When the value of the composition relational expression f1 is higher than 80.8, the proportion of κ phase is excessively high from the viewpoints of ductility and impact resistance. In addition, μ phase is more likely to precipitate. When the proportion of κ phase or μ phase is excessively high, ductility, impact resistance, cold workability, high temperature properties, hot workability, corrosion resistance, and machinability deteriorate. Accordingly, the upper limit of the composition relational expression f1 is 80.8 or lower, preferably 80.5 or lower, and more preferably 80.2 or lower.

This way, by defining the composition relational expression f1 to be in the above-described range, a copper alloy having excellent properties can be obtained. As, Sb, and Bi that are selective elements and the inevitable impurities that are separately defined scarcely affect the composition relational expression f1 because the contents thereof are low, and thus are not defined in the composition relational expression f1.

(Composition Relational Expression f2)

The composition relational expression f2 is an expression indicating a relation between the composition and workability, various properties, and the metallographic structure. When the value of the composition relational expression f2 is lower than 60.2, the proportion of γ phase in the metallographic structure increases, and other metallic phases including β phase are more likely to appear and remain. Therefore, corrosion resistance, ductility, impact resistance, cold workability, and high temperature properties deteriorate. In addition, during hot forging, crystal grains are coarsened, and cracking is more likely to occur. Accordingly, the lower limit of the composition relational expression f2 is 60.2 or higher, preferably 60.4 or higher, and more preferably 60.5 or higher.

On the other hand, when the value of the composition relational expression f2 exceeds 61.5, hot deformation resistance is improved, hot deformability deteriorates, and surface cracking may occur in a hot extruded material or a hot forged product. In addition, coarse α phase having a length of more than 1000 μm and a width of more than 200 μm in a direction parallel to a hot working direction is more likely to appear in a metallographic structure. When coarse α phase is present, machinability and strength deteriorate, the length of the long side of γ phase present at a boundary between α phase and κ phase increases, or segregation of Sn or Al is likely to occur even though that would not lead to generation of γ phase. When the value of f2 is high, κ1 phase in α phase is not likely to appear, strength decreases, and machinability, high temperature properties, and wear resistance deteriorate. In addition, the range of solidification temperature, that is, (liquidus temperature-solidus temperature) exceeds 50° C., shrinkage cavities during casting are significant, and sound casting cannot be obtained. Accordingly, the upper limit of the composition relational expression f2 is 61.5 or lower, preferably 61.4 or lower, more preferably 61.3 or lower, and still more preferably 61.2 or lower. When the value of f1 is 60.2 or higher and the upper limit of f2 is a preferable value, crystal grains of α phase are refined to be about 50 μm or less, and α phase is uniformly distributed. As a result, an alloy having higher strength and excellent ductility, cold workability, impact resistance, and high temperature properties and having a good balance between strength and ductility and impact resistance can be obtained.

This way, by defining the composition relational expression f2 to be in the above-described narrow range, a copper alloy having excellent properties can be manufactured with a high yield. As, Sb, and Bi that are selective elements and the inevitable impurities that are separately defined scarcely affect the composition relational expression f2 because the contents thereof are low, and thus are not defined in the composition relational expression f2.

Comparison to Patent Documents

Here, the results of comparing the compositions of the Cu—Zn—Si alloys described in Patent Documents 3 to 12 and the composition of the alloy according to the embodiment are shown in Table 1.

The embodiment and Patent Document 3 are different from each other in the contents of Pb and Sn which is a selective element. The embodiment and Patent Document 4 are different from each other in the contents of Pb and Sn which is a selective element. The embodiment and Patent Documents 6 and 7 are different from each other as to whether or not Zr is contained. The embodiment and Patent Document 8 are different from each other as to whether or not Fe is contained. The embodiment and Patent Document 9 are different from each other as to whether or not Pb is contained and also whether or not Fe, Ni, and Mn are contained.

As described above, the alloy according to the embodiment and the Cu—Zn—Si alloys described in Patent Documents 3 to 9 excluding Patent Document 5 are different from each other in the composition ranges. Patent Document 5 is silent about strength, machinability, κ1 phase present in α phase contributing to wear resistance, f1, and f2, and the strength balance is also low. Patent Document 11 relates to brazing in which heating is performed at 700° C. or higher, and relates to a brazed structure. Patent Document 12 relates to a material that is to be rolled for producing a threaded bolt or a gear.

TABLE 1

| | Cu | Si | P | Pb | Sn | Al | Other Essential Elements |
|---|---|---|---|---|---|---|---|
| First Embodiment | 75.4-78.0 | 3.05-3.55 | 0.05-0.13 | 0.005-0.070 | 0.05 or less | 0.05 or less | — |
| Second Embodiment | 75.6-77.8 | 3.15-3.5 | 0.06-0.12 | 0.006-0.045 | 0.03 or less | 0.03 or less | — |
| Patent Document 3 | 69-79 | 2.0-4.0 | 0.02-0.25 | — | 0.3-3.5 | 1.0-3.5 | — |
| Patent Document 4 | 69-79 | 2.0-4.0 | 0.02-0.25 | 0.02-0.4 | 0.3-3.5 | 0.1-1.5 | — |
| Patent Document 5 | 71.5-78.5 | 2.0-4.5 | 0.01-0.2 | 0.005-0.02 | 0.1-1.2 | 0.1-2.0 | — |
| Patent Document 6 | 69-88 | 2-5 | 0.01-0.25 | 0.004-0.45 | 0.1-2.5 | 0.02-1.5 | Zr: 0.0005-0.04 |
| Patent Document 7 | 69-88 | 2-5 | 0.01-0.25 | 0.005-0.45 | 0.05-1.5 | 0.02-1.5 | Zr: 0.0005-0.04 |
| Patent Document 8 | 74.5-76.5 | 3.0-3.5 | 0.04-0.10 | 0.01-0.25 | 0.05-0.2 | 0.05-0.2 | Fe: 0.11-0.2 |
| Patent Document 9 | 70-83 | 1-5 | 0.1 or less | — | 0.01-2 | — | Fe, Co: 0.01-0.3<br>Ni: 0.01-0.3<br>Mn: 0.01-0.3 |
| Patent Document 10 | — | 0.25-3.0 | — | — | — | — | — |
| Patent Document 11 | 73.0-79.5 | 2.5-4.0 | 0.015-0.2 | 0.003-0.25 | 0.03-1.0 | 0.03-1.5 | — |
| Patent Document 12 | 73.5-79.5 | 2.5-3.7 | 0.015-0.2 | 0.003-0.25 | 0.03-1.0 | 0.03-1.5 | — |

<Metallographic Structure>

In Cu—Zn—Si alloys, 10 or more kinds of phases are present, complicated phase change occurs, and desired properties cannot be necessarily obtained simply by defining the composition ranges and relational expressions of the elements. By specifying and determining the kinds of metallic phases that are present in a metallographic structure and the ranges thereof, desired properties can finally be obtained.

In the case of Cu—Zn—Si alloys including a plurality of metallic phases, the corrosion resistance level varies between phases. Corrosion begins and progresses from a phase having the lowest corrosion resistance, that is, a phase that is most prone to corrosion, or from a boundary between a phase having low corrosion resistance and a phase adjacent to such phase. In the case of Cu—Zn—Si alloys including three elements of Cu, Zn, and Si, for example, when corrosion resistances of a phase, α' phase, β phase (including β' phase), κ phase, γ phase (including γ' phase), and μ phase are compared, the ranking of corrosion resistance is: α phase >α' phase >κ phase >μ phase ≥γ phase >β phase. The difference in corrosion resistance between κ phase and μ phase is particularly large.

Compositions of the respective phases vary depending on the composition of the alloy and the area ratios of the respective phases, and the following can be said.

Si concentration of each phase is higher in the following order: μ phase >γ phase >κ phase >α phase >α' phase ≥β phase. The Si concentrations in μ phase, γ phase, and κ phase are higher than the Si concentration in the alloy. In addition, the Si concentration in μ phase is about 2.5 times to about 3 times the Si concentration in α phase, and the Si concentration in γ phase is about 2 times to about 2.5 times the Si concentration in α phase.

Cu concentration is higher in the following order: μ phase >κ phase ≥α phase >α' phase ≥γ phase >β phase. The Cu concentration in μ phase is higher than the Cu concentration in the alloy.

In the Cu—Zn—Si alloys described in Patent Documents 3 to 6, a large part of γ phase, which has the highest machinability-improving function, is present together with α' phase or is present at a boundary between κ phase and α phase. When used in water that is bad for copper alloys or in an environment that is harsh for copper alloys, γ phase becomes a source of selective corrosion (origin of corrosion) such that corrosion progresses. Of course, when β phase is present, β phase starts to corrode before γ phase. When μ phase and γ phase are present together, μ phase starts to corrode slightly later than or at the same time as γ phase. For example, when α phase, κ phase, γ phase, and μ phase are present together, if dezincification corrosion selectively occurs in γ phase or μ phase, the corroded γ phase or μ phase becomes a corrosion product (patina) that is rich in Cu due to dezincification. This corrosion product causes κ phase or α' phase adjacent thereto to be corroded, and corrosion progresses in a chain reaction. Therefore, it is essential that β phase is 0%, and it is preferable that the amounts of γ phase and μ phase are limited as much as possible, and it is ideal that these phases are not present at all.

The water quality of drinking water varies across the world including Japan, and this water quality is becoming one where corrosion is more likely to occur to copper alloys. For example, the concentration of residual chlorine used for disinfection for the safety of human body is increasing although the upper limit of chlorine level is regulated. That is to say, the environment where copper alloys that compose water supply devices are used is becoming one in which alloys are more likely to be corroded. The same is true of corrosion resistance in a use environment where a variety of solutions are present, for example, those where component materials for automobiles, machines, and industrial plumbing described above are used. Under these circumstances, it is becoming increasingly necessary to reduce phases that are vulnerable to corrosion.

In addition, γ phase is a hard and brittle phase. Therefore, when a large load is applied to a copper alloy member, the γ phase microscopically becomes a stress concentration source. γ phase is mainly present in an elongated shape at an α-κ phase boundary (phase boundary between α phase and κ phase). γ phase becomes a stress concentration source and thus has an effect of promoting chip parting, and reducing cutting resistance during cutting. On the other hand, γ phase becomes the stress concentration source such that ductility, cold workability, or impact resistance deteriorates and tensile strength also deteriorates due to deterioration in ductility. Further, since γ phase is mainly present at a boundary between α phase and κ phase, high temperature creep strength deteriorates. Since the alloy according to the embodiment aims not only at high strength but also at excellent ductility, impact resistance, and high temperature properties, it is necessary to limit the amount of γ phase and the length of the long side of γ phase.

μ phase is mainly present at a grain boundary of α phase or at a phase boundary between α phase and κ phase. Therefore, as in the case of γ phase, μ phase microscopically becomes a stress concentration source. Due to being a stress concentration source or a grain boundary sliding phenomenon, μ phase makes the alloy more vulnerable to stress corrosion cracking, deteriorates impact resistance, and deteriorates ductility, cold workability, and strength under normal temperature and high temperature. As in the case of γ phase, μ phase has an effect of improving machinability, and this effect is much smaller than that of γ phase. Accordingly, it is necessary to limit the amount of μ phase and the length of the long side of μ phase.

However, if the proportion of γ phase or the proportions of γ phase and μ phase are significantly reduced or are made to be zero in order to improve the above-mentioned properties, satisfactory machinability may not be obtained merely by containing a small amount of Pb and three phases of α phase, α' phase, and κ phase. Therefore, providing that the alloy with a tiny amount of Pb has excellent machinability, it is necessary to define the constituent phases of a metallographic structure (metallic phases or crystalline phases) as follows in order to improve ductility, impact resistance, strength, high-temperature properties, and corrosion resistance.

Hereinafter, the unit of the proportion of each of the phases is area ratio (area %).

(γ Phase)

γ phase is α phase that contributes most to the machinability of Cu—Zn—Si alloys. In order to improve corrosion resistance, normal-temperature strength, high temperature properties, ductility, cold workability, and impact resistance in a harsh environment, it is necessary to limit γ phase. In order to obtain sufficient machinability and various other properties at the same time, the composition relational expressions f1 and f2, metallographic structure relational expressions described below, and the manufacturing process are limited.

(β Phase and Other Phases)

In order to obtain excellent corrosion resistance and high ductility, impact resistance, strength, and high-temperature strength, the proportions of β phase, γ phase, μ phase, and other phases such as ζ phase in a metallographic structure are particularly important.

The proportion of β phase should not be detected when observed with a 500× metallographic microscope, that is, its proportion needs to be 0%.

The proportion of phases such as ζ phase other than α phase, κ phase, β phase, γ phase, and μ phase is preferably 0.3% or lower and more preferably 0.1% or lower. It is most preferable that the other phases such as ζ phase are not present.

First, in order to obtain excellent corrosion resistance, strength, ductility, cold workability, impact resistance, and high temperature properties, the proportion of γ phase needs to be 0.3% or lower and the length of the long side of γ phase needs to be 25 μm or less. In order to further improve these properties, the proportion of γ phase is preferably 0.1% or lower, and it is most preferable γ phase is not observed with a 500-fold microscope, that is, the amount of γ phase is 0% in effect.

The length of the long side of γ phase is measured using the following method. Using a 500-fold or 1000-fold metallographic micrograph, for example, the maximum length of the long side of γ phase is measured in one visual field. This operation is performed in arbitrarily chosen five visual fields as described below. The average maximum length of the long side of γ phase calculated from the lengths measured in the respective visual fields is regarded as the length of the long side of γ phase. Therefore, the length of the long side of γ phase can be referred to as the maximum length of the long side of γ phase.

Even if the proportion of γ phase is low, γ phase is mainly present at a phase boundary in an elongated shape when two-dimensionally observed. When the length of the long side of γ phase is long, corrosion in a depth direction is accelerated, high temperature creep is promoted, and ductility, tensile strength, impact resistance, and cold workability deteriorate.

From these viewpoints, the length of the long side of γ phase needs to be 25 μm or less and is preferably 15 μm or less. γ phase that can be clearly recognized with a 500-fold microscope is γ phase having a long side with a length of about 3 μm or more. When the amount of γ phase in which the length of the long side is less than about 3 μm is small, there is little influence on tensile strength, ductility, high temperature properties, impact resistance, cold workability, and corrosion resistance, which is negligible. Incidentally, regarding machinability, the presence of γ phase is the most effective improver of machinability of the copper alloy according to the embodiment. However, γ phase needs to be eliminated if possible due to various problems that γ phase has, and κ1 phase described below can be replacement for γ phase.

The proportion of γ phase and the length of the long side of γ phase are closely related to the contents of Cu, Sn, and Si and the composition relational expressions f1 and f2.

(μ Phase)

μ phase is effective to improve machinability and affects corrosion resistance, ductility, cold workability, impact resistance, normal-temperature tensile strength, and high temperature properties. Therefore, it is necessary that the proportion of μ phase is at least 0% to 1.0%. The proportion of μ phase is preferably 0.5% or lower and more preferably 0.3% or lower, and it is most preferable that μ phase is not present. μ phase is mainly present at a grain boundary or a phase boundary. Therefore, in a harsh environment, grain boundary corrosion occurs at a grain boundary where μ phase is present. In addition, μ phase that is present in an elongated shape at a grain boundary causes the impact resistance and ductility of alloy to deteriorate, and consequently, the tensile strength also deteriorates due to the decline in ductility. In addition, for example, when a copper alloy is used in a valve used around the engine of a vehicle or in a high-pressure gas valve, if the copper alloy is held at a high temperature of 150° C. for a long period of time, grain boundary sliding occurs, and creep is more likely to occur. Therefore, it is necessary to limit the amount of μ phase, and at the same time limit the length of the long side of μ phase that is mainly present at a grain boundary to 20 μm or less. The length of the long side of μ phase is preferably 15 μm or less, more preferably 5 μm or less.

The length of the long side of μ phase is measured using the same method as the method of measuring the length of the long side of γ phase. That is, by basically using a 500-fold metallographic micrograph, but where appropriate, using a 1000-fold metallographic micrograph, or a 2000-fold or 5000-fold secondary electron micrograph (electron micrograph) according to the size of μ phase, the maximum length of the long side of μ phase in one visual field is measured. This operation is performed in arbitrarily chosen five visual fields. The average maximum length of the long sides of μ phase calculated from the lengths measured in the respective visual fields is regarded as the length of the long side of μ phase. Therefore, the length of the long side of μ phase can be referred to as the maximum length of the long side of μ phase.

(K Phase)

Under recent high-speed machining conditions, the machinability of a material including cutting resistance and chip dischargeability is the most important property. However, in order to obtain excellent machinability in a state where the proportion of γ phase having the highest machinability-improvement function is limited to be 0.3% or lower, it is necessary that the proportion of κ phase is at least 29% or higher. The proportion of κ phase is preferably 33% or higher and more preferably 35% or higher. When strength is important, the proportion of κ phase is 38% or higher.

κ phase is less brittle, is richer in ductility, and has higher corrosion resistance than γ phase, μ phase, and β phase. γ phase and μ phase are present along a grain boundary or a phase boundary of α phase, but this tendency is not shown in κ phase. In addition, strength, machinability, wear resistance, and high temperature properties are higher than α phase.

As the proportion of κ phase increases, machinability is improved, tensile strength and high-temperature strength are improved, and wear resistance is improved. However, on the other hand, as the proportion of κ phase increases, ductility, cold workability, or impact resistance gradually deteriorates. When the proportion of κ phase reaches about 50%, the effect of improving machinability is also saturated, and as the proportion of κ phase further increases, cutting resistance increases due to κ phase that is hard and has high strength. In addition, when the amount of κ phase is excessively large, chips tend to be unseparated. When the proportion of κ phase reaches about 60%, tensile strength is saturated and cold workability and hot workability deteriorate along with deterioration in ductility. When the strength, ductility, impact resistance, and machinability are comprehensively considered, the proportion of κ phase needs to be 60% or lower. The proportion of κ phase is preferably 58% or lower or 56% or lower and more preferably 54% or lower and, in particular, when ductility, impact resistance, and swaging or bending workability are important, is 50% or lower.

κ phase has an excellent machinability-improvement function like γ phase. However, γ phase is mainly present at a phase boundary and becomes a stress concentration source during cutting. As a result, with a small amount of γ phase, excellent chip partibility can be obtained, and cutting resistance is reduced. In the relational expression f6 relating to machinability described below, a coefficient that is six times the amount of κ phase is assigned to the square root value of the amount of γ phase. On the other hand, κ phase is not unevenly distributed at a phase boundary unlike γ phase or μ phase, forms a metallographic structure with α phase, and is present together with soft α phase. As a result, a function of improving machinability is exhibited. In other words, by making κ phase to be present together with soft α phase, the machinability improvement function of κ phase is utilized, and this function is exhibited according to the amount of κ phase and how α phase and κ phase are mixed. Accordingly, how α phase and κ phase are distributed also affects machinability, and when coarse α phase is formed, machinability deteriorates. If the proportion of γ phase is significantly limited, when the amount of κ phase is about 50%, the effect of improving chip partibility or the effect of reducing cutting resistance is saturated. As the amount of κ phase further increases, the effects gradually weaken. That is, even when the proportion of κ phase excessively increases, a component ratio or a mixed state between κ phase and soft α phase deteriorates such that chip partibility deteriorates. When the proportion of κ phase exceeds about 50%, the influence of κ phase having high strength is strengthened, and the cutting resistance gradually increases.

In order to obtain excellent machinability with a small amount of Pb in a state where the area ratio of γ phase having excellent machinability is limited to be 0.3% or lower and preferably 0.1% or 0%, it is necessary not only to adjust the amount of κ phase but also to improve the machinability of α phase. That is, by making acicular κ phase and κ1 phase to be present in α phase, the machinability of α phase is improved, and the machinability of the alloy is improved with little deterioration in ductility. As the amount of κ1 phase present in α phase increases, the machinability of the alloy is further improved. Although depending on the relational expressions and the manufacturing process, the amount of κ1 phase in α phase also increases along with an increase in the amount of κ phase in the metallographic structure. The presence of an excess amount of κ1 phase deteriorates the ductility of α phase and adversely affects the ductility, cold workability, and impact resistance of the alloy. Therefore, the proportion of κ phase needs to be 60% or lower and is preferably 58% or lower or 56% or lower. From the above, it is most preferable that the proportion of κ phase in the metallographic structure is about 33% to about 56% from the viewpoint of a balance between ductility, cold workability, strength, impact resistance, corrosion resistance, high temperature properties, machinability, and wear resistance. In addition, although depending on the values of f1 and f2, when the proportion of κ phase is 33% to 56%, the amount of κ1 phase in α phase also increases, and excellent machinability can be secured even if the Pb content is lower than 0.020 mass %.

(Presence of Elongated Acicular κ Phase (κ1 Phase) in α Phase)

When the above-described requirements of the composition, the composition relational expressions f1 and f2, and the process are satisfied, acicular κ phase starts to appear in α phase. This κ phase is harder than α phase. The thickness of κ phase (κ1 phase) present in α phase is about 0.1 μm to about 0.2 μm (about 0.05 μm to about 0.5 μm), and this κ phase (κ1 phase) is thin, elongated, and acicular. Due to the presence of acicular κ1 phase in α phase, the following effects are obtained.

1) α phase is strengthened, and the tensile strength of the alloy is improved.

2) The machinability of α phase is improved, and the machinability of the alloy such as deterioration in cutting resistance or improvement of chip partibility is improved.

3) Since the κ1 phase is present in α phase, there is no bad influence on the corrosion resistance of the alloy.

4) α phase is strengthened, and the wear resistance of the alloy is improved.

5) Since the κ1 phase is present in α phase, there is a small influence on ductility and impact resistance.

The acicular κ phase present in α phase is affected by a constituent element such as Cu, Zn, or Si, the relational expressions f1 and f2, and the manufacturing process. When the requirements of the composition and the metallographic structure of the embodiment are satisfied, Si is one of the main factors that determine the presence of κ1 phase. For example, when the amount of Si is about 2.95 mass % or higher, acicular κ1 phase starts to be present in α phase. When the amount of Si is about 3.05 mass % or higher, κ1 phase becomes clear, and when the amount of Si is about 3.15 mass % or higher, κ1 phase becomes more clearly present. In addition, the presence of κ1 phase is affected by the relational expressions. For example, the composition relational expression f2 needs to be 61.5 or lower, and as the value of f2 increases to 61.2 and from 61.2 to 61.0, an increased amount of κ1 phase is present.

On the other hand, even if the width of κ1 phase in α crystal grains of 2 to 100 μm or α phase is as small as about 0.2 μm, the proportion of κ1 phase increases. That is, if the amount of κ1 phase excessively increases, the ductility or impact resistance of α phase deteriorates. The amount of κ1 phase in α phase is strongly affected by the contents of Cu, Si, and Zn, the relational expressions f1 and f2, and the manufacturing process mainly in conjunction with the amount of κ phase in the metallographic structure. When the proportion of κ phase in the metallographic structure as the main factor exceeds 60%, the amount of κ1 phase present in α phase excessively increases. From the viewpoint of obtaining an appropriate amount of κ1 phase present in α phase, the amount of κ phase in the metallographic structure is 60% or lower, preferably 58% or lower and more preferably 54% or lower, and, when ductility, cold workability, or impact resistance is important, it is preferably 54% or lower and more preferably 50% or lower. In addition, when the proportion of κ phase is high and the value of f2 is low, the amount of κ1 phase increases. Conversely, when the proportion of κ phase is low and the value of f2 is high, the amount of κ1 phase present in α phase decreases.

κ1 phase present in α phase can be recognized as an elongated linear material or acicular material when enlarged with a metallographic microscope at a magnification of 500-fold, in some cases, about 1000-fold. However, since it is difficult to calculate the area ratio of κ1 phase, it should be noted that the area ratio of κ1 phase in α phase is included in the area ratio of α phase.

(Metallographic Structure Relational Expressions f3, f4, and f5)

In order to obtain excellent corrosion resistance, ductility, impact resistance, and high temperature properties, the total proportion of α phase and κ phase (metallographic structure relational expression f3=(α)+(κ)) needs to be 98.6% or higher. The value of f3 is preferably 99.3% or higher and more preferably 99.5% or higher. Likewise, the total proportion of α phase, κ phase, γ phase, and μ phase (metallographic structure relational expression f4=(α)+(κ)+(γ)+(μ)) is 99.7% or higher and preferably 99.8% or higher.

Further, the total proportion of γ phase and μ phase (f5=(γ)+(μ)) is 0% to 1.2%. The value of f5 is preferably 0.5 or lower.

The metallographic structure relational expressions f3 to f6 are directed to 10 kinds of metallic phases including α phase, β phase, γ phase, δ phase, ε phase, ζ phase, η phase, κ phase, μ phase, and χ phase, and are not directed to intermetallic compounds, Pb particles, oxides, non-metallic inclusion, non-melted materials, and the like. In addition, acicular κ phase (κ1 phase) present in α phase is included in α phase, and μ phase that cannot be observed with a 500-fold or 1000-fold metallographic microscope is excluded. Intermetallic compounds that are formed by Si, P, and elements that are inevitably mixed in (for example, Fe, Co, and Mn) are excluded from the area ratio of a metallic phase. However, these intermetallic compounds affect machinability, and thus it is necessary to pay attention to the inevitable impurities.

(Metallographic Structure Relational Expression f6)

In the alloy according to the embodiment, it is necessary that machinability is excellent while minimizing the Pb content in the Cu—Zn—Si alloy, and it is necessary that the alloy satisfies required impact resistance, ductility, cold workability, pressure resistance, normal-temperature strength, high-temperature strength, and corrosion resistance. However, the effect of γ phase on machinability is contradictory to that on impact resistance, ductility, or corrosion resistance.

Metallographically, the larger the amount of γ phase is, the better the machinability of the alloy is since γ phase has the highest machinability. However, from the viewpoints of impact resistance, ductility, strength, corrosion resistance, and other properties, it is necessary to reduce the amount of γ phase. It was found from experiment results that, when the proportion of γ phase is 0.3% or lower, it is necessary that the value of the metallographic structure relational expression f6 is in an appropriate range in order to obtain excellent machinability.

Since γ phase has the highest machinability, a high coefficient that is six times larger is assigned to the square root value of the proportion of γ phase ((γ) (%)) in the metallographic structure relational expression f6 relating to machinability. On the other hand, the coefficient of κ phase is 1. κ phase forms a metallographic structure with α phase and exhibits the effect according to the proportion without being unevenly distributed in α phase boundary like γ phase or μ phase. In order to obtain excellent machinability, the value of the metallographic structure relational expression f6 needs to be 30 or higher. The value of f6 is preferably 33 or higher and more preferably 35 or higher.

On the other hand, when the metallographic structure relational expression f6 exceeds 62, machinability conversely deteriorates, and deterioration in impact resistance and ductility becomes significant. Therefore, the metallographic structure relational expression f6 needs to be 62 or lower. The value of f6 is preferably 58 or lower and more preferably 54 or lower.

<Properties>

(Normal-Temperature Strength and High Temperature Properties)

As a strength required in various fields of valves and devices for drinking water, vessels, fittings, plumbing, and valves relating to hydrogen such as those of a hydrogen station, hydrogen power generation, or in a high-pressure hydrogen environment, and automotive valves and fittings, a tensile strength is important. In addition, for example, a valve used in an environment close to the engine room of a vehicle or a high-temperature and high-pressure valve is exposed in an environment where the temperature can reach about 150° C. at the maximum. And the alloy is required to remain intact without deformation or fracture when a pressure or a stress is applied. In the case of the pressure vessel, an allowable stress thereof is affected by the tensile strength. Pressure vessels need to have minimum ductility and impact resistance that are required for their intended use and the use conditions, and are determined according to the balance with strength. In addition, reduction in thickness and weight has been strongly demanded for members and components that are targeted use of the embodiment, for example, automobile components.

To that end, it is preferable that a hot extruded material, a hot rolled material, or a hot forged material as a hot worked material is a high strength material having a tensile strength of 550 N/mm$^2$ or higher at a normal temperature. The tensile strength at a normal temperature is more preferably 580 N/mm$^2$ or higher, still more preferably 600 N/mm$^2$ or higher, and most preferably 625 N/mm$^2$ or higher. Most of valves or pressure vessels are formed by hot forging, and hydrogen embrittlement does not occur in the alloy according to the embodiment as long as the tensile strength is 580 N/mm$^2$ or higher and preferably 600 N/mm$^2$ or higher. Therefore, the alloy according to the embodiment can be replacement of a material for a hydrogen valve, a valve for hydrogen power generation, or the like that may have a problem of low-temperature brittleness, and its industrial utility value enhances. In general, cold working is not performed on hot forged materials. For example, the surface can be hardened by shot peening. In this case, however, the cold working ratio is merely about 0.1% to 1.5% in practice, and the improvement of the tensile strength is about 2 to 15 N/mm$^2$.

The alloy according to the embodiment undergoes a heat treatment under an appropriate temperature condition that is higher than the recrystallization temperature of the material or undergoes an appropriate thermal history to improve the tensile strength. Specifically, although depending on the composition or the heat treatment conditions, the tensile strength is improved by about 10 to about 100 N/mm$^2$ as compared to the hot worked material before the heat treatment. Except for Corson alloy or age-hardening alloy such as Ti—Cu alloy, example of increased tensile strength by heat treatment at a temperature higher than the recrystallization temperature is scarcely found among copper alloys. The reason why the strength of the alloy according to the embodiment is improved is presumed to be as follows. By performing the heat treatment at a temperature of 505° C. to 575° C. under appropriate conditions, α phase or κ phase in the matrix is softened. On the other hand, the strengthening of α phase due to the presence of acicular κ phase in α phase, an increase in maximum load that can be withstood before breakage due to improvement of ductility caused by a decrease in the amount of γ phase, and an increase in the proportion of κ phase significantly surmount the softening of α phase and κ phase. As a result, as compared to the hot worked material, not only corrosion resistance but also tensile strength, ductility, impact value, and cold workability are significantly improved, and an alloy having high strength, high ductility, and high toughness is prepared.

On the other hand, the hot worked material is drawn, wire-drawn, or rolled in a cold state after an appropriate heat treatment to improve the strength in some cases. When cold working is performed on the alloy according to the embodiment, at a cold working ratio of 15% or lower, the tensile strength increases by 12 N/mm$^2$ per 1% of cold working ratio. On the other hand, and the impact resistance decrease by about 4% per 1% of cold working ratio. Otherwise, an impact value $I_R$ after cold working under the condition that the cold working ratio is 20% or lower can be substantially defined by $I_R=I_0\times(20/(20+RE))$, wherein $I_0$ represents the impact value of the heat treated material and RE % represents the cold working ratio. For example, when an alloy material having a tensile strength of 580 N/mm$^2$ and an impact value of 30 J/cm$^2$ is cold-drawn at a cold working ratio of 5% to prepare a cold worked material, the tensile strength of the cold worked material is about 640 N/mm$^2$, and the impact value is about 24 J/cm$^2$. When the cold working ratio varies, the tensile strength and the impact value also vary and cannot be determined.

This way, when cold working is performed, the tensile strength increases, but the impact value and the elongation deteriorate. In order to obtain a strength, an elongation, and an impact value according to the intended use, it is necessary to set an appropriate cold working ratio.

On the other hand, when cold drawing, cold wire-drawing, or cold rolling is performed and then a heat treatment is performed under appropriate conditions, tensile strength, elongation, impact resistance are improved as compared to the hot worked material, in particular, the hot extruded material. In addition, there may be a case where a tensile test cannot be performed for a forged product. In this case, since the Rockwell B scale (HRB) and the tensile strength (S) have a strong correlation, the tensile strength can be estimated by measuring the Rockwell B scale for convenience. However, this correlation is established on the presupposition that the composition of the embodiment is satisfied and the requirements f1 to f6 are satisfied.

When HRB is 65 to 88, $S=4.3\times HRB+242$

When HRB is higher than 88 and 99 or lower, $S=11.8\times HRB-422$

When the values of HRB are 65, 75, 85, 88, 93, and 98, the values of tensile strength are estimated to be about 520, 565, 610, 625, 675, and 735 N/mm$^2$, respectively.

Regarding the high temperature properties, it is preferable that a creep strain after holding the copper alloy at 150° C. for 100 hours in a state where a stress corresponding to 0.2% proof stress at room temperature is applied is 0.3% or lower. This creep strain is more preferably 0.2% or lower and still more preferably 0.15% or lower. In this case, even when the copper alloy is exposed to a high temperature as in the case of, for example, a high-temperature high-pressure valve or a valve used close to the engine room of an automobile, deformation is not likely to occur, and high temperature properties are excellent.

Even when machinability is excellent and tensile strength is high, if ductility and cold workability are poor, the use of the alloy is limited. Regarding cold workability, for example, for use in water-related devices, plumbing components, automobiles, and electrical components, a hot forged material or a cut material may undergo cold working such as slight swaging or bending and is required not to crack due to such processing. Machinability requires a material to have some kind of brittleness for chip parting, which is contrary to cold workability. Likewise, tensile strength and ductility are contrary to each other, and it is desired that tensile strength and ductility (elongation) are highly balanced. That is, one yardstick to determine whether such a material has high strength and high ductility is that if the tensile strength is at least 540 N/mm$^2$ or higher, the elongation is 12% or higher, and the value of $f8=S\times\{(E+100)/100\}^{1/2}$, which is the product of the tensile strength (S), and the value of {(Elongation (E %)+100)/100} raised to the power ½ is preferably 675 or higher, the material can be regarded as having high strength and high ductility. The value of f8 is more preferably 690 or higher and still more preferably 700 or higher. In the case cold working performed at a cold working ratio of 2% to 15% is included, an elongation of 12% or higher and a tensile strength of 630 N/mm$^2$ or higher and further 650 N/mm$^2$ or higher can be obtained, and the value of 8 reaches 690 or higher, sometimes 700 or higher.

Incidentally, the strength balance index f8 is not applicable to castings because crystal grains of casting are likely to coarsen and may include microscopic defects.

In the case of free-cutting brass including 60 mass % of Cu, 3 mass % of Pb with a balance including Zn and inevitable impurities, tensile strength at a normal temperature is 360 $N/mm^2$ to 400 $N/mm^2$ when formed into a hot extruded material or a hot forged product, and the elongation is 35% to 45%. That is, the value of f8 is about 450. In addition, even after the alloy is exposed to 150° C. for 100 hours in a state where a stress corresponding to 0.2% proof stress at room temperature is applied, the creep strain is about 4% to 5%. Therefore, the tensile strength and heat resistance of the alloy according to the embodiment are higher than those of conventional free-cutting brass including Pb. That is, the alloy according to the embodiment has excellent corrosion resistance and high strength at room temperature, and scarcely deforms even after being exposed to a high temperature for a long period of time. Therefore, a reduction in thickness and weight can be realized using the high strength. In particular, in the case of a forged material such as a valve for high-pressure gas or high-pressure hydrogen, cold working cannot be performed in practice. Therefore, an increase in allowable pressure and a reduction in thickness and weight can be realized using the high strength.

Further, free-cutting copper alloys containing 3% Pb exhibits poor cold workability such as that during swaging.

In the case of the alloy according to the embodiment, there is little difference in the properties under high temperature between an extruded material and a cold worked material. That is, the 0.2% proof stress increases due to cold working, but even in a state where a load corresponding to the 0.2% proof stress increased due to cold working is applied, a creep strain after exposing the alloy to 150° C. for 100 hours is 0.3% or lower, and high heat resistance is obtained. The high temperature properties are mainly affected by the area ratios of β phase, γ phase, and μ phase, and as these area ratios increase, the high temperature properties deteriorate. In addition, as the length of the long side of μ phase or γ phase present at a grain boundary of α phase or at α phase boundary increases, the high temperature properties deteriorate.

(Impact Resistance)

In general, when a material has high strength, the material is brittle. It is said that a material having chip partibility during cutting has some kind of brittleness. Impact resistance is contrary to machinability and strength in some aspect.

However, if the copper alloy is for use in various members including drinking water devices such as valves or fittings, automobile components, mechanical components, and industrial plumbing components, the copper alloy needs to have not only high strength but also properties to resist impact. Specifically, when a Charpy impact test is performed using a U-notched specimen, a Charpy impact test value (I) is preferably 12 $J/cm^2$ or higher. When cold working is performed, as the working ratio increases, the impact value decreases, and it is more preferable if the Charpy impact test value is 15 $J/cm^2$ or higher. On the other hand, in a hot worked material that does not undergo cold working, the Charpy impact test value is preferably 15 $J/cm^2$ or higher, more preferably 16 $J/cm^2$ or higher, still more preferably 20 $J/cm^2$ or higher, and most preferably 24 $J/cm^2$ or higher. The alloy according to the embodiment relates to an alloy having excellent machinability. Therefore, it is not really necessary that the Charpy impact test value exceeds 50 $J/cm^2$. Conversely, when the Charpy impact test value exceeds 50 $J/cm^2$, cutting resistance increases due to increased ductility and toughness, which causes unseparated chips more likely to be generated, and as a result, machinability deteriorates. Therefore, it is preferable that the Charpy impact test value is 50 $J/cm^2$ or lower.

When the amount of hard κ phase contributing to the strength and machinability of the material excessively increases or when the amount of κ1 phase excessively increases, toughness, that is, impact resistance deteriorates. Therefore, strength and machinability are contrary to impact resistance (toughness). The following expression defines a strength-elongation-impact balance index f9 which indicates impact resistance in addition to strength and elongation.

Regarding the hot worked material, when the tensile strength (S) is 550 $N/mm^2$ or higher, the elongation (E) is 12% or higher, the Charpy impact test value (I) is 12 $J/cm^2$ or higher, and the value of $f9=S\times\{(E+100)/100\}^{1/2}+I$, is preferably 700 or higher, more preferably 715 or higher, and still more preferably 725 or higher, it can be said that the material has high strength, elongation, and toughness. When cold working is performed at a working ratio of 2% to 15%, the value of f9 is still more preferably 740 or higher.

It is preferable that the strength-ductility balance index f8 is 675 or higher or the strength-ductility-impact balance index f9 is 700 or higher. Both impact resistance and elongation are yardsticks of ductility. However, static ductility and instantaneous ductility are distinguished from each other, and it is more preferable that both f8 and f9 are satisfied.

Impact resistance has a close relation with a metallographic structure, and γ phase and μ phase deteriorate impact resistance. In addition, if γ phase or μ phase is present at a grain boundary of α phase or a phase boundary between α phase and κ phase, the grain boundary or the phase boundary is embrittled, and impact resistance deteriorates. As described above, not only the area ratio but also the lengths of the long side of γ phase and of μ phase affect the impact resistance.

<Manufacturing Process>

Next, the method of manufacturing the high-strength free-cutting copper alloy according to the first or second embodiment of the present invention is described below.

The metallographic structure of the alloy according to the embodiment varies not only depending on the composition but also depending on the manufacturing process. The metallographic structure of the alloy is affected not only by hot working temperature during hot extrusion and hot forging, and heat treatment conditions but also by an average cooling rate (also simply referred to as cooling rate) in the process of cooling during hot working or heat treatment. As a result of a thorough study, it was found that the metallographic structure is largely affected by a cooling rate in a temperature range from 450° C. to 400° C. and a cooling rate in a temperature range from 575° C. to 525° C. in the process of cooling during hot working or a heat treatment.

The manufacturing process according to the embodiment is a process required for the alloy according to the embodiment. Basically, the manufacturing process has the following important roles although they are affected by composition.

1) Significantly reduce or entirely eliminate γ phase that deteriorates ductility, strength, impact resistance, and corrosion resistance, and shorten the length of the long side of γ phase.

2) Suppress generation of μ phase that deteriorates ductility, strength, impact resistance, and corrosion resistance, and control the length of the long side of μ phase.

3) Allow acicular κ phase to appear in α phase.

(Melt Casting)

Melting is performed at a temperature of about 950° C. to about 1200° C. that is higher than the melting point (liquidus temperature) of the alloy according to the embodiment by about 100° C. to about 300° C. In casting, casting material is poured into a predetermined mold at about 900° C. to about 1100° C. that is higher than the melting point by about 50° C. to about 200° C., then is cooled by some cooling means such as air cooling, slow cooling, or water cooling. After solidification, constituent phase(s) changes in various ways.

(Hot Working)

Examples of hot working include hot extrusion, hot forging, and hot rolling.

For example, although depending on production capacity of the equipment used, it is preferable that hot extrusion is performed when the temperature of the material during actual hot working, specifically, immediately after the material passes through an extrusion die, is 600° C. to 740° C. If hot working is performed when the material temperature is higher than 740° C., a large amount of β phase is formed during plastic working, and β phase may remain. In addition, a large amount of γ phase remains and has an adverse effect on constituent phase(s) after cooling. In addition, even when a heat treatment is performed in the next step, the metallographic structure of a hot worked material is affected. The hot working temperature is preferably 670° C. or lower and more preferably 645° C. or lower. When hot extrusion is performed at 645° C. or lower, the amount of γ phase in the hot extruded material is reduced. Further, α phase is refined into fine grains, which improves the strength. When a hot forged material or a heat treated material having undergone hot forging is prepared using the hot extruded material having a small amount of γ phase, the amount of γ phase in the hot forged material or the heat treated material is further reduced.

Further, by adjusting the cooling rate after hot extrusion, a material having various properties such as machinability or corrosion resistance can also be obtained. That is, when cooling is performed in a temperature range from 575° C. to 525° C. at a cooling rate of 0.1° C./min to 3° C./min in the process of cooling after hot extrusion, the amount of γ phase is reduced. When the cooling rate exceeds 3° C./min, the amount of γ phase is not sufficiently reduced. The cooling rate in a temperature range from 575° C. to 525° C. is preferably 1.5° C./min or lower and more preferably 1° C./min or lower. Next, the cooling rate in a temperature range from 450° C. to 400° C. is 3° C./min to 500° C./min. The cooling rate in a temperature range from 450° C. to 400° C. is preferably 4° C./min or higher and more preferably 8° C./min or higher. As a result, an increase in the amount of μ phase is prevented.

When a heat treatment is performed in the next step or the final step, it is not necessary to control the cooling rate in a temperature range from 575° C. to 525° C. and the cooling rate in a temperature range from 450° C. to 400° C. after hot working.

In addition, when the hot working temperature is low, hot deformation resistance is improved. From the viewpoint of deformability, the lower limit of the hot working temperature is preferably 600° C. or higher. When the extrusion ratio is 50 or lower, or when hot forging is performed in a relatively simple shape, hot working can be performed at 600° C. or higher. To be safe, the lower limit of the hot working temperature is preferably 605° C. Although depending on the production capacity of the equipment used, it is preferable to perform hot working at a lowest possible temperature.

In consideration of feasibility of measurement position, the hot working temperature is defined as a temperature of a hot worked material that can be measured three or four seconds after hot extrusion, hot forging, or hot rolling. The metallographic structure is affected by a temperature immediately after working where large plastic deformation occurs.

In the embodiment, in the process of cooling after hot plastic working, the material is cooled in a temperature range from 575° C. to 525° C. at an average cooling rate of 0.1° C./min to 3° C./min. Subsequently, the material is cooled in a temperature range from 450° C. to 400° C. at an average cooling rate of 3° C./min to 500° C./min.

Most of extruded materials are made of a brass alloy including 1 to 4 mass % of Pb. Typically, this kind of brass alloy is wound into a coil after hot extrusion unless the diameter of the extruded material exceeds, for example, about 38 mm. The heat of the ingot (billet) during extrusion is taken by an extrusion device such that the temperature of the ingot decreases. The extruded material comes into contact with a winding device such that heat is taken and the temperature further decreases. A temperature decrease of 50° C. to 100° C. from the temperature of the ingot at the start of the extrusion or from the temperature of the extruded material occurs when the cooling rate is relatively high. Although depending on the weight of the coil and the like, the wound coil is cooled in a temperature range from 450° C. to 400° C. at a relatively low cooling rate of about 2° C./min due to a heat keeping effect. After the material's temperature reaches about 300° C., the cooling rate further declines. Therefore, water cooling is performed in consideration of handling. In the case of a brass alloy including Pb, hot extrusion is performed at about 600° C. to 700° C. In the metallographic structure immediately after extrusion, a large amount of β phase having excellent hot workability is present. When the cooling rate after extrusion is high, a large amount of β phase remains in the cooled metallographic structure such that corrosion resistance, ductility, impact resistance, and high temperature properties deteriorate. In order to avoid the deterioration, by performing cooling at a relatively low cooling rate using the heat keeping effect of the extruded coil and the like, β phase is transformed into α phase, and a metallographic structure that is rich in α phase is obtained. As described above, the cooling rate of the extruded material is relatively high immediately after extrusion. Therefore, by subsequently performing cooling at a relatively low cooling rate, a metallographic structure that is rich in α phase is obtained. Patent Document 1 does not describe the cooling rate but discloses that, in order to reduce the amount of μ phase and to isolate β phase, slow cooling is performed until the temperature of an extruded material is 180° C. or lower.

As described above, the alloy according to the embodiment is manufactured at a cooling rate that is completely different from that of a method of manufacturing a brass alloy including Pb of the conventional art in the process of cooling after hot working.

(Hot Forging)

As a material for hot forging, a hot extruded material is mainly used, but a continuously cast rod is also used. Since a more complex shape is formed in hot forging than in hot extrusion, the temperature of the material before forging is made high. However, the temperature of a hot forged material on which plastic working is performed to create a large, main portion of a forged product, that is, the material's temperature about three or four seconds immediately after forging is preferably 600° C. to 740° C. as in the case of the hot extruded material.

If the extrusion temperature during the manufacturing of the hot extruded rod is lowered to obtain a metallographic structure including a small amount of γ phase, when hot forging is performed on the hot extruded rod, a hot forged metallographic structure in which the amount of γ phase is maintained to be small can be obtained even if hot forging is performed at a high temperature.

Further, by adjusting the cooling rate after forging, a material having various properties such as corrosion resistance or machinability can be obtained. That is, the temperature of the forged material about three or four seconds after hot forging is 600° C. to 740° C. When cooling is performed in a temperature range from 575° C. to 525° C., in particular, 570° C. to 530° C. at a cooling rate of 0.1° C./min to 3° C./min in the following cooling process, the amount of γ phase is reduced. The lower limit of the cooling rate in a temperature range from 575° C. to 525° C. is set to be 0.1° C./min or higher in consideration of economic efficiency. On the other hand, when the cooling rate exceeds 3° C./min, the amount of γ phase is not sufficiently reduced. The cooling rate is preferably 1.5° C./min or lower and more preferably 1° C./min or lower. The cooling rate in a temperature range from 450° C. to 400° C. is 3° C./min to 500° C./min. The cooling rate in a temperature range from 450° C. to 400° C. is preferably 4° C./min or higher and more preferably 8° C./min or higher. As a result, an increase in the amount of μ phase is prevented. This way, in a temperature range from 575° C. to 525° C., cooling is performed at a cooling rate of 3° C./min or lower and preferably 1.5° C./min or lower. In addition, in a temperature range from 450° C. to 400° C., cooling is performed at a cooling rate of 3° C./min or higher and preferably 4° C./min or higher. This way, by adjusting the average cooling rate to be low in the temperature range from 575° C. to 525° C. and adjusting the average cooling rate to be high in the temperature range from 450° C. to 400° C., a more satisfactory material can be manufactured. Hot extruded materials are formed by unidirectional plastic working, but forged products are generally formed by complex plastic deformation. Therefore, the degree of a decrease in the amount of γ phase and the degree of a decrease in the length of the long side of γ phase are higher in forged products than in hot extruded materials.

(Hot Rolling)

In the case of hot rolling, rolling is repeatedly performed, but the final hot rolling temperature (material's temperature three or four seconds after the final hot rolling) is preferably 600° C. to 740° C. and more preferably 605° C. to 670° C. As in the case of hot extrusion, the hot rolled material is cooled in a temperature range from 575° C. to 525° C. at a cooling rate of 0.1° C./min to 3° C./min and subsequently is cooled in a temperature range from 450° C. to 400° C. at a cooling rate of 3° C./min to 500° C./min.

If heat treatment is performed again in the next step or the final step, it is not necessary to control the cooling rate in a temperature range from 575° C. to 525° C. and the cooling rate in a temperature range from 450° C. to 400° C. after hot working.

(Heat Treatment)

The main heat treatment for copper alloys is also called annealing. When producing a small product which cannot be made by, for example, hot extrusion, a heat treatment is performed as necessary after cold drawing or cold wire drawing such that the material recrystallizes, that is, usually for the purpose of softening a material. In addition, in the case of hot worked materials, if the material is desired to have substantially no work strain, or if an appropriate metallographic structure is required, a heat treatment is performed as necessary.

In the case of a brass alloy including Pb, a heat treatment is performed as necessary. In the case of the brass alloy including Bi disclosed in Patent Document 1, a heat treatment is performed under conditions of 350° C. to 550° C. and 1 to 8 hours.

In the case of the alloy according to the embodiment, when it is held at a temperature of 525° C. to 575° C. for 15 minutes to 8 hours, tensile strength, ductility, corrosion resistance, impact resistance, and high temperature properties are improved. However, when a heat treatment is performed under the condition that the material's temperature exceeds 620° C., a large amount of γ phase or β phase is formed, and α phase is coarsened. As the heat treatment condition, the heat treatment temperature is preferably 575° C. or lower.

On the other hand, although a heat treatment can be performed even at a temperature lower than 525° C., the degree of a decrease in the amount of γ phase becomes much smaller, and it takes more time to complete heat treatment. At a temperature of at least 505° C. or higher and lower than 525° C., a time of 100 minutes or longer and preferably 120 minutes or longer is required. Further, in a heat treatment that is performed at a temperature lower than 505° C. for a long time, a decrease in the amount of γ phase is very small, or the amount of γ phase scarcely decreases. Depending on conditions, μ phase appears.

Regarding the heat treatment time (the time for which the material is held at the heat treatment temperature), it is necessary to hold the material at a temperature of 525° C. to 575° C. for at least 15 minutes or longer. The holding time contributes to a decrease in the amount of γ phase. Therefore, the holding time is preferably 40 minutes or longer and more preferably 80 minutes or longer. The upper limit of the holding time is 8 hours, and from the viewpoint of economic efficiency, the holding time is 480 minutes or shorter and preferably 240 minutes or shorter. Alternatively, as described above, at a temperature of 505° C. or higher and preferably 515° C. or higher and lower than 525° C., the holding time is 100 minutes or longer and preferably 120 minutes to 480 minutes.

The advantage of performing heat treatment at this temperature is that, when the amount of γ phase in the material before the heat treatment is small, the softening of α phase and κ phase can be minimized, the grain growth of α phase scarcely occurs, and a higher strength can be obtained. In addition, the amount of κ1 phase contributing to strength or machinability is the largest when heat treated at 515° C. to 545° C. The further away the heat treatment temperature is from the above-mentioned temperature range, the less the amount of κ1 phase is. If heat treatment is performed at a temperature 500° C. or lower or 590° C. or higher, κ1 phase is scarcely present.

Regarding another heat treatment method, in the case of a continuous heat treatment furnace where a hot extruded material, a hot forged product, a hot rolled material, or a material that is cold worked (cold drawn, cold wire-drawn, etc.) moves in a heat source, the above-described problems occur if the material's temperature exceeds 620° C. However, by performing the heat treatment under conditions corresponding to increasing the material's temperature to a temperature 525° C. or higher, preferably 530° C. or higher and 620° C. or lower, preferably 595° C. or lower, and subsequently holding the material's temperature in a temperature range from 525° C. to 575° C. for 15 minutes or longer, that is, the heat treatment is performed such that the sum of the holding time in a temperature range from 525° C. to 575° C. and the time for which the material passes through a temperature range from 525° C. to 575° C. during cooling after holding is 15 minutes or longer, the metallographic structure can be improved. In the case of a continuous furnace, the holding time at a maximum reaching temperature is short. Therefore, the cooling rate in a temperature range from 575° C. to 525° C. is preferably 0.1° C./min to 3° C./min, more preferably 2° C./min or lower, and still more preferably 1.5° C./min or lower. Of course, the temperature is not necessarily set to be 575° C. or higher. For example, when the maximum reaching temperature is 545° C., the material may be held in a temperature range from 545° C. to 525° C. for at least 15 minutes. Even if the material's temperature reaches 545° C. as the maximum reaching temperature and the holding time is 0 minutes, the material may pass through a temperature range from 545° C. to 525° C. at an average cooling rate of 1.3° C./min or lower. That is, as long as the material is held in a temperature range of 525° C. or higher for 20 minutes or longer and the materials' temperature is in a range of 525° C. to 620° C., the maximum reaching temperature is not a problem. Not only in a continuous furnace but also in other furnaces, the definition of the holding time is the time from when the material's temperature reaches "Maximum Reaching Temperature—10° C.".

Although the material is cooled to normal temperature in these heat treatments also, in the process of cooling, the cooling rate in a temperature range from 450° C. to 400° C. needs to be 3° C./min to 500° C./min. The cooling rate for the temperature range from 450° C. to 400° C. is preferably 4° C./min or higher. That is, from about 500° C., it is necessary to increase the cooling rate. In general, during cooling in the furnace, the cooling rate decreases at a lower temperature. For example, the cooling rate at 430° C. is lower than that at 550° C.

(Heat Treatment of Casting)

Even when a final product is a casting, a casting is heated and/or cooled after being cast and cooled to normal temperature under any one of the following conditions (1) to (4).

(1) Hold the casting at a temperature from 525° C. to 575° C. for 15 minutes to 8 hours;

(2) Hold the casting at a temperature of 505° C. or higher and lower than 525° C. for 100 minutes to 8 hours;

(3) Raise the material's temperature to a temperature between 525° C. and 620° C. once, then hold it in a temperature range from 525° C. to 575° C. for 15 minutes or longer; or (4) Cool the casting on a condition corresponding to one described in (3) above, specifically, in a temperature range from 525° C. to 575° C. at an average cooling rate of 0.1° C./min to 3° C./min.

Subsequently, the casting is cooled in a temperature range from 450° C. to 400° C. at an average cooling rate of 3° C./min to 500° C./min. As a result, the metallographic structure can be improved.

When the metallographic structure is observed using a 2000-fold or 5000-fold electron microscope, it can be seen that the cooling rate in a temperature range from 450° C. to 400° C., which decides whether μ phase appears or not, is about 8° C./min. In particular, a critical cooling rate that significantly affects the properties is 3° C./min or 4° C./min. Of course, whether or not μ phase appears also depends on the composition, and the formation of μ phase rapidly progresses as the Cu concentration increases, the Si concentration increases, and the value of the metallographic structure relational expression f1 increases.

That is, when the cooling rate in a temperature range from 450° C. to 400° C. is lower than about 8° C./min, the length of the long side of μ phase precipitated at a grain boundary reaches about 1 μm, and μ phase further grows as the cooling rate becomes lower. When the cooling rate is about 5° C./min, the length of the long side of μ phase is about 3 μm to 10 μm. When the cooling rate is lower than about 3° C./min, the length of the long side of μ phase exceeds 15 μm and, in some cases, exceeds 25 μm. When the length of the long side of μ phase reaches about 10 μm, μ phase can be distinguished from a grain boundary and can be observed using a 1000-fold metallographic microscope. On the other hand, the upper limit of the cooling rate varies depending on the hot working temperature or the like. When the cooling rate is excessively high, a constituent phase that is formed under high temperature is maintained as it is even under normal temperature, the amount of κ phase increases, and the amounts of β phase and γ phase that affect corrosion resistance and impact resistance increase.

Currently, for most of extrusion materials of a copper alloy, brass alloy including 1 to 4 mass % of Pb is used. In the case of the brass alloy including Pb, as disclosed in Patent Document 1, a heat treatment is performed at a temperature of 350° C. to 550 as necessary. The lower limit of 350° C. is a temperature at which recrystallization occurs and the material softens almost entirely. At 550° C. as the upper limit, the recrystallization ends, and recrystallized grains start to be coarsened. In addition, heat treatment at a higher temperature causes a problem in relation to energy. In addition, when a heat treatment is performed at a temperature of higher than 550° C., the amount of β phase significantly increases. It is presumed that this is the reason the upper limit is disclosed as 550° C. As a common manufacturing facility, a batch furnace or a continuous furnace is used. In the case of the batch furnace, after furnace cooling, the material is air-cooled after its temperature reaches about 300° C. to about 50° C. In the case of the continuous furnace, the material is cooled at a relatively low rate until the material's temperature decreases to about 300° C. Cooling is performed at a cooling rate that is different from that of the method of manufacturing the alloy according to the embodiment.

Regarding the metallographic structure of the alloy according to the embodiment, one important thing in the manufacturing step is the cooling rate in the temperature range from 450° C. to 400° C. in the process of cooling after heat treatment or hot working. When the cooling rate is lower than 3° C./min, the proportion of μ phase increases. μ phase is mainly formed around a grain boundary or α phase boundary. In a harsh environment, the corrosion resistance of μ phase is lower than that of α phase or κ phase. Therefore, selective corrosion of μ phase or grain boundary corrosion is caused to occur. In addition, as in the case of γ phase, μ phase becomes a stress concentration source or causes grain boundary sliding to occur such that impact resistance or high-temperature strength deteriorates. Preferably, in the process of cooling after hot working, the cooling rate in a temperature range from 450° C. to 400° C. is 3° C./min or higher, preferably 4° C./min or higher and more preferably 8° C./min or higher. In consideration of thermal strain, the upper limit of the cooling rate is 500° C./min or lower and preferably 300° C./min or lower.

(Cold Working Step)

In order to obtain high strength, to improve the dimensional accuracy, or to straighten the extruded coil, cold working may be performed on the hot extruded material. For example, the hot extruded material is cold-drawn at a working ratio of about 2% to about 20%, preferably about 2% to about 15%, and more preferably about 2% to about 10% and then undergoes a heat treatment. Alternatively, after hot working and a heat treatment, the heat treated material is wire-drawn or rolled in a cold state at a working ratio of about 2% to about 20%, preferably about 2% to about 15%, and more preferably about 2% to about 10% and, in some cases, undergoes a straightness correction step. Depending on the dimensions of a final product, cold working and the heat treatment may be repeatedly performed. The straightness of the rod material may be improved using only a straightness correction facility, or shot peening may be performed a forged product after hot working. Actual cold working ratio is about 0.1% to about 1.5%, and even when the cold working ratio is small, the strength increases.

Cold working is advantageous in that the strength of the alloy can be increased. By performing a combination of cold working at a working ratio of 2% to 20% and a heat treatment on the hot worked material, regardless of the order of performing these processes, high strength, ductility, and impact resistance can be well-balanced, and properties in which strength is prioritized or ductility or toughness is prioritized according to the intended use can be obtained.

When the heat treatment of the embodiment is performed after cold working at a working ratio of 2% to 15%, α phase and κ phase are sufficiently recovered due to the heat treatment but are not completely recrystallized such that work strain remains in α phase and κ phase. Concurrently, the amount of γ phase is reduced, α phase is strengthened due to the presence of acicular κ phase (κ1 phase) in α phase, and the amount of κ phase increases. As a result, ductility, impact resistance, tensile strength, high temperature properties, and the strength-ductility balance index are higher than those of the hot worked material with the balance index f8 being 690 or higher, sometimes even 700 or higher, or the strength balance index f9 reaches 715 or higher, sometimes even 725 or higher. By adopting a manufacturing process like this, an alloy having excellent corrosion resistance, impact resistance, ductility, strength, and machinability is prepared.

Incidentally, when a copper alloy that is generally widely used as the free-cutting copper alloy is cold-worked at 2% to 15% and is heated to 505° C. to 575° C., the strength of the copper alloy decreases by recrystallization. That is, in a free-cutting copper alloy of the conventional art that undergoes cold working, the strength significantly decreases by recrystallization heat treatment. However, in the case of the alloy according to the embodiment that undergoes cold working, the strength increases on the contrary, and an extremely high strength is obtained. This way, the alloy according to the embodiment and the free-cutting copper alloy of the conventional art that undergo cold working are completely different from each other in the behavior after the heat treatment.

(Low-Temperature Annealing)

A rod material, a forged product, or a casting may be annealed at a low temperature which is lower than the recrystallization temperature mainly in order to remove residual stress or to correct the straightness of rod material. In the alloy according to the embodiment, elongation and proof stress are improved while maintaining tensile strength. As low-temperature annealing conditions, it is desired that the material's temperature is 240° C. to 350° C. and the heating time is 10 minutes to 300 minutes. Further, it is preferable that the low-temperature annealing is performed so that the relation of $150 \leq (T-220) \times (t)^{1/2} \leq 1200$, wherein the temperature (material's temperature) of the low-temperature annealing is represented by T (° C.) and the heating time is represented by t (min), is satisfied. Note that the heating time t (min) is counted (measured) from when the temperature is 10° C. lower (T−10) than a predetermined temperature T (° C.).

When the low-temperature annealing temperature is lower than 240° C., residual stress is not removed sufficiently, and straightness correction is not sufficiently performed. When the low-temperature annealing temperature is higher than 350° C., μ phase is formed around a grain boundary or a phase boundary. When the low-temperature annealing time is shorter than 10 minutes, residual stress is not removed sufficiently. When the low-temperature annealing time is longer than 300 minutes, the amount of μ phase increases. As the low-temperature annealing temperature increases or the low-temperature annealing time increases, the amount of μ phase increases, and corrosion resistance, impact resistance, and high-temperature properties deteriorate. However, as long as low-temperature annealing is performed, precipitation of μ phase is not avoidable. Therefore, how precipitation of μ phase can be minimized while removing residual stress is the key.

The lower limit of the value of $(T-220) \times (t)^{1/2}$ is 150, preferably 180 or higher, and more preferably 200 or higher. In addition, the upper limit of the value of $(T-220) \times (t)^{1/2}$ is 1200, preferably 1100 or lower, and more preferably 1000 or lower.

Using this manufacturing method, the high-strength free-cutting copper alloys according to the first and second embodiments of the present invention are manufactured.

The hot working step, the heat treatment (also referred to as annealing) step, and the low-temperature annealing step are steps of heating the copper alloy. When the low-temperature annealing step is not performed, or the hot working step or the heat treatment step is performed after the low-temperature annealing step (when the low-temperature annealing step is not the final step among the steps of heating the copper alloy), the step that is performed later among the hot working steps and the heat treatment steps is important, regardless of whether cold working is performed. When the hot working step is performed after the heat treatment step, or the heat treatment step is not performed after the hot working step (when the hot working step is the final step among the steps of heating the copper alloy), it is necessary that the hot working step satisfies the above-described heating conditions and cooling conditions. When the heat treatment step is performed after the hot working step, or the hot working step is not performed after the heat treatment step (a case where the heat treatment step is the final step among the steps of heating the copper alloy), it is necessary that the heat treatment step satisfies the above-described heating conditions and cooling conditions. For example, in cases where the heat treatment step is not performed after the hot forging step, it is necessary that the hot forging step satisfies the above-described heating conditions and cooling conditions for hot forging. In cases where the heat treatment step is performed after the hot forging step, it is necessary that the heat treatment step satisfies the above-described heating conditions and cooling conditions for heat treatment.

In this case, it is not necessary that the hot forging step satisfies the above-described heating conditions and cooling conditions for hot forging.

In the low-temperature annealing step, the material's temperature is 240° C. to 350° C. This temperature concerns whether or not μ phase is formed, and does not concern the temperature range (575° C. to 525° C. and 525° C. to 505° C.) where the amount of γ phase is reduced. This way, the material's temperature in the low-temperature annealing step does not relate to an increase or decrease in the amount of γ phase. Therefore, when the low-temperature annealing step is performed after the hot working step or the heat treatment step (the low-temperature annealing step is the final step among the steps of heating the copper alloy), the conditions of the low-temperature annealing step and the heating conditions and cooling conditions of the step before the low-temperature annealing step (the step of heating the copper alloy immediately before the low-temperature annealing step) are both important, and it is necessary that the low-temperature annealing step and the step before the low-temperature annealing step satisfy the above-described heating conditions and the cooling conditions. Specifically, the heating conditions and cooling conditions of the step that is performed last among the hot working steps and the heat treatment steps performed before the low-temperature annealing step are important, and it is necessary that the above-described heating conditions and cooling conditions are satisfied. When the hot working step or the heat treatment step is performed after the low-temperature annealing step, as described above, the step that is performed last among the hot working steps and the heat treatment steps is important, and it is necessary that the above-described heating conditions and cooling conditions are satisfied. The hot working step or the heat treatment step may be performed before or after the low-temperature annealing step.

In the free-cutting alloy according to the first or second embodiment of the present invention having the above-described constitution, the alloy composition, the composition relational expressions, the metallographic structure, and the metallographic structure relational expressions are defined as described above. Therefore, corrosion resistance in a harsh environment, impact resistance, and high-temperature properties are excellent. In addition, even if the Pb content is low, excellent machinability can be obtained.

The embodiments of the present invention are as described above. However, the present invention is not limited to the embodiments, and appropriate modifications can be made within a range not deviating from the technical requirements of the present invention.

EXAMPLES

The results of an experiment that was performed to verify the effects of the present invention are as described below. The following Examples are shown in order to describe the effects of the present invention, and the requirements for composing the example alloys, processes, and conditions included in the descriptions of the Examples do not limit the technical range of the present invention.

Example 1

<Experiment on the Actual Production Line>

Using a low-frequency melting furnace and a semi-continuous casting machine on the actual production line, a trial manufacture test of copper alloy was performed. Table 2 shows alloy compositions. Since the equipment used was the one on the actual production line, impurities were also measured in the alloys shown in Table 2. In addition, manufacturing steps were performed under the conditions shown in Tables 5 to 11.

(Steps No. A1 to A14 and AH1 to AH14)

Using the low-frequency melting furnace and the semi-continuous casting machine on the actual production line, a billet having a diameter of 240 mm was manufactured. As to raw materials, those used for actual production were used. The billet was cut into a length of 700 mm and was heated. Then hot extruded into a round bar shape having a diameter of 25.6 mm, and the rod bar was wound into a coil (extruded material). Next, using the heat keeping effect of the coil and adjustment of a fan, the extruded material was cooled in temperature ranges from 575° C. to 525° C. and from 450° C. to 400° C. at a cooling rate of 20° C./min. In a temperature range of 400° C. or lower also, the extruded material was cooled at a cooling rate of 20° C./min. The temperature was measured using a radiation thermometer placed mainly around the final stage of hot extrusion about three to four seconds after being extruded from an extruder. A radiation thermometer DS-06DF (manufactured by Daido Steel Co., Ltd.) was used for the temperature measurement.

It was verified that the average temperature of the extruded material was within ±5° C. of a temperature shown in Tables 5 and 6 (in a range of (temperature shown in Tables 5 and 6)−5° C. to (temperature shown in Table 5 and 6)+5° C.).

In Step No. AH14, the extrusion temperature was 580° C. In steps other than Step AH14, the extrusion temperatures were 640° C. In Step No. AH14 in which the extrusion temperature was 580° C., two kinds of prepared materials were not able to be extruded to the end, and the extrusion was given up.

After the extrusion, in Step No. AH1, only straightness correction was performed. In Step No. AH2, an extruded material having a diameter of 25.6 mm was cold-drawn to obtain a diameter of 25.0 mm.

In Steps No. A1 to A6 and AH3 to AH6, an extruded material having a diameter of 25.6 mm was cold-drawn to obtain a diameter of 25.0 mm. The drawn material was heated and held at a predetermined temperature for a predetermined time using an electric furnace on the actual production line or a laboratory electric furnace, and an average cooling rate in a temperature range from 575° C. to 525° C. or an average cooling rate in a temperature range from 450° C. to 400° C. in the process of cooling was made to vary.

In Steps No. A7 to A9 and AH7 to AH8, an extruded material having a diameter of 25.6 mm was cold-drawn to obtain a diameter of 25.0 mm. A heat treatment was performed on the drawn material using a continuous furnace, and a maximum reaching temperature, a cooling rate in a temperature range from 575° C. to 525° C. or a cooling rate in a temperature range from 450° C. to 400° C. in the process of cooling was made to vary.

In Steps No. A10 and A11, a heat treatment was performed on an extruded material having a diameter of 25.6 mm. Next, in Steps No. A10 and A11, the extruded materials were cold-drawn at cold working ratios of about 5% and about 8% to obtain diameters of 25 mm and 24.5 mm, respectively, and the straightness thereof was corrected (drawing and straightness correction after heat treatment).

Step No. A12 is the same as Step No. A1, except for the dimension after drawing as being 424.5 mm.

In Steps No. A13, A14, AH12, and AH13, a cooling rate after hot extrusion was made to vary, and a cooling rate in a temperature range from 575° C. to 525° C. or a cooling rate in a temperature range from 450° C. to 400° C. in the process of cooling was made to vary.

Regarding heat treatment conditions, as shown in Tables 5 and 6, the heat treatment temperature was made to vary in a range of 490° C. to 635° C., and the holding time was made to vary in a range of 5 minutes to 180 minutes.

In the following tables, if cold drawing was performed before the heat treatment, "○" is indicated, and if the cold drawing was not performed before the heat treatment, "-" is indicated.

Regarding Alloy No. 1, the molten alloy was transferred to a holding furnace and Sn and Fe were added to the molten alloy. Step No. EH1 or Step No. E1 was then performed, and the alloy was evaluated.

(Steps No. B1 to B3 and BH1 to BH3)

A material (rod material) having a diameter of 25 mm obtained in Step No. A10 was cut into a length of 3 m. Next, this rod material was set in a mold and was annealed at a low temperature for straightness correction. The conditions of this low-temperature annealing are shown in Table 8.

The conditional expression indicated in Table 8 is as follows:

$$(\text{Conditional Expression})=(T-220)\times(t)^{1/2}$$

T: temperature (material's temperature) (° C.)

t: heating time (min)

The result was that straightness was poor only in Step No. BH1. Therefore, the properties of the alloy prepared by Step No. BH1 were not evaluated.

(Steps No. C0 and C1)

Using the low-frequency melting furnace and the semi-continuous casting machine on the actual production line, an ingot (billet) having a diameter of 240 mm was manufactured. As to raw materials, raw materials corresponding to those used for actual production were used. The billet was cut into a length of 500 mm and was heated. Hot extrusion was performed to obtain a round bar-shaped extruded material having a diameter of 50 mm. This extruded material was extruded onto an extrusion table in a straight rod shape. The temperature was measured using a radiation thermometer mainly at the final stage of extrusion about three to four seconds after extrusion from an extruder. It was verified that the average temperature of the extruded material was within ±5° C. of a temperature shown in Table 9 (in a range of (temperature shown in Table 9)−5° C. to (temperature shown in Table 9)+5° C.). The cooling rate from 575° C. to 525° C. and the cooling rate from 450° C. to 400° C. after extrusion were both 15° C./min (extruded material). In steps described below, an extruded material (round bar) obtained in Step No. C0 was used as materials for forging. In Step No. C1, heating was performed at 560° C. for 60 minutes, and subsequently, the material was cooled from 450° C. to 400° C. at a cooling rate of 12° C./min.

(Steps No. D1 to D7 and DH1 to DH6)

A round bar having a diameter of 50 mm obtained in Step No. C0 was cut into a length of 180 mm. This round bar was horizontally set and was forged into a thickness of 16 mm using a press machine having a hot forging press capacity of 150 ton. About three or four seconds immediately after hot forging the material into a predetermined thickness, the temperature was measured using the radiation thermometer. It was verified that the hot forging temperature (hot working temperature) was within ±5° C. of a temperature shown in Table 10 (in a range of (temperature shown in Table 10)−5° C. to (temperature shown in Table 10)+5° C.).

In Steps No. D1 to D4, DH2, and DH6, a heat treatment was performed in a laboratory electric furnace, and the heat treatment temperature, the time, the cooling rate in a temperature range from 575° C. to 525° C., and the cooling rate in a temperature range from 450° C. to 400° C. in the process of cooling were made to vary.

In Steps No. D5, D7, DH3, and DH4, heating was performed in the continuous furnace in a temperature range of 565° C. to 590° C. for 3 minutes, and the cooling rate was made to vary.

Heat treatment temperature refers to the maximum reaching temperature of the material, and as the holding time, a period of time in which the material was held in a temperature range from the maximum reaching temperature to (maximum reaching temperature−10° C.) was used.

In Steps No. DH1, D6, and DH5, during cooling after hot forging, the cooling rate in a temperature range from 575° C. to 525° C. and the cooling rate in a temperature range from 450° C. to 400° C. were made to vary. The preparation operations of the samples ended upon completion of the cooling after forging.

<Laboratory Experiment>

Using a laboratory facility, a trial manufacture test of copper alloy was performed. Tables 3 and 4 show alloy compositions. The balance refers to Zn and inevitable impurities. The copper alloys having the compositions shown in Table 2 were also used in the laboratory experiment. In addition, manufacturing steps were performed under the conditions shown in Tables 12 to 16.

(Steps No. E1 and EH1)

In a laboratory, raw materials mixed at a predetermined component ratio were melted. The molten alloy was cast into a mold having a diameter of 100 mm and a length of 180 mm to prepare a billet. A part of the molten alloy was cast from a melting furnace on the actual production line into a mold having a diameter of 100 mm and a length of 180 mm to prepare a billet. This billet was heated and, in Steps No. E1 and EH1, was extruded into a round bar having a diameter of 40 mm.

Immediately after stopping the extrusion test machine, the temperature was measured using a radiation thermometer. In effect, this temperature corresponds to the temperature of the extruded material about three or four seconds after being extruded from the extruder.

In Step No. EH1, the preparation operation of the sample ended upon completion of the extrusion, and the obtained extruded material was used as a material for hot forging in steps described below.

In Step No. E1, a heat treatment was performed under conditions shown in Table 12 after extrusion.

(Steps No. F1 to F5, FH1, and FH2)

Round bars having a diameter of 40 mm obtained in Step Nos. EH1 and PH1, which will be described later, were cut into a length of 180 mm. This round bar obtained in Step No. EH1 or the casting of Step No. PH1 was horizontally set and was forged to a thickness of 15 mm using a press machine having a hot forging press capacity of 150 ton. About three to four seconds immediately after hot forging the material to the predetermined thickness, the temperature was measured using a radiation thermometer. It was verified that the hot forging temperature (hot working temperature) was within ±5° C. of a temperature shown in Table 13 (in a range of (temperature shown in Table 13)−5° C. to (temperature shown in Table 13)+5° C.).

The hot-forged material was cooled at the cooling rate of 20° C./min for a temperature range from 575° C. to 525° C. and at the cooling rate of 18° C./min for a temperature range from 450° C. to 400° C. respectively. In Step No. FH1, hot forging was performed on the round bar obtained in Step No. EH1, and the preparation operation of the sample ended upon cooling the material after hot forging.

In Steps No. F1, F2, F3, and FH2, hot forging was performed on the round bar obtained in Step No. EH1, and a heat treatment was performed after hot forging. The heat treatment was performed with varied heating conditions and varied cooling rates for temperature ranges from 575° C. to 525° C. and from 450° C. to 400° C.

In Steps No. F4 and F5, hot forging was performed by using a casting which was made with a metal mold (No. PH1) as a material for forging. After hot forging, a heat treatment (annealing) was performed with varied heating conditions and cooling rates.

(Steps No. P1 to P3 and PH1)

In Step No. PH1, raw materials mixed at a predetermined component ratio was melted, and the molten alloy was cast into a mold having an inner diameter of ϕ40 mm to obtain a casting. Specifically, a part of the molten alloy was taken from a melting furnace on the actual production line and was poured into a mold having an inner diameter of 40 mm to prepare the casting.

In Step No. PC, a continuously cast rod having a diameter of ϕ40 mm was prepared by continuous casting (not shown in the table).

In Step No. P1, a heat treatment was performed on the casting of Step No. PH1. On the other hand, in Steps No. P2 and P3, a heat treatment was performed on the casting of Step No. PC. In Steps No. P1 to P3, the heat treatment was performed on the castings on varied heating conditions and cooling rates.

In Step No. R1, a part of the molten alloy was taken from a melting furnace on the actual production line and poured into a mold having dimensions of 35 mm×70 mm. The surface of the casting was machined to obtain dimensions of 30 mm×65 mm. The casting was then heated to 780° C. and was hot rolled in three passes to obtain a thickness of 8 mm. About three or four seconds after the end of the final hot rolling, the material's temperature was 640, and then the material was air-cooled. A heat treatment was performed on the obtained rolled plate using an electric furnace.

TABLE 2

| Alloy | Component Composition (mass %) | | | | | Impurities (mass %) | | | | | | Composition Relational Expression | |
|---|---|---|---|---|---|---|---|---|---|---|---|---|---|
| No. | Cu | Si | P | Pb | Zn | Element | Amount | Element | Amount | Element | Amount | f1 | f2 |
| S01 | 76.0 | 3.19 | 0.11 | 0.044 | Balance | Sn | 0.008 | Al | 0 | Mn | 0.005 | 78.7 | 60.9 |
| | | | | | | Fe | 0.007 | Ni | 0.040 | As | 0.004 | | |
| | | | | | | Ag | 0.003 | Cr | 0.005 | | | | |
| S02 | 77.2 | 3.44 | 0.07 | 0.032 | Balance | Sn | 0.016 | Al | 0 | S | 0.001 | 80.1 | 61.0 |
| | | | | | | Fe | 0.024 | Mn | 0.021 | Sb | 0.003 | | |
| | | | | | | Ag | 0.008 | Rare Earth Element | 0.010 | | | | |
| S03 | 76.3 | 3.33 | 0.09 | 0.009 | Balance | Sn | 0.006 | Al | 0.003 | Se | 0.008 | 79.1 | 60.6 |
| | | | | | | Fe | 0.018 | Ni | 0.012 | Te | 0.009 | | |
| | | | | | | Co | 0.005 | W | 0.003 | Bi | 0.002 | | |
| | | | | | | Ag | 0.010 | | | | | | |
| S11 | 76.0 | 3.19 | 0.11 | 0.044 | Balance | Sn | 0.030 | Al | 0 | Mn | 0.005 | | |
| | | | | | | Fe | 0.007 | Ni | 0.040 | As | 0.004 | 78.7 | 60.9 |
| | | | | | | Ag | 0.003 | Cr | 0.005 | | | | |
| S12 | 76.0 | 3.18 | 0.11 | 0.044 | Balance | Sn | 0.064 | Al | 0 | Mn | 0.005 | | |
| | | | | | | Fe | 0.007 | Ni | 0.040 | As | 0.004 | 78.7 | 61.0 |
| | | | | | | Ag | 0.003 | Cr | 0.005 | | | | |
| S13 | 76.0 | 3.18 | 0.10 | 0.043 | Balance | Sn | 0.008 | Al | 0 | Mn | 0.005 | | |
| | | | | | | Fe | 0.040 | Ni | 0.040 | As | 0.004 | 78.7 | 61.0 |
| | | | | | | Ag | 0.003 | Cr | 0.005 | | | | |
| S14 | 76.0 | 3.17 | 0.11 | 0.043 | Balance | Sn | 0.008 | Al | 0 | Mn | 0.005 | | |
| | | | | | | Fe | 0.13 | Ni | 0.040 | As | 0.004 | 78.7 | 61.0 |
| | | | | | | Ag | 0.003 | Cr | 0.005 | | | | |

TABLE 3

| Alloy No. | Cu | Si | P | Pb | Sn | Al | Others | Zn | f1 | f2 |
|---|---|---|---|---|---|---|---|---|---|---|
| S21 | 77.0 | 3.35 | 0.10 | 0.022 | 0.007 | 0 | — | Balance | 79.8 | 61.2 |
| S22 | 75.7 | 3.24 | 0.08 | 0.045 | 0.006 | 0 | — | Balance | 78.4 | 60.4 |
| S23 | 76.5 | 3.27 | 0.07 | 0.034 | 0.006 | 0 | — | Balance | 79.2 | 61.1 |
| S24 | 77.3 | 3.48 | 0.13 | 0.038 | 0.007 | 0 | — | Balance | 80.3 | 60.8 |
| S25 | 77.1 | 3.40 | 0.05 | 0.019 | 0.007 | 0 | — | Balance | 79.9 | 61.1 |
| S26 | 75.5 | 3.09 | 0.08 | 0.026 | 0.005 | 0 | — | Balance | 78.1 | 60.9 |
| S27 | 76.8 | 3.36 | 0.06 | 0.027 | 0.005 | 0 | — | Balance | 79.6 | 61.0 |
| S28 | 77.7 | 3.50 | 0.08 | 0.029 | 0.006 | 0 | — | Balance | 80.6 | 61.2 |
| S29 | 76.0 | 3.25 | 0.07 | 0.012 | 0.005 | 0 | — | Balance | 78.7 | 60.7 |
| S30 | 77.6 | 3.53 | 0.09 | 0.008 | 0.006 | 0 | — | Balance | 80.5 | 60.9 |
| S31 | 76.2 | 3.12 | 0.12 | 0.009 | 0.006 | 0 | — | Balance | 78.8 | 61.4 |
| S41 | 76.4 | 3.30 | 0.10 | 0.044 | 0.029 | 0.023 | — | Balance | 79.2 | 60.8 |

TABLE 3-continued

| Alloy No. | Cu | Si | P | Pb | Sn | Al | Others | Zn | f1 | f2 |
|---|---|---|---|---|---|---|---|---|---|---|
| S42 | 77.6 | 3.47 | 0.08 | 0.031 | 0.026 | 0 | Fe: 0.03 | Balance | 80.5 | 61.2 |
| S51 | 76.6 | 3.27 | 0.07 | 0.025 | 0.006 | 0 | Sb: 0.04, Bi: 0.02 | Balance | 79.3 | 61.2 |
| S52 | 77.0 | 3.38 | 0.08 | 0.009 | 0.007 | 0 | Sb: 0.015, As: 0.04 | Balance | 79.8 | 61.0 |

TABLE 4

| Alloy No. | Cu | Si | P | Pb | Sn | Al | Others | Zn | f1 | f2 |
|---|---|---|---|---|---|---|---|---|---|---|
| S101 | 75.6 | 3.01 | 0.08 | 0.034 | 0 | 0 | — | Balance | 78.1 | 61.4 |
| S102 | 73.7 | 2.84 | 0.11 | 0.025 | 0 | 0 | — | Balance | 76.1 | 60.3 |
| S103 | 74.0 | 3.16 | 0.10 | 0.030 | 0 | 0 | — | Balance | 76.7 | 59.1 |
| S104 | 78.0 | 3.70 | 0.12 | 0.010 | 0 | 0 | — | Balance | 81.1 | 60.5 |
| S105 | 76.6 | 3.08 | 0.09 | 0.025 | 0 | 0 | — | Balance | 79.2 | 62.0 |
| S106 | 77.5 | 3.20 | 0.07 | 0.018 | 0 | 0 | — | Balance | 80.1 | 62.4 |
| S107 | 77.9 | 3.30 | 0.09 | 0.015 | 0 | 0 | — | Balance | 80.6 | 62.3 |
| S108 | 76.0 | 3.10 | 0.02 | 0.023 | 0 | 0 | — | Balance | 78.5 | 61.4 |
| S109 | 76.1 | 3.49 | 0.09 | 0.039 | 0 | 0 | — | Balance | 79.0 | 59.6 |
| S110 | 77.2 | 3.52 | 0.18 | 0.050 | 0 | 0 | — | Balance | 80.2 | 60.5 |
| S111 | 75.8 | 3.08 | 0.08 | 0.002 | 0 | 0 | — | Balance | 78.3 | 61.2 |
| S112 | 78.6 | 3.53 | 0.11 | 0.020 | 0 | 0 | — | Balance | 81.5 | 61.9 |
| S113 | 75.5 | 2.90 | 0.09 | 0.044 | 0 | 0 | — | Balance | 78.0 | 61.8 |
| S114 | 76.1 | 3.17 | 0.07 | 0.036 | 0.008 | 0.08 | — | Balance | 78.7 | 61.1 |
| S115 | 76.0 | 3.15 | 0.06 | 0.034 | 0.045 | 0.04 | — | Balance | 78.6 | 61.2 |
| S116 | 75.9 | 3.16 | 0.07 | 0.036 | 0.007 | 0 | Sb: 0.06, As: 0.06 | | 78.5 | 61.0 |
| S117 | 76.0 | 3.15 | 0.07 | 0.037 | 0.006 | 0 | Fe: 0.07, Cr: 0.05 | | 78.6 | 61.1 |
| S118 | 75.9 | 3.18 | 0.08 | 0.198 | 0 | 0 | — | | 78.8 | 61.0 |

TABLE 5

| | Hot Extrusion | | | | | Heat Treatment (Annealing) | | | | |
|---|---|---|---|---|---|---|---|---|---|---|
| Step No. | Temp. (° C.) | Cooling Rate from 575° C. to 525° C. (° C./min) | Cooling Rate from 450° C. to 400° C. (° C./min) | Cold Drawing and Straightness Correction before Heat Treatment | Diameter of Extruded Material before Heat Treatment (mm) | Kind of Furnace (*) | Temp. (° C.) | Holding Time (min) | Cooling Rate from 575° C. to 525° C. (° C./min) | Cooling Rate from 450° C. to 400° C. ( °C./min) |
| A1 | 640 | 20 | 20 | ○ | 25.0 | C | 535 | 120 | 15 | 20 |
| A2 | 640 | 20 | 20 | ○ | 25.0 | C | 535 | 120 | 15 | 14 |
| A3 | 640 | 20 | 20 | ○ | 25.0 | C | 535 | 120 | 15 | 7 |
| A4 | 640 | 20 | 20 | ○ | 25.0 | C | 535 | 120 | 15 | 3.6 |
| A5 | 640 | 20 | 20 | ○ | 25.0 | C | 515 | 240 | — | 20 |
| A6 | 640 | 20 | 20 | ○ | 25.0 | A | 535 | 30 | 15 | 20 |
| A7 | 640 | 20 | 20 | ○ | 25.0 | B | 590 | 5 | 1.8 | 10 |
| A8 | 640 | 20 | 20 | ○ | 25.0 | B | 590 | 5 | 1 | 10 |
| A9 | 640 | 20 | 20 | ○ | 25.0 | B | 560 | 5 | 1 | 20 |
| A10 | 640 | 20 | 20 | — | 25.6 | C | 545 | 120 | 15 | 20 |
| A11 | 640 | 20 | 20 | — | 25.6 | C | 545 | 120 | 15 | 20 |
| A12 | 640 | 20 | 20 | ○ | 24.5 | C | 535 | 120 | 15 | 20 |
| A13 | 640 | 1.6 | 15 | Correction only | 25.6 | — | — | — | — | — |
| A14 | 640 | 1.1 | 15 | Correction only | 25.6 | — | — | — | — | — |

(*) A: Electric furnace in the laboratory

B: Continuous furnace in the laboratory

C: Electric furnace on the production line

TABLE 6

| | Hot Extrusion | | | | | Heat Treatment (Annealing) | | | | |
|---|---|---|---|---|---|---|---|---|---|---|
| Step No. | Temp (° C.) | Cooling Rate from 575° C. to 525° C. (° C./min) | Cooling Rate from 450° C. to 400° C. (° C./min) | Cold Drawing and Straightness Correction before Heat Treatment | Diameter of Extruded Material before Heat Treatment (mm) | Kind of Furnace (*) | Temp (° C.) | Holding Time (min) | Cooling Rate from 575° C. to 525° C. (° C./min) | Cooling Rate from 450° C. to 400° C. (° C./min) |
| AH1 | 640 | 20 | 20 | Correction only | 25.6 | — | — | — | — | — |
| AH2 | 640 | 20 | 20 | ○ | 25.0 | — | — | — | — | — |
| AH3 | 640 | 20 | 20 | ○ | 25.0 | C | 535 | 120 | 2.4 | 1.8 |
| AH4 | 640 | 20 | 20 | ○ | 25.0 | C | 535 | 120 | 1.5 | 1 |
| AH5 | 640 | 20 | 20 | ○ | 25.0 | A | 635 | 60 | 15 | 10 |
| AH6 | 640 | 20 | 20 | ○ | 25.0 | A | 490 | 180 | — | 20 |
| AH7 | 640 | 20 | 20 | ○ | 25.0 | B | 590 | 5 | 5 | 10 |
| AH8 | 640 | 20 | 20 | ○ | 25.0 | B | 590 | 5 | 1.8 | 1.6 |
| AH9 | 640 | 20 | 20 | ○ | 25.0 | A | 515 | 50 | — | 20 |
| AH10 | 640 | 20 | 20 | ○ | 25.0 | A | 560 | 10 | 15 | 20 |
| AH11 | 640 | 20 | 20 | ○ | 25.0 | A | 595 | 60 | 15 | 20 |
| AH12 | 640 | 3.5 | 15 | Correction only | 25.6 | — | — | — | — | — |
| AH13 | 640 | 1.4 | 1.2 | Correction only | 25.6 | — | — | — | — | — |
| AH14 | 580 | 20 | 20 | | Unable to be extruded to the end | | | | | |

(*) A: Electric furnace in the laboratory
B: Continuous furnace in the laboratory
C: Electric furnace on the production line

TABLE 7

| Step No. | Note |
|---|---|
| A1 | Appropriate conditions |
| A2 | Cooling rate of heat treatment was made to vary |
| A3 | Cooling rate of heat treatment was made to vary |
| A4 | Cooling rate of heat treatment from 450° C. to 400° C. was close to 3° C./min. |
| A5 | Heat treatment temperature was relatively low, but holding time was relatively long |
| A6 | Heat treatment temperature was appropriate, and holding time was relatively short (31 minutes in effect) |
| A7 | Heat treatment temperature was relatively high. Cooling rate from 525° C. to 575° C. was relatively low (relatively short as being 28 minutes in effect) |
| A8 | Heat treatment temperature was relatively high. Cooling rate from 525° C. to 575° C. was relatively low (50 minutes in effect) |
| A9 | Cooling rate was relatively low (40 minutes in effect) |
| A10 | After heat treatment, drawing and straightness correction were performed at cold working ratio of 4.6% to obtain diameter of 25 mm |
| A11 | After heat treatment, drawing and straightness correction were performed at cold working ratio of 8.4% to obtain diameter of 24.5 mm |
| A12 | Same conditions as those of Step A1, except that the diameter in Step A1 was 25 mm, whereas that in Step A12 was 24.5 mm |
| A13 | Cooling rate from 575° C. to 525° C. after extrusion was slightly low |
| A14 | Cooling rate from 575° C. to 525° C. after extrusion was relatively low |
| AH1 | No heat treatment was performed |
| AH2 | No heat treatment was performed |
| AH3 | Cooling rate from 450° C. to 400° C. was low due to furnace cooling |
| AH4 | Cooling rate from 450° C. to 400° C. was low due to furnace cooling |
| AH5 | Heat treatment temperature was high, and α phase was coarsened |
| AH6 | Heat treatment temperature was low |
| AH7 | Heat treatment temperature was higher by 15° C., and cooling rate from 525° C. to 575° C. was high |
| AH8 | Cooling rate of heat treatment from 450° C. to 400° C. was low |
| AH9 | Heat treatment temperature was relatively low, and holding time was short |
| AH10 | Heat treatment temperature was appropriate, and holding time was short (12 minutes in effect) |
| AH11 | heat treatment temperature was relatively high, and holding time from 575° C. to 525° C. during cooling was short |
| AH12 | Cooling rate from 575° C. to 525° C. after extrusion was high |
| AH13 | Cooling rate from 450° C. to 400° C. after extrusion was low |
| AH14 | Extrusion was not able to be performed to the end due to low extrusion temperature |

TABLE 8

| Step No. | Material | Kind of Furnace | Temp. (° C.) | Holding Time (min) | Value of Conditional Expression |
|---|---|---|---|---|---|
| B1 | Rod material obtained in Step A10 | Electric furnace on the production line | 275 | 180 | 738 |
| B2 | | Electric furnace on the production line | 320 | 75 | 866 |
| B3 | | Electric furnace on the production line | 290 | 75 | 606 |
| BH1 | | Electric furnace on the production line | 220 | 120 | — |
| BH2 | | Electric furnace in the laboratory | 370 | 20 | 671 |
| BH3 | | Electric furnace on the production line | 320 | 180 | 1342 |

Conditional Expression: $(T - 220) \times (t)^{1/2}$

T: Temperature (° C.), t: Time (min)

TABLE 11

| Step No. | Note |
|---|---|
| D1 | Appropriate conditions |
| D2 | Cooling rate of heat treatment was made to vary |
| D3 | Cooling rate of heat treatment was made to vary |
| D4 | Heat treatment temperature was relatively low, but holding time was relatively long |
| D5 | Cooling rate from 575° C. to 525° C. in heat treatment was relatively low (25 minutes in effect) |
| D6 | Cooling rate from 575° C. to 525° C. after forging was relatively low |
| D7 | Cooling rate from 575° C. to 525° C. in heat treatment was relatively low (43 minutes in effect) |
| DH1 | Heat treatment was not performed |
| DH2 | Due to furnace cooling, the cooling rate from 450° C. to 400° C. was low |
| DH3 | Cooling rate of heat treatment from 450° C. to 400° C. was low |
| DH4 | Cooling rate from 575° C. to 525° C. in heat treatment was high (13 minutes in effect) |

TABLE 9

| | Hot Extrusion | | | | Heat Treatment (Annealing) | | | | |
|---|---|---|---|---|---|---|---|---|---|
| Step No. | Temp. (° C.) | Cooling Rate from 575° C. to 525° C. (° C./min) | Cooling Rate from 450° C. to 400° C. (° C./min) | Diameter of Extruded Material before Heat Treatment (mm) | Temp. (° C.) | Holding Time (min) | Cooling Rate from 575° C. to 525° C. (° C./min) | Cooling Rate from 450° C. to 400° C. (° C./min) | Note |
| C0 | 640 | 15 | 15 | 50 | — | — | — | — | Materials for forging |
| C1 | 640 | 15 | 15 | 50 | 560 | 60 | 15 | 12 | — |

TABLE 10

| | | Hot Forging | | | Heat Treatment (Annealing) | | | | |
|---|---|---|---|---|---|---|---|---|---|
| Step No. | Material | Temp. (° C.) | Cooling Rate from 575° C. to 525° C. (° C./min) | Cooling Rate from 450° C. to 400° C. (° C./min) | Kind of Furnace | Temp. (° C.) | Holding Time (min) | Cooling Rate from 575° C. to 525° C. (° C./min) | Cooling Rate from 450° C. to 400° C. (° C./min) |
| D1 | Round bar obtained in Step C0 | 690 | 20 | 20 | Electric Furnace in the Lab | 535 | 80 | 15 | 15 |
| D2 | | 690 | 20 | 20 | Electric Furnace in the Lab | 535 | 80 | 15 | 8 |
| D3 | | 690 | 20 | 20 | Electric Furnace in the Lab | 535 | 80 | 6 | 4.5 |
| D4 | | 690 | 20 | 20 | Electric Furnace in the Lab | 520 | 150 | 15 | 15 |
| D5 | | 690 | 20 | 20 | Continuous Furnace in the Lab | 590 | 3 | 2 | 15 |
| D6 | | 690 | 1.5 | 10 | — | — | — | — | — |
| D7 | | 690 | 20 | 20 | Continuous Furnace in the Lab | 565 | 3 | 1 | 15 |
| DH1 | | 690 | 20 | 20 | — | — | — | — | — |
| DH2 | | 690 | 20 | 20 | Electric Furnace in the Lab | 535 | 80 | 6 | 2 |
| DH3 | | 690 | 20 | 20 | Continuous Furnace in Lab | 590 | 3 | 1.5 | 1.8 |
| DH4 | | 690 | 20 | 20 | Continuous Furnace in the Lab | 565 | 3 | 4 | 15 |
| DH5 | | 690 | 3.5 | 10 | — | — | — | — | — |
| DH6 | | 690 | 20 | 20 | Electric Furnace in the Lab | 515 | 50 | — | 15 |

TABLE 11-continued

| Step No. | Note |
|---|---|
| DH5 | Cooling rate from 575° C. to 525° C. after forging was high |
| DH6 | Heat treatment temperature was relatively low, and holding time was short |

TABLE 12

| | Hot Extrusion | | | | Heat Treatment (Annealing) | | | | |
|---|---|---|---|---|---|---|---|---|---|
| Step No. | Temp. (° C.) | Cooling Rate from 575° C. to 525° C. (° C./min) | Cooling Rate from 450° C. to 400° C. (° C./min) | Diameter of Extruded Material (mm) | Temp. (° C.) | Holding Time (min) | Cooling Rate from 575° C. to 525° C. (° C./min) | Cooling Rate from 450° C. to 400° C. (° C./min) | Note |
| E1 | 640 | 20 | 20 | 40 | 540 | 80 | 15 | 15 | |
| EH1 | 640 | 20 | 20 | 40 | — | — | — | — | Materials for forging |

TABLE 13

| | | Hot Forging | | | Heat Treatment (Annealing) | | | | |
|---|---|---|---|---|---|---|---|---|---|
| Step No. | Material | Temp. (° C.) | Cooling Rate from 575° C. to 525° C. (° C./min) | Cooling Rate from 450° C. to 400° C. (° C./min) | Kind of Furnace (*) | Temp. (° C.) | Holding Time (min) | Cooling Rate from 575° C. to 525° C. (° C./min) | Cooling Rate from 450° C. to 400° C. (° C./min) |
| F1 | ϕ40 mm | 690 | 20 | 18 | A | 560 | 60 | 50 | 10 |
| F2 | round bar | 690 | 20 | 18 | A | 515 | 180 | — | 20 |
| F3 | obtained in Step EH1 | 690 | 20 | 18 | B | 565 | 10 | 1.2 | 10 |
| F4 | ϕ40 mm | 690 | 20 | 18 | A | 560 | 70 | 20 | 20 |
| F5 | round bar obtained in Step PH1 (casting) | 690 | 20 | 18 | B | 590 | 5 | 1.2 | 10 |
| FH1 | ϕ40 mm | 690 | 20 | 18 | — | — | — | — | — |
| FH2 | round bar obtained in Step EH1 | 690 | 20 | 18 | B | 590 | 5 | 1.8 | 1.5 |

(*) A: Electric furnace in the laboratory
B: Continuous furnace in the laboratory

TABLE 14

| Step No. | Note |
|---|---|
| F1 | — |
| F2 | Heat treatment temperature was low, but holding time was relatively long |
| F3 | Cooling rate from 575° C. to 525° C. in heat treatment was relatively low (43 minutes in effect) |
| F4 | — |
| F5 | Cooling rate from 575° C. to 525° C. in heat treatment was relatively low (42 minutes in effect) |
| FH1 | — |
| FH2 | Cooling rate from 450° C. to 400° C. in heat treatment was low |

TABLE 15

| Step No. | Casting | Cooling Rate from 575° C. to 525° C. (° C./min) | Cooling Rate from 450° C. to 400° C. (° C./min) | Heat Treatment (Annealing) Kind of Furnace (*) | Temp. (° C.) | Holding Time (min) | Cooling Rate from 575° C. to 525° C. (° C./min) | Cooling Rate from 450° C. to 400° C. (° C./min) | Note |
|---|---|---|---|---|---|---|---|---|---|
| P1 | mold casting | 25 | 20 | A | 540 | 120 | 20 | 20 | — |
| P2 | continuous casting | 20 | 20 | A | 540 | 120 | 20 | 20 | Heat treatment temperature was relatively low, but the holding time was relatively long. |
| P3 | continuous casting | 20 | 20 | B | 595 | 5 | 1 | 15 | The cooling rate in heat treatment from 575° C. to 525° C. was relatively low (50 minutes in effect). |
| PH1 | mold casting | 25 | 20 | — | — | — | — | — | — |

(*) A: Electric furnace in the laboratory
B: Continuous furnace in the laboratory

TABLE 16

| Step No. | Hot Rolling Rolling Commencemnent Temperature (° C.) | Final Rolling Temp. (° C.) | Cooling Rate from 575° C. to 525° C. (° C./min) | Cooling Rate from 450° C. to 400° C. (° C./min) | Heat Treatment (Annealing) Temp. (° C.) | Holding Time (min) | Cooling Rate from 575° C. to 525° C. (° C./min) | Cooling Rate from 450° C. to 400° C. (° C./min) |
|---|---|---|---|---|---|---|---|---|
| R1 | 780 | 640 | 20 | 20 | 540 | 120 | 15 | 20 |

Regarding the above-described test materials, the metallographic structure observed, corrosion resistance (dezincification corrosion test/dipping test), and machinability were evaluated in the following procedure.

(Observation of Metallographic Structure)

The metallographic structure was observed using the following method and area ratios (%) of α phase, κ phase, β phase, γ phase, and μ phase were measured by image analysis. Note that α' phase, β' phase, and γ' phase were included in α phase, β phase, and γ phase respectively.

Each of the test materials, rod material or forged product, was cut in a direction parallel to the longitudinal direction or parallel to the flowing direction of the metallographic structure. Next, the surface was polished (mirror-polished) and was etched with a mixed solution of hydrogen peroxide and ammonia water. For etching, an aqueous solution obtained by mixing 3 mL of 3 vol % hydrogen peroxide water and 22 mL of 14 vol % ammonia water was used. At room temperature of about 15° C. to about 25° C., the metal's polished surface was dipped in the aqueous solution for about 2 seconds to about 5 seconds.

Using a metallographic microscope, the metallographic structure was observed mainly at a magnification of 500-fold and, depending on the conditions of the metallographic structure, at a magnification of 1000-fold. In micrographs of five visual fields, respective phases (α phase, κ phase, β phase, γ phase, and μ phase) were manually painted using image processing software "Photoshop CC". Next, the micrographs were binarized using image analysis software "WinROOF2013" to obtain the area ratios of the respective phases. Specifically, the average value of the area ratios of the five visual fields for each phase was calculated and regarded as the proportion of the phase. Thus, the total of the area ratios of all the constituent phases was 100%.

The lengths of the long sides of γ phase and μ phase were measured using the following method. Mainly using a 500-fold metallographic micrograph (when it is still difficult to distinguish, a 1000-fold metallographic micrograph instead), the maximum length of the long side of γ phase was measured in one visual field. This operation was performed in arbitrarily selected five visual fields, and the average maximum length of the long side of γ phase calculated from the lengths measured in the five visual fields was regarded as the length of the long side of γ phase. Likewise, by using a 500-fold or 1000-fold metallographic micrograph or using a 2000-fold or 5000-fold secondary electron micrograph (electron micrograph) according to the size of μ phase, the maximum length of the long side of μ phase in one visual field was measured. This operation was performed in arbitrarily selected five visual fields, and the average maximum length of the long sides of μ phase calculated from the lengths measured in the five visual fields was regarded as the length of the long side of μ phase.

Specifically, the evaluation was performed using an image that was printed out in a size of about 70 mm×about 90 mm. In the case of a magnification of 500-fold, the size of an observation field was 276 μm×220 μm.

When it was difficult to identify α phase, the phase was identified using an electron backscattering diffraction pattern (FE-SEM-EBSP) method at a magnification of 500-fold or 2000-fold.

In addition, in Examples in which the cooling rates were made to vary, in order to determine whether or not p phase, which mainly precipitates at a grain boundary, was present, a secondary electron image was obtained using JSM-7000F (manufactured by JEOL Ltd.) under the conditions of acceleration voltage: 15 kV and current value (set value: 15), and the metallographic structure was observed at a magnification of 2000-fold or 5000-fold. In cases where μ phase was able to be observed using the 2000-fold or 5000-fold secondary electron image but was not able to be observed using the 500-fold or 1000-fold metallographic micrograph, the μ phase was not included in the calculation of the area ratio. That is, μ phase that was able to be observed using the 2000-fold or 5000-fold secondary electron image but was not able to be observed using the 500-fold or 1000-fold metallographic micrograph was not included in the area ratio of μ phase. The reason for this is that, in most cases, the length of the long side of μ phase that is not able to be observed using the metallographic microscope is 5 μm or less, and the width of such μ phase is 0.3 μm or less. Therefore, such μ phase scarcely affects the area ratio.

The length of μ phase was measured in arbitrarily selected five visual fields, and the average value of the maximum lengths measured in the five visual fields was regarded as the length of the long side of μ phase as described above. The composition of μ phase was verified using an EDS, an accessory of JSM-7000F. Note that when μ phase was not able to be observed at a magnification of 500-fold or 1000-fold but the length of the long side of μ phase was measured at a higher magnification, in the measurement result columns of the tables, the area ratio of μ phase is indicated as 0%, but the length of the long side of μ phase is filled in.

(Observation of μ Phase)

Regarding μ phase, when cooling was performed in a temperature range of 450° C. to 400° C. at a cooling rate of 8° C./min or lower or 15° C./min or lower after hot extrusion or heat treatment, the presence of μ phase was able to be identified. FIG. 1 shows an example of a secondary electron image of Test No. T05 (Alloy No. S01/Step No. A3). It was verified that μ phase was precipitated at a grain boundary of α phase (elongated grayish white phase).

(Acicular κ Phase Present in α Phase)

Acicular κ phase (κ1 phase) present in α phase has a width of about 0.05 μm to about 0.5 μm and has an elongated linear shape or an acicular shape. If the width is 0.1 μm or more, the presence of κ1 phase can be identified using a metallographic microscope.

Figure 2:
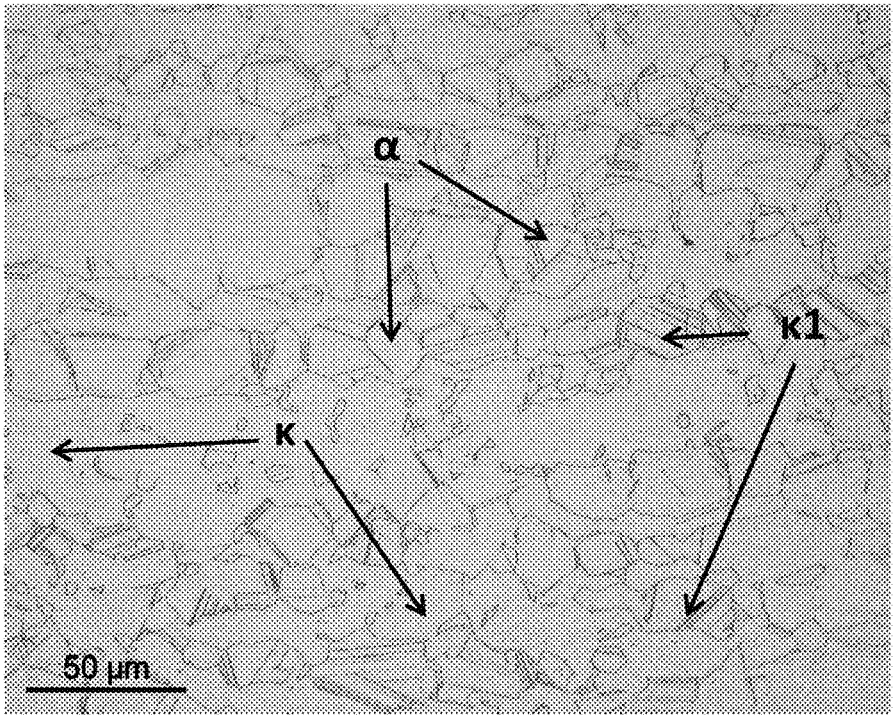
FIG. 2 is a metallographic micrograph of a metallographic structure of a high-strength free-cutting copper alloy (Test No. T73) according to Example 1.
Figure 3:
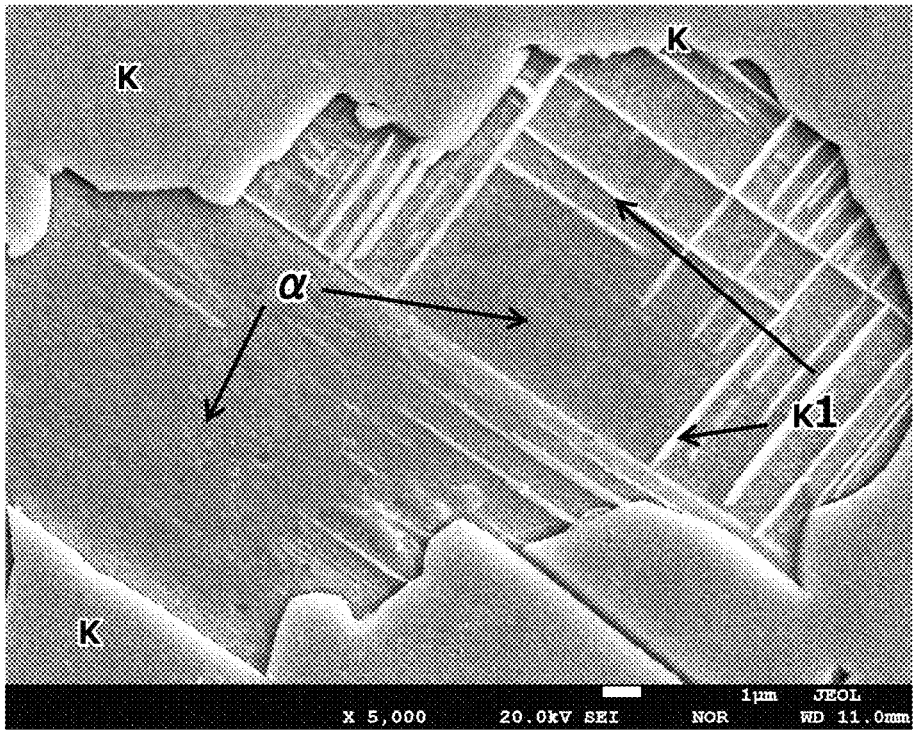
FIG. 3 is an electron micrograph of a metallographic structure of a high-strength free-cutting copper alloy (Test No. T73) according to Example 1.

FIG. 2 shows a metallographic micrograph of Test No. T73 (Alloy No. S02/Step No. A1) as a representative metallographic micrograph. FIG. 3 shows an electron micrograph of Test No. T73 (Alloy No. S02/Step No. A1) as a representative electron micrograph of acicular κ phase present in α phase. Observation points of FIGS. 2 and 3 were not the same. In a copper alloy, κ phase may be confused with twin crystal present in α phase. However, the width of κ phase is narrow, and twin crystal consists of a pair of crystals, and thus κ phase present in α phase can be distinguished from twin crystal present in α phase. In the metallographic micrograph of FIG. 2, α phase having an elongated, linear, and acicular pattern is observed in α phase. In the secondary electron image (electron micrograph) of FIG. 3, the pattern present in α phase can be clearly identified as κ phase. The thickness of κ phase was about 0.1 to about 0.2 μm.

The amount (number) of acicular κ phase in α phase was determined using the metallographic microscope. The micrographs of the five visual fields taken at a magnification of 500-fold or 1000-fold for the determination of the metallographic structure constituent phases (metallographic structure observation) were used. In an enlarged visual field printed out to the dimensions of about 70 mm in length and about 90 mm in width, the number of acicular κ phases was counted, and the average value of five visual fields was obtained. When the average number of acicular κ phase in the five visual fields is 20 or more and less than 70, it was determined that a quite acceptable number of acicular κ phase was present, and "Δ" was indicated. When the average number of acicular κ phase in the five visual fields was 70 or more, it was determined that a large amount of acicular κ phase was present, and "○" was indicated. When the average number of acicular κ phase in the five visual fields was 19 or less, it was determined that there was no acicular κ phase, or no sufficient amount of acicular κ phase, and "X" was indicated. The number of acicular κ1 phases that was unable to be observed using the images was not counted.

(Mechanical Properties)

(Tensile Strength)

Each of the test materials was processed into a No. 10 specimen according to JIS Z 2241, and the tensile strength thereof was measured. If the tensile strength of a hot extruded material or hot forged material prepared without cold working process is 550 N/mm$^2$ or higher, preferably 580 N/mm$^2$ or higher, more preferably 600 N/mm$^2$ or higher, and most preferably 625 N/mm$^2$ or higher, the material can be regarded as a free-cutting copper alloy of the highest quality, and with such a material, a reduction in the thickness and weight, or increase in allowable stress of members used in various fields can be realized.

As the alloy according to the embodiment is a copper alloy having a high tensile strength, the finished surface roughness of the tensile test specimen affects elongation and tensile strength. Therefore, the tensile test specimen was prepared so as to satisfy the following conditions.

(Condition of Finished Surface Roughness of Tensile Test Specimen)

The difference between the maximum value and the minimum value on the Z-axis is 2 μm or less in a cross-sectional curve corresponding to a standard length of 4 mm at any position between gauge marks on the tensile test specimen. The cross-sectional curve refers to a curve obtained by applying a low-pass filter of a cut-off value λs to a measured cross-sectional curve.

(High Temperature Creep)

A flanged specimen having a diameter of 10 mm according to JIS Z 2271 was prepared from each of the specimens. In a state where a load corresponding to 0.2% proof stress at room temperature was applied to the specimen, a creep strain after being kept for 100 hours at 150° C. was measured. If the creep strain is 0.3% or lower after the test piece is held at 150° C. for 100 hours in a state where 0.2% proof stress, that is, a load corresponding to 0.2% plastic deformation in elongation between gauge marks under room temperature, is applied, the specimen is regarded to have good high-temperature creep. In the case where this creep strain is 0.2% or lower, the alloy is regarded to be of the highest quality among copper alloys, and such material can be used as a highly reliable material in, for example, valves used under high temperature or in automobile components used in a place close to the engine room.

(Impact Resistance)

In an impact test, a U-notched specimen (notch depth: 2 mm, notch bottom radius: 1 mm) according to JIS Z 2242 was taken from each of the extruded rod materials, the forged materials, and alternate materials thereof, the cast materials, and the continuously cast rod materials. Using an impact blade having a radius of 2 mm, a Charpy impact test was performed to measure the impact value.

The relation between the impact value obtained from the V-notched specimen and the impact value obtained from the U-notched specimen is substantially as follows.

$$(V\text{-Notch Impact Value})=0.8\times(U\text{-Notch Impact Value})-3$$

(Machinability)

The machinability was evaluated as follows in a cutting test using a lathe.

Hot extruded rod materials having a diameter of 50 mm, 40 mm, or 25.6 mm, cold drawn materials having a diameter of 25 mm (24.5 mm), and castings were machined to prepare test materials having a diameter of 18 mm. A forged material was machined to prepare a test material having a diameter of 14.5 mm. A point nose straight tool, in particular, a tungsten carbide tool not equipped with a chip breaker was attached to the lathe. Using this lathe, the circumference of the test material having a diameter of 18 mm or a diameter of 14.5 mm was machined under dry conditions at rake angle: −6 degrees, nose radius: 0.4 mm, machining speed: 150 m/min, machining depth: 1.0 mm, and feed rate: 0.11 mm/rev.

A signal emitted from a dynamometer (AST tool dynamometer AST-TL1003, manufactured by Mihodenki Co., Ltd.) that is composed of three portions attached to the tool was electrically converted into a voltage signal, and this voltage signal was recorded on a recorder. Next, this signal was converted into cutting resistance (N). Accordingly, the machinability of the alloy was evaluated by measuring the cutting resistance, in particular, the principal component of cutting resistance showing the highest value during machining.

Concurrently, chips were collected, and the machinability was evaluated based on the chip shape. The most serious problem during actual machining is that chips become entangled with the tool or become bulky. Therefore, when all the chips that were generated had a chip shape with one winding or less, it was evaluated as "○" (good). When the chips had a chip shape with more than one winding and three windings or less, it was evaluated as "Δ" (fair). When a chip having a shape with more than three windings was included, it was evaluated as "X" (poor). This way, the evaluation was performed in three grades.

The cutting resistance depends on the strength of the material, for example, shear stress, tensile strength, or 0.2% proof stress, and as the strength of the material increases, the cutting resistance tends to increase. Cutting resistance that is higher than the cutting resistance of a free-cutting brass rod including 1% to 4% of Pb by about 10% to about 20%, the cutting resistance is sufficiently acceptable for practical use. In the embodiment, the cutting resistance was evaluated based on whether it had 130 N (boundary value). Specifically, when the cutting resistance was 130 N or lower, the machinability was evaluated as excellent (evaluation: ○). When the cutting resistance was higher than 130 N and 150 N or lower, the machinability was evaluated as "acceptable (Δ)". When the cutting resistance was higher than 150 N, the cutting resistance was evaluated as "unacceptable (X)". Incidentally, when Step No. F1 was performed on a 58 mass % Cu-42 mass % Zn alloy to prepare a sample and this sample was evaluated, the cutting resistance was 185 N.

(Hot Working Test)

The rod materials and castings having a diameter of 50 mm, 40 mm, 25.6 mm, or 25.0 mm were machined to prepare test materials having a diameter of 15 mm and a length of 25 mm. The test materials were held at 740° C. or 635° C. for 15 minutes. Next, the test materials were horizontally set and compressed to a thickness of 5 mm at a high temperature using an Amsler testing machine having a hot compression capacity of 10 ton and equipped with an electric furnace at a strain rate of 0.02/sec and a working ratio of 80%.

Hot workability was evaluated using a magnifying glass at a magnification of 10-fold, and when cracks having an opening of 0.2 mm or more were observed, it was regarded that cracks occurred. When cracking did not occur under two conditions of 740° C. and 635° C., it was evaluated as "○" (good). When cracking occurred at 740° C. but did not occur at 635° C., it was evaluated as "Δ" (fair). When cracking did not occur at 740° C. and occurred at 635° C., it was evaluated as "▲" (fair). When cracking occurred at both of the temperatures, 740° C. and 635° C., it was evaluated as "X" (poor).

When cracking did not occur under two conditions of 740° C. and 635° C., even if the material's temperature decreases to some extent during actual hot extrusion or hot forging, or even if the material comes into contact with a mold or a die even for a moment and the material's temperature decreases, there is no problem in practical use as long as hot extrusion or hot forging is performed at an appropriate temperature. When cracking occurs at either temperature of 740° C. or 635° C., although hot working is considered to be possible, its practical use is significantly restricted, and therefore, it is necessary to perform hot working in a more narrowly controlled temperature range. When cracking occurred at both temperatures of 740° C. and 635° C., it is determined to be unacceptable as that is a serious problem in practical use.

(Swaging (Bending) Workability)

In order to evaluate swaging (bending) workability, the outer surfaces of the rod material and the forged material were machined to reduce the outer diameter to 13 mm, and holes were drilled with a drill having a drill bit of 10 mm in diameter attached in the materials, which were then cut into a length of 10 mm. As a result, cylindrical samples having an outer diameter of 13 mm, a thickness of 1.5 mm, and a length of 10 mm were prepared. These samples were clamped with a vice and were flattened in an elliptical shape by human power to investigate whether or not cracking occurred.

The swaging ratio (ellipticity) of when cracking occurred was calculated based on the following expression.

$$(\text{Swaging Ratio})-(1-(\text{Length of Inner Short Side after Flattening})/(\text{Inner Diameter}))\times 100(\%)$$

$$(\text{Length (mm) of Inner Short Side after Flattening})-(\text{Length of Outer Short Side of Flattened Elliptical Shape})-(\text{Thickness})\times 2$$

$$(\text{Inner Diameter (mm)})=(\text{Outer Diameter of Cylinder})-(\text{Thickness})\times 2$$

Incidentally, when a load added to flatten a cylindrical material is removed, the material springs back to the original shape. However, the shape here refer to a permanently deformed shape.

Here, if the swaging ratio (bending ratio) when cracking occurred was 30% or higher, the swaging (bending) workability was evaluated as "○" (good). When the swaging ratio (bending ratio) was 15% or higher and lower than 30%, the swaging (bending) workability was evaluated as "Δ" (fair). When the swaging ratio (bending ratio) was lower than 15%, the swaging (bending) workability was evaluated as "X" (poor).

Incidentally, when a commercially available free-cutting brass rod (59% Cu-3% Pb-balance Zn) to which Pb was added was tested to examine its swaging workability, the swaging ratio was 9%. An alloy having excellent free-cutting ability has some kind of brittleness.

(Dezincification Corrosion Tests 1)

When the test material was an extruded material, the test material was embedded in a phenol resin material such that an exposed sample surface of the test material was perpendicular to the extrusion direction. When the test material was a cast material (cast rod), the test material was embedded in a phenol resin material such that an exposed sample surface of the test material was perpendicular to the longitudinal direction of the cast material. When the test material was a forged material, the test material was embedded in a phenol resin material such that an exposed sample surface of the test material was perpendicular to the flowing direction of forging.

The sample surface was polished with emery paper up to grit 1200, was ultrasonically cleaned in pure water, and then was dried with a blower. Next, each of the samples was dipped in a prepared dipping solution.

After the end of the test, the samples were embedded in a phenol resin material again such that the exposed surface is maintained to be perpendicular to the extrusion direction, the longitudinal direction, or the flowing direction of forging. Next, the sample was cut such that the cross-section of a corroded portion was the longest cut portion. Next, the sample was polished.

Using a metallographic microscope, corrosion depth was observed in 10 visual fields (arbitrarily selected 10 visual fields) of the microscope at a magnification of 500-fold. The deepest corrosion point was recorded as the maximum dezincification corrosion depth.

In the dezincification corrosion test, the following test solution was prepared as the dipping solution, and the above-described operation was performed.

The test solution was adjusted by adding a commercially available chemical agent to distilled water. Simulating highly corrosive tap water, 80 mg/L of chloride ions, 40 mg/L of sulfate ions, and 30 mg/L of nitrate ion were added. The alkalinity and hardness were adjusted to 30 mg/L and 60 mg/L, respectively, based on Japanese general tap water. In order to reduce pH to 6.5, carbon dioxide was added while adjusting the flow rate thereof. In order to saturate the dissolved oxygen concentration, oxygen gas was continuously added. The water temperature was adjusted to 25° C.±5° C. (20° C. to 30° C.). When this solution is used, it is presumed that this test is an about 50 times accelerated test performed in such a harsh corrosion environment. If the maximum corrosion depth is 50 μm or less, corrosion resistance is excellent. In the case excellent corrosion resistance is required, it is presumed that the maximum corrosion depth is preferably 35 μm or less and more preferably 25 pin or less. The Examples of the instant invention were evaluated based on these presumed values.

Incidentally, the sample was held in the test solution for 3 months, then was taken out from the aqueous solution, and the maximum value (maximum dezincification corrosion depth) of the dezincification corrosion depth was measured. The test solution was adjusted by adding a commercially available chemical agent to distilled water. Simulating highly corrosive tap water, 80 mg/L of chloride ions, 40 mg/L of sulfate ions, and 30 mg/L of nitrate ion were added. The alkalinity and hardness were adjusted to 30 mg/L and 60 mg/L, respectively, based on Japanese general tap water. In order to reduce pH to 6.5, carbon dioxide was added while adjusting the flow rate thereof. In order to saturate the dissolved oxygen concentration, oxygen gas was continuously added. The water temperature was adjusted to 25° C.±5° C. (20 C-30° C.). the sample was held in the test solution for 3 months, then was taken out from the aqueous solution, and the maximum value (maximum dezincification corrosion depth) of the dezincification corrosion depth was measured.

(Dezincification Corrosion Test 2: Dezincification Corrosion Test According to ISO 6509)

This test is adopted in many countries as a dezincification corrosion test method and is defined by JIS H 3250 of JIS Standards.

As in the case of the dezincification corrosion test, the test material was embedded in a phenol resin material. Each of the samples was dipped in an aqueous solution (12.7 g/L) of 1.0% cupric chloride dihydrate ($CuCl_2.2H_2O$) and was held under a temperature condition of 75° C. for 24 hours. Next, the sample was taken out from the aqueous solution.

The samples were embedded in a phenol resin material again such that the exposed surfaces were maintained to be perpendicular to the extrusion direction, the longitudinal direction, or the flowing direction of forging. Next, the samples were cut such that the longest possible cross-section of a corroded portion could be obtained. Next, the samples were polished.

Using a metallographic microscope, corrosion depth was observed in 10 visual fields of the microscope at a magnification of 100-fold or 500-fold. The deepest corrosion point was recorded as the maximum dezincification corrosion depth.

When the maximum corrosion depth in the test according to ISO 6509 is 200 μm or less, there was no problem for practical use regarding corrosion resistance. When particularly excellent corrosion resistance is required, it is presumed that the maximum corrosion depth is preferably 100 μm or less and more preferably 50 μm or less.

In this test, when the maximum corrosion depth was more than 200 μm, it was evaluated as "X" (poor). When the maximum corrosion depth was more than 50 μm and 200 μm or less, it was evaluated as "Δ" (fair). When the maximum corrosion depth was 50 μm or less, it was strictly evaluated as "○" (good). In the embodiment, a strict evaluation criterion was adopted because the alloy was assumed to be used in a harsh corrosion environment, and only when the evaluation was "○", it was determined that corrosion resistance was excellent.

The evaluation results are shown in Tables 17 to 55.

Tests No. T01 to T62, T71 to T114, and T121 to T169 are the results of experiments performed on the actual production line. In Tests No. T201 to T208, Sn and Fe were intentionally added to the molten alloy in the furnace on the actual production line. Tests No. T301 to T337 are the results of laboratory experiments. Tests No. T501 to T537 are the results of laboratory experiments performed on alloys corresponding to Comparative Examples.

Regarding the length of the long side of μ phase in the tables, the value "40" refers to 40 μm or more. In addition, regarding the length of the long side of γ phase in the tables, the value "150" refers to 150 μm or more.

TABLE 17

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T01 | S01 | AH1 | 32.0 | 1.6 | 0 | 0 | 98.4 | 100 | 1.6 | 39.6 | 50 | 0 | X |
| T02 | S01 | AH2 | 31.5 | 1.7 | 0 | 0 | 98.3 | 100 | 1.7 | 39.4 | 52 | 0 | X |
| T03 | S01 | A1 | 38.0 | 0.1 | 0 | 0 | 99.9 | 100 | 0.1 | 40.0 | 6 | 0 | ○ |
| T04 | S01 | A2 | 38.1 | 0 | 0 | 0 | 100 | 100 | 0 | 38.1 | 0 | 0 | ○ |
| T05 | S01 | A3 | 37.7 | 0.1 | 0 | 0 | 99.9 | 100 | 0.1 | 39.7 | 10 | 4 | ○ |
| T06 | S01 | A4 | 37.6 | 0 | 0 | 0.3 | 99.7 | 100 | 0.3 | 37.8 | 0 | 16 | ○ |
| T07 | S01 | AH3 | 35.3 | 0.1 | 0 | 1.7 | 98.2 | 100 | 1.8 | 38.1 | 20 | 28 | ○ |
| T08 | S01 | AH4 | 32.8 | 0 | 0 | 4.2 | 95.8 | 100 | 4.2 | 34.9 | 0 | 40 | ○ |
| T09 | S01 | A5 | 38.2 | 0.2 | 0 | 0 | 99.8 | 100 | 0.2 | 40.8 | 18 | 0 | ○ |
| T10 | S01 | A6 | 37.2 | 0.2 | 0 | 0 | 99.8 | 100 | 0.2 | 39.9 | 18 | 0 | ○ |
| T11 | S01 | AHS | 35.9 | 0.6 | 0 | 0 | 99.4 | 100 | 0.6 | 40.6 | 34 | 0 | X |
| T12 | S01 | AH6 | 34.2 | 0.7 | 0 | 0 | 99.3 | 100 | 0.7 | 39.2 | 40 | 0 | X |
| T13 | S01 | AH7 | 36.5 | 0.5 | 0 | 0 | 99.5 | 100 | 0.5 | 40.7 | 32 | 0 | X |
| T14 | S01 | A7 | 37.3 | 0.2 | 0 | 0 | 99.8 | 100 | 0.2 | 40.0 | 14 | 0 | Δ |
| T15 | S01 | A8 | 37.2 | 0.1 | 0 | 0 | 99.9 | 100 | 0.1 | 39.2 | 8 | 0 | ○ |
| T16 | S01 | AH8 | 34.6 | 0.1 | 0 | 2.0 | 97.9 | 100 | 2.1 | 37.6 | 14 | 30 | Δ |
| T17 | S01 | A9 | 37.5 | 0.1 | 0 | 0 | 99.9 | 100 | 0.1 | 39.5 | 10 | 0 | ○ |
| T18 | S01 | AH9 | 36.3 | 0.5 | 0 | 0 | 99.5 | 100 | 0.5 | 40.5 | 30 | 0 | Δ |
| T19 | S01 | AH10 | 37.2 | 0.5 | 0 | 0 | 99.5 | 100 | 0.5 | 41.4 | 28 | 0 | Δ |
| T20 | S01 | AH11 | 35.6 | 0.6 | 0 | 0 | 99.4 | 100 | 0.6 | 40.3 | 32 | 0 | X |
| T21 | S01 | A10 | 37.6 | 0.1 | 0 | 0 | 99.9 | 100 | 0.1 | 39.6 | 8 | 0 | ○ |

TABLE 18

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T01 | S01 | AH1 | 118 | ○ | Δ | ○ | 82 | ○ |
| T02 | S01 | AH2 | 119 | ○ | X | — | 84 | — |
| T03 | S01 | A1 | 120 | ○ | ○ | — | 18 | ○ |
| T04 | S01 | A2 | 120 | ○ | — | — | 16 | — |
| T05 | S01 | A3 | 121 | ○ | ○ | — | 30 | — |
| T06 | S01 | A4 | 121 | ○ | ○ | — | 36 | — |
| T07 | S01 | AH3 | 122 | ○ | Δ | — | 60 | ○ |
| T08 | S01 | AH4 | 125 | ○ | X | — | 66 | ○ |
| T09 | S01 | A5 | 121 | ○ | ○ | — | 36 | ○ |
| T10 | S01 | A6 | 120 | ○ | ○ | — | 34 | — |
| T11 | S01 | AH5 | 127 | Δ | Δ | — | 58 | — |
| T12 | S01 | AH6 | 123 | ○ | X | — | 62 | ○ |
| T13 | S01 | AH7 | 122 | Δ | ○ | — | 58 | — |
| T14 | S01 | A7 | 122 | ○ | ○ | — | 34 | — |
| T15 | S01 | A8 | 121 | ○ | ○ | — | 26 | — |
| T16 | S01 | AH8 | 122 | ○ | X | — | 62 | — |
| T17 | S01 | A9 | 122 | ○ | ○ | — | 34 | — |
| T18 | S01 | AH9 | 122 | ○ | Δ | — | 58 | — |
| T19 | S01 | AH10 | 121 | ○ | ○ | — | 56 | ○ |
| T20 | S01 | AH11 | 125 | Δ | ○ | — | 60 | — |
| T21 | S01 | A10 | 123 | ○ | ○ | — | 20 | — |

TABLE 19

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T01 | S01 | AH1 | 567 | 28.8 | 26.3 | 643 | 670 | 0.34 |
| T02 | S01 | AH2 | 599 | 24.0 | 23.8 | 666 | 690 | 0.35 |
| T03 | S01 | A1 | 633 | 29.0 | 29.0 | 718 | 747 | 0.12 |
| T04 | S01 | A2 | 629 | 29.4 | 28.5 | 716 | 744 | — |
| T05 | S01 | A3 | 631 | 28.8 | 28.1 | 717 | 745 | 0.13 |
| T06 | S01 | A4 | 620 | 27.4 | 27.1 | 700 | 727 | 0.15 |

TABLE 19-continued

| Test No. | Alloy No. | Step No. | Tensile Strength (N/mm$^2$) | Elongation (%) | Impact Value (J/cm$^2$) | Strength Balance Index f8 | Strength Balance Index f9 | 150° C. Creep Strain (%) |
|---|---|---|---|---|---|---|---|---|
| T07 | S01 | AH3 | 599 | 25.6 | 24.7 | 672 | 696 | 0.35 |
| T08 | S01 | AH4 | 584 | 21.0 | 20.8 | 642 | 663 | 0.51 |
| T09 | S01 | A5 | 646 | 25.6 | 26.4 | 724 | 750 | 0.13 |
| T10 | S01 | A6 | 616 | 25.4 | 27.8 | 689 | 717 | 0.16 |
| T11 | S01 | AH5 | 564 | 26.8 | 24.1 | 636 | 660 | — |
| T12 | S01 | AH6 | 609 | 21.8 | 22.0 | 672 | 694 | 0.25 |
| T13 | S01 | AH7 | 595 | 24.4 | 25.6 | 664 | 690 | 0.24 |
| T14 | S01 | A7 | 611 | 27.0 | 27.5 | 688 | 716 | 0.16 |
| T15 | S01 | A8 | 616 | 28.2 | 27.9 | 698 | 726 | 0.12 |
| T16 | S01 | AH8 | 594 | 23.0 | 24.0 | 659 | 683 | 0.34 |
| T17 | S01 | A9 | 627 | 27.4 | 29.0 | 707 | 736 | 0.12 |
| T18 | S01 | AH9 | 608 | 22.8 | 24.3 | 674 | 698 | 0.24 |
| T19 | S01 | AH10 | 604 | 24.6 | 25.2 | 675 | 700 | 0.26 |
| T20 | S01 | AH11 | 589 | 25.8 | 27.4 | 660 | 688 | 0.25 |
| T21 | S01 | A10 | 659 | 25.8 | 24.6 | 739 | 763 | 0.12 |

TABLE 20

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T22 | S01 | A11 | 38.0 | 0 | 0 | 0 | 100 | 100 | 0 | 38.0 | 0 | 0 | ○ |
| T23 | S01 | A12 | 37.7 | 0 | 0 | 0 | 100 | 100 | 0 | 37.7 | 0 | 0 | ○ |
| T24 | S01 | A13 | 35.1 | 0.3 | 0 | 0 | 99.7 | 100 | 0.3 | 38.4 | 22 | 0 | Δ |
| T25 | S01 | A14 | 36.3 | 0.2 | 0 | 0 | 99.8 | 100 | 0.2 | 39.0 | 18 | 0 | ○ |
| T26 | S01 | AH12 | 33.8 | 1.2 | 0 | 0 | 98.8 | 100 | 1.2 | 40.5 | 44 | 0 | X |
| T27 | S01 | AH13 | 35.2 | 0.2 | 0 | 2.4 | 97.4 | 100 | 2.6 | 39.1 | 22 | 36 | Δ |
| T28 | S01 | B1 | 38.1 | 0.1 | 0 | 0 | 99.9 | 100 | 0.1 | 40.1 | 10 | 2 | ○ |
| T29 | S01 | B2 | 38.0 | 0 | 0 | 0 | 100 | 100 | 0 | 38.0 | 0 | 2 | ○ |
| T30 | S01 | B3 | 37.8 | 0.1 | 0 | 0 | 99.9 | 100 | 0.1 | 39.8 | 10 | 2 | ○ |
| T31 | S01 | BH1 | — | — | — | — | — | — | — | — | — | — | — |
| T32 | S01 | BH2 | 34.2 | 0 | 0 | 2.6 | 97.4 | 100 | 2.6 | 35.5 | 0 | 38 | ○ |
| T33 | S01 | BH3 | 34.5 | 0.1 | 0 | 2.9 | 97.0 | 100 | 3.0 | 37.9 | 10 | 40 | ○ |
| T34 | S01 | C0 | 32.3 | 1.6 | 0 | 0 | 98.4 | 100 | 1.6 | 39.9 | 52 | 0 | X |
| T35 | S01 | C1 | 37.5 | 0.1 | 0 | 0 | 99.9 | 100 | 0.1 | 39.5 | 10 | 0 | ○ |
| T36 | S01 | DH1 | 32.9 | 1.4 | 0 | 0 | 98.6 | 100 | 1.4 | 40.1 | 44 | 0 | X |
| T37 | S01 | D1 | 37.8 | 0 | 0 | 0 | 100 | 100 | 0 | 37.8 | 0 | 0 | ○ |
| T38 | S01 | D2 | 37.6 | 0 | 0 | 0 | 100 | 100 | 0 | 37.6 | 0 | 2 | ○ |
| T39 | S01 | D3 | 37.4 | 0 | 0 | 0.3 | 99.7 | 100 | 0.3 | 37.6 | 0 | 12 | ○ |
| T40 | S01 | DH2 | 36.6 | 0 | 0 | 1.4 | 98.6 | 100 | 1.4 | 37.3 | 0 | 26 | ○ |
| T41 | S01 | D4 | 38.1 | 0.1 | 0 | 0 | 99.9 | 100 | 0.1 | 40.1 | 14 | 0 | ○ |
| T42 | S01 | D5 | 37.7 | 0.2 | 0 | 0 | 99.8 | 100 | 0.2 | 40.4 | 20 | 0 | Δ |

TABLE 21

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T22 | S01 | A11 | 125 | ○ | ○ | — | 18 | — |
| T23 | S01 | A12 | 123 | ○ | ○ | — | 14 | — |
| T24 | S01 | A13 | 120 | ○ | ○ | — | 42 | — |
| T25 | S01 | A14 | 121 | ○ | ○ | — | 40 | — |
| T26 | S01 | AH12 | 119 | ○ | Δ | ○ | 72 | ○ |
| T27 | S01 | AH13 | 120 | ○ | X | — | 68 | — |
| T28 | S01 | B1 | 122 | ○ | ○ | — | 28 | — |
| T29 | S01 | B2 | 124 | ○ | ○ | — | 20 | — |
| T30 | S01 | B3 | 123 | ○ | ○ | — | 26 | — |
| T31 | S01 | BH1 | — | — | — | — | — | — |
| T32 | S01 | BH2 | 123 | ○ | Δ | — | 62 | — |
| T33 | S01 | BH3 | 125 | ○ | X | — | 66 | ○ |
| T34 | S01 | C0 | 118 | ○ | — | ○ | 90 | ○ |
| T35 | S01 | C1 | 121 | ○ | ○ | — | 28 | — |
| T36 | S01 | DH1 | 119 | ○ | — | — | — | — |
| T37 | S01 | D1 | 121 | ○ | ○ | — | 18 | ○ |

TABLE 21-continued

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T38 | S01 | D2 | 121 | ○ | ○ | — | 20 | — |
| T39 | S01 | D3 | 122 | ○ | ○ | — | 30 | — |
| T40 | S01 | DH2 | 122 | ○ | Δ | — | 52 | — |
| T41 | S01 | D4 | 121 | ○ | ○ | — | 38 | — |
| T42 | S01 | D5 | 121 | ○ | ○ | — | 44 | — |

TABLE 22

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T22 | S01 | A11 | 690 | 21.2 | 21.9 | 759 | 781 | 0.13 |
| T23 | S01 | A12 | 640 | 27.0 | 27.2 | 721 | 748 | 0.12 |
| T24 | S01 | A13 | 582 | 34.0 | 28.6 | 673 | 702 | 0.23 |
| T25 | S01 | A14 | 591 | 35.6 | 29.3 | 689 | 718 | 0.22 |
| T26 | S01 | AH12 | 576 | 31.0 | 27.2 | 659 | 686 | 0.33 |
| T27 | S01 | AH13 | 581 | 29.4 | 24.1 | 661 | 685 | 0.43 |
| T28 | S01 | B1 | 662 | 26.2 | 24.5 | 743 | 768 | 0.17 |
| T29 | S01 | B2 | 661 | 25.8 | 24.8 | 741 | 766 | — |
| T30 | S01 | B3 | 663 | 26.0 | 24.6 | 745 | 769 | 0.16 |
| T31 | S01 | BH1 | — | — | — | — | — | — |
| T32 | S01 | BH2 | 624 | 20.6 | 21.2 | 685 | 706 | 0.40 |
| T33 | S01 | BH3 | 621 | 19.4 | 20.2 | 678 | 699 | — |
| T34 | S01 | C0 | 561 | 28.6 | 26.8 | 636 | 663 | — |
| T35 | S01 | C1 | 595 | 35.0 | 31.7 | 691 | 723 | 0.12 |
| T36 | S01 | DH1 | 564 | 29.2 | 27.2 | 642 | 669 | 0.33 |
| T37 | S01 | D1 | 606 | 36.2 | 32.1 | 707 | 739 | 0.12 |
| T38 | S01 | D2 | 604 | 35.6 | 32.0 | 704 | 736 | — |
| T39 | S01 | D3 | 595 | 34.8 | 31.0 | 690 | 721 | 0.16 |
| T40 | S01 | DH2 | 584 | 31.4 | 27.2 | 669 | 696 | 0.33 |
| T41 | S01 | D4 | 620 | 31.6 | 30.4 | 711 | 741 | 0.14 |
| T42 | S01 | D5 | 593 | 33.2 | 30.8 | 684 | 715 | 0.16 |

TABLE 23

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T43 | S01 | DH3 | 35.6 | 0.1 | 0 | 2 | 97.9 | 100 | 2.1 | 38.6 | 10 | 28 | Δ |
| T44 | S01 | DH4 | 36.2 | 0.5 | 0 | 0 | 99.5 | 100 | 0.5 | 40.4 | 30 | 0 | Δ |
| T45 | S01 | D6 | 34.7 | 0.3 | 0 | 0 | 99.7 | 100 | 0.3 | 38.0 | 22 | 0 | Δ |
| T46 | S01 | DH5 | 33.8 | 1.1 | 0 | 0 | 98.9 | 100 | 1.1 | 40.2 | 44 | 0 | X |
| T47 | S01 | D7 | 37.5 | 0.1 | 0 | 0 | 99.9 | 100 | 0.1 | 39.5 | 10 | 0 | ○ |
| T48 | S01 | DH6 | 36.2 | 0.6 | 0 | 0 | 99.4 | 100 | 0.6 | 40.9 | 34 | 0 | Δ |
| T49 | S01 | EH1 | 32.8 | 1.6 | 0 | 0 | 98.4 | 100 | 1.6 | 40.4 | 54 | 0 | X |
| T50 | S01 | E1 | 37.7 | 0.2 | 0 | 0 | 99.8 | 100 | 0.2 | 40.4 | 12 | 0 | ○ |
| T51 | S01 | FH1 | 33.0 | 1.5 | 0 | 0 | 98.5 | 100 | 1.5 | 40.4 | 50 | 0 | X |
| T52 | S01 | F1 | 38.1 | 0 | 0 | 0 | 100 | 100 | 0 | 38.1 | 0 | 0 | ○ |
| T53 | S01 | F2 | 38.2 | 0.1 | 0 | 0 | 99.9 | 100 | 0.1 | 40.2 | 6 | 0 | ○ |
| T54 | S01 | FH2 | 36.0 | 0.2 | 0 | 1.9 | 97.9 | 100 | 2.1 | 39.6 | 18 | 30 | Δ |
| T55 | S01 | F3 | 38.0 | 0.1 | 0 | 0 | 99.9 | 100 | 0.1 | 40.0 | 10 | 0 | ○ |
| T56 | S01 | F4 | 38.2 | 0.1 | 0 | 0 | 99.9 | 100 | 0.1 | 40.2 | 14 | 0 | ○ |
| T57 | S01 | F5 | 38.0 | 0.2 | 0 | 0 | 99.8 | 100 | 0.2 | 40.7 | 16 | 0 | ○ |
| T58 | S01 | PH1 | 33.0 | 1.9 | 0 | 0 | 98.1 | 100 | 1.9 | 41.3 | 60 | 0 | X |
| T59 | S01 | P1 | 36.9 | 0.3 | 0 | 0 | 99.7 | 100 | 0.3 | 40.2 | 22 | 0 | ○ |
| T60 | S01 | P2 | 38.5 | 0.1 | 0 | 0 | 99.9 | 100 | 0.1 | 40.5 | 14 | 0 | ○ |
| T61 | S01 | P3 | 37.9 | 0.2 | 0 | 0 | 99.8 | 100 | 0.2 | 40.6 | 20 | 0 | ○ |
| T62 | S01 | R1 | 38.2 | 0 | 0 | 0 | 100 | 100 | 0 | 38.2 | 0 | 0 | ○ |

TABLE 24

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T43 | S01 | DH3 | 123 | ○ | Δ | — | 58 | ○ |
| T44 | S01 | DH4 | 121 | ○ | ○ | — | 60 | — |
| T45 | S01 | D6 | 121 | ○ | ○ | — | 48 | — |
| T46 | S01 | DH5 | 120 | ○ | Δ | — | 78 | ○ |
| T47 | S01 | D7 | 120 | ○ | ○ | — | 24 | — |
| T48 | S01 | DH6 | 122 | ○ | Δ | — | 60 | — |
| T49 | S01 | EH1 | 117 | ○ | X | ○ | 88 | — |
| T50 | S01 | E1 | 119 | ○ | ○ | — | 30 | ○ |
| T51 | S01 | FH1 | 118 | ○ | Δ | — | 82 | ○ |
| T52 | S01 | Fl | 120 | ○ | ○ | — | 16 | — |
| T53 | S01 | F2 | 121 | ○ | ○ | — | 24 | — |
| T54 | S01 | FH2 | 122 | ○ | Δ | — | 70 | — |
| T55 | S01 | F3 | 120 | ○ | — | — | 26 | — |
| T56 | S01 | F4 | 120 | ○ | ○ | — | 36 | — |
| T57 | S01 | F5 | 118 | ○ | ○ | — | 34 | ○ |
| T58 | S01 | PH1 | 115 | ○ | — | ○ | 98 | ○ |
| T59 | S01 | P1 | 119 | ○ | — | — | 38 | ○ |
| T60 | S01 | P2 | 120 | ○ | — | — | 30 | — |
| T61 | S01 | P3 | 119 | ○ | — | — | 44 | ○ |
| T62 | S01 | R1 | — | — | — | — | 18 | ○ |

TABLE 25

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T43 | S01 | DH3 | 582 | 29.6 | 27.4 | 662 | 689 | 0.36 |
| T44 | S01 | DH4 | 586 | 30.6 | 29.1 | 669 | 699 | 0.24 |
| T45 | S01 | D6 | 591 | 33.6 | 30.4 | 684 | 714 | — |
| T46 | S01 | DH5 | 575 | 30.2 | 29.0 | 656 | 685 | 0.28 |
| T47 | S01 | D7 | 600 | 34.2 | 32.5 | 696 | 728 | 0.15 |
| T48 | S01 | DH6 | 601 | 26.6 | 28.4 | 676 | 704 | 0.25 |
| T49 | S01 | EH1 | 557 | 28.6 | 27.7 | 632 | 660 | 0.34 |
| T50 | S01 | E1 | 593 | 35.0 | 31.4 | 689 | 720 | 0.13 |
| T51 | S01 | FH1 | 563 | 29.2 | 26.8 | 639 | 666 | 0.36 |
| T52 | S01 | F1 | 602 | 36.8 | 32.4 | 705 | 737 | 0.12 |
| T53 | S01 | F2 | 618 | 33.0 | 30.8 | 713 | 743 | — |
| T54 | S01 | FH2 | 582 | 29.8 | 26.0 | 663 | 689 | 0.37 |
| T55 | S01 | F3 | 598 | 35.0 | 30.8 | 694 | 725 | — |
| T56 | S01 | F4 | 598 | 34.8 | 31.4 | 694 | 725 | 0.14 |
| T57 | S01 | F5 | 586 | 33.6 | 29.7 | 678 | 708 | 0.16 |
| T58 | S01 | PH1 | — | — | 28.2 | — | — | — |
| T59 | S01 | P1 | — | — | 33.6 | — | — | — |
| T60 | S01 | P2 | 595 | 33.0 | 29.6 | 686 | 716 | 0.15 |
| T61 | S01 | P3 | 588 | 33.8 | 27.1 | 680 | 707 | 0.16 |
| T62 | S01 | R1 | — | — | — | — | — | — |

TABLE 26

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase μm) | Presence of Acicular κ Phase |
|---|---|---|---|---|---|---|---|---|---|---|---|---|---|
| T71 | S02 | AH1 | 44.6 | 0.3 | 0 | 0 | 99.7 | 100 | 0.3 | 48.0 | 24 | 0 | × |
| T72 | S02 | AH2 | 44.3 | 0.4 | 0 | 0 | 99.6 | 100 | 0.4 | 48.2 | 30 | 0 | × |
| T73 | S02 | A1 | 52.8 | 0 | 0 | 0 | 100 | 100 | 0 | 52.8 | 0 | 0 | ○ |
| T74 | S02 | A2 | 52.0 | 0 | 0 | 0 | 100 | 100 | 0 | 52.0 | 0 | 0 | ○ |
| T75 | S02 | A3 | 52.4 | 0 | 0 | 0 | 100 | 100 | 0 | 52.4 | 0 | 3 | ○ |
| T76 | S02 | A4 | 51.9 | 0 | 0 | 0.3 | 99.7 | 100 | 0.3 | 52.0 | 0 | 14 | ○ |
| T77 | S02 | AH3 | 50.8 | 0 | 0 | 2.0 | 98.0 | 100 | 2.0 | 51.8 | 0 | 32 | ○ |
| T78 | S02 | AH4 | 46.4 | 0 | 0 | 4.7 | 95.3 | 100 | 4.7 | 48.7 | 0 | 40 | ○ |
| T79 | S02 | A5 | 52.4 | 0.2 | 0 | 0 | 99.8 | 100 | 0.2 | 55.1 | 18 | 0 | ○ |
| T80 | S02 | A6 | 51.8 | 0 | 0 | 0 | 100 | 100 | 0 | 51.8 | 0 | 0 | ○ |
| T81 | S02 | AH5 | 50.8 | 0.1 | 0 | 0 | 99.9 | 100 | 0.1 | 53.0 | 28 | 0 | × |
| T82 | S02 | AH6 | 49.1 | 0.2 | 0 | 0 | 99.8 | 100 | 0.2 | 52.0 | 28 | 0 | × |

TABLE 26-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase μm) | Presence of Acicular κ Phase |
|---|---|---|---|---|---|---|---|---|---|---|---|---|---|
| T83 | S02 | A7 | 51.0 | 0.1 | 0 | 0 | 99.9 | 100 | 0.1 | 52.9 | 8 | 0 | ○ |
| T84 | S02 | A8 | 51.8 | 0 | 0 | 0 | 100 | 100 | 0 | 51.8 | 0 | 0 | ○ |
| T85 | S02 | AH8 | 49.4 | 0 | 0 | 2.2 | 97.8 | 100 | 2.2 | 50.5 | 0 | 30 | ○ |
| T86 | S02 | A9 | 51.8 | 0 | 0 | 0 | 100 | 100 | 0 | 51.8 | 0 | 0 | ○ |
| T87 | S02 | AH9 | 49.8 | 0.2 | 0 | 0 | 99.8 | 100 | 0.2 | 52.7 | 24 | 0 | ○ |
| T88 | S02 | AH10 | 51.2 | 0.2 | 0 | 0 | 99.8 | 100 | 0.2 | 54.1 | 20 | 0 | ○ |
| T89 | S02 | AH11 | 49.3 | 0.2 | 0 | 0 | 99.8 | 100 | 0.2 | 52.2 | 20 | 0 | Δ |
| T90 | S02 | A10 | 52.2 | 0 | 0 | 0 | 100 | 100 | 0 | 52.2 | 0 | 0 | ○ |
| T91 | S02 | A12 | 51.8 | 0 | 0 | 0 | 100 | 100 | 0 | 51.8 | 0 | 0 | ○ |
| T92 | S02 | B2 | 51.9 | 0 | 0 | 0 | 100 | 100 | 0 | 51.9 | 0 | 2 | ○ |

TABLE 27

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T71 | S02 | AH1 | 114 | ○ | Δ | ○ | — | ○ |
| T72 | S02 | AH2 | 116 | ○ | × | — | 50 | — |
| T73 | S02 | A1 | 117 | ○ | ○ | — | 18 | — |
| T74 | S02 | A2 | 116 | ○ | — | — | 22 | — |
| T75 | S02 | A3 | 116 | ○ | ○ | — | 24 | — |
| T76 | S02 | A4 | 115 | ○ | ○ | — | 36 | — |
| T77 | S02 | AH3 | 116 | ○ | × | — | — | — |
| T78 | S02 | AH4 | 118 | ○ | × | — | 88 | — |
| T79 | S02 | A5 | 116 | ○ | Δ | — | 36 | — |
| T80 | S02 | A6 | 115 | ○ | ○ | — | 24 | — |
| T81 | S02 | AH5 | 122 | Δ | Δ | — | — | — |
| T82 | S02 | AH6 | 119 | ○ | × | — | 52 | ○ |
| T83 | S02 | A7 | 115 | ○ | ○ | — | 30 | — |
| T84 | S02 | A8 | 116 | ○ | ○ | — | 22 | — |
| T85 | S02 | AH8 | 117 | ○ | × | — | 64 | — |
| T86 | S02 | A9 | 116 | ○ | ○ | — | 28 | — |
| T87 | S02 | AH9 | 115 | ○ | × | — | — | — |
| T88 | S02 | AH10 | 114 | ○ | Δ | — | — | ○ |
| T89 | S02 | AH11 | 120 | ○ | ○ | — | — | — |
| T90 | S02 | A10 | 117 | ○ | ○ | — | — | — |
| T91 | S02 | A12 | 116 | ○ | ○ | — | — | — |
| T92 | S02 | B2 | 115 | ○ | ○ | — | 28 | — |

TABLE 28

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T71 | S02 | AH1 | 590 | 26.8 | 20.2 | 664 | 685 | 0.21 |
| T72 | S02 | AH2 | 628 | 22.0 | 17.7 | 693 | 711 | — |
| T73 | S02 | A1 | 652 | 22.8 | 19.0 | 722 | 741 | 0.11 |
| T74 | S02 | A2 | 650 | 22.6 | 18.9 | 719 | 738 | — |
| T75 | S02 | A3 | 653 | 22.2 | 18.5 | 722 | 740 | 0.13 |
| T76 | S02 | A4 | 640 | 21.2 | 17.8 | 705 | 723 | 0.14 |
| T77 | S02 | AH3 | 618 | 19.4 | 16.1 | 675 | 691 | — |
| T78 | S02 | AH4 | 600 | 15.4 | 13.9 | 645 | 659 | — |
| T79 | S02 | A5 | 667 | 18.8 | 17.4 | 727 | 744 | 0.11 |
| T80 | S02 | A6 | 637 | 19.4 | 18.8 | 696 | 715 | — |
| T81 | S02 | AHS | 593 | 22.2 | 16.8 | 655 | 672 | 0.17 |
| T82 | S02 | AH6 | 632 | 17.6 | 16.6 | 686 | 702 | 0.19 |
| T83 | S02 | A7 | 631 | 20.0 | 18.6 | 692 | 710 | 0.14 |
| T84 | S02 | A8 | 637 | 21.8 | 18.7 | 703 | 722 | 0.13 |
| T85 | S02 | AH8 | 613 | 16.4 | 15.8 | 662 | 678 | 0.34 |
| T86 | S02 | A9 | 648 | 20.8 | 19.3 | 712 | 731 | 0.11 |
| T87 | S02 | AH9 | 631 | 17.6 | 17.3 | 684 | 702 | — |
| T88 | S02 | AH10 | 626 | 19.6 | 17.3 | 685 | 702 | — |
| T89 | S02 | AH11 | 615 | 20.2 | 18.8 | 675 | 694 | — |
| T90 | S02 | A10 | 681 | 19.8 | 17.1 | 745 | 762 | 0.12 |

TABLE 28-continued

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T91 | S02 | A12 | 661 | 20.2 | 18.7 | 725 | 743 | — |
| T92 | S02 | B2 | 682 | 19.2 | 17.3 | 745 | 762 | 0.14 |

TABLE 29

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T93 | S02 | BH2 | 48.9 | 0 | 0 | 2.6 | 97.4 | 100 | 2.6 | 50.2 | 0 | 38 | ○ |
| T94 | S02 | C0 | 44.6 | 0.4 | 0 | 0 | 99.6 | 100 | 0.4 | 48.5 | 26 | 0 | × |
| T95 | S02 | C1 | 51.9 | 0 | 0 | 0 | 100 | 100 | 0 | 51.9 | 0 | 0 | ○ |
| T96 | S02 | DH1 | 45.2 | 0.3 | 0 | 0 | 99.7 | 100 | 0.3 | 48.5 | 20 | 0 | × |
| T97 | S02 | D1 | 52.2 | 0 | 0 | 0 | 100 | 100 | 0 | 52.2 | 0 | 0 | ○ |
| T98 | S02 | D2 | 52.0 | 0 | 0 | 0 | 100 | 100 | 0 | 52.0 | 0 | 4 | ○ |
| T99 | S02 | D3 | 51.5 | 0 | 0 | 0.3 | 99.7 | 100 | 0.3 | 51.6 | 0 | 10 | ○ |
| T100 | S02 | DH2 | 50.8 | 0 | 0 | 1.5 | 98.5 | 100 | 1.5 | 51.5 | 0 | 24 | ○ |
| T101 | S02 | D4 | 52.6 | 0 | 0 | 0 | 100 | 100 | 0 | 52.6 | 0 | 0 | ○ |
| T102 | S02 | D5 | 51.8 | 0 | 0 | 0 | 100 | 100 | 0 | 51.8 | 0 | 0 | ○ |
| T103 | S02 | DH3 | 49.7 | 0 | 0 | 2 | 98.0 | 100 | 2.0 | 50.7 | 0 | 28 | ○ |
| T104 | S02 | DH4 | 49.3 | 0.2 | 0 | 0 | 99.8 | 100 | 0.2 | 52.2 | 20 | 0 | ○ |
| T105 | S02 | D6 | 48.5 | 0.1 | 0 | 0 | 99.9 | 100 | 0.1 | 50.7 | 12 | 0 | Δ |
| T106 | S02 | DH5 | 46.6 | 0.2 | 0 | 0 | 99.8 | 100 | 0.2 | 49.3 | 26 | 0 | × |
| T107 | S02 | D7 | 51.4 | 0 | 0 | 0 | 100 | 100 | 0 | 51.4 | 0 | 0 | ○ |
| T108 | S02 | DH6 | 47.8 | 0.3 | 0 | 0 | 99.7 | 100 | 0.3 | 51.1 | 26 | 0 | ○ |
| T109 | S02 | EH1 | 45.7 | 0.5 | 0 | 0 | 99.5 | 100 | 0.5 | 50.0 | 34 | 0 | × |
| T110 | S02 | E1 | 52.0 | 0 | 0 | 0 | 100 | 100 | 0 | 52.0 | 0 | 0 | ○ |
| T111 | S02 | FH1 | 46.0 | 0.3 | 0 | 0 | 99.7 | 100 | 0.3 | 49.3 | 22 | 0 | × |
| T112 | S02 | F1 | 52.4 | 0 | 0 | 0 | 100 | 100 | 0 | 52.4 | 0 | 0 | ○ |
| T113 | S02 | F2 | 52.3 | 0 | 0 | 0 | 100 | 100 | 0 | 52.3 | 0 | 0 | ○ |
| T114 | S02 | FH2 | 48.9 | 0 | 0 | 1.6 | 98.4 | 100 | 1.6 | 49.7 | 0 | 28 | ○ |

TABLE 30

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T93 | S02 | BH2 | 118 | ○ | × | — | 72 | — |
| T94 | S02 | C0 | 113 | ○ | Δ | ○ | — | ○ |
| T95 | S02 | C1 | 114 | ○ | ○ | — | — | — |
| T96 | S02 | DH1 | 114 | ○ | Δ | — | 54 | ○ |
| T97 | S02 | D1 | 115 | ○ | ○ | — | 18 | — |
| T98 | S02 | D2 | 115 | ○ | ○ | — | 28 | — |
| T99 | S02 | D3 | 114 | ○ | ○ | — | 34 | — |
| T100 | S02 | DH2 | 114 | ○ | Δ | — | 54 | — |
| T101 | S02 | D4 | 115 | ○ | ○ | — | 32 | — |
| T102 | S02 | D5 | 114 | ○ | ○ | — | 36 | — |
| T103 | S02 | DH3 | 116 | ○ | × | — | 58 | ○ |
| T104 | S02 | DH4 | 117 | ○ | Δ | — | 50 | — |
| T105 | S02 | D6 | 117 | ○ | ○ | — | 40 | — |
| T106 | S02 | DH5 | 114 | ○ | Δ | — | 54 | — |
| T107 | S02 | D7 | 115 | ○ | ○ | — | 22 | — |
| T108 | S02 | DH6 | 116 | ○ | × | — | 54 | — |
| T109 | S02 | EH1 | 113 | ○ | × | ○ | 74 | — |
| nT110 | S02 | E1 | 114 | ○ | ○ | — | 24 | — |
| T111 | S02 | FH1 | 114 | ○ | Δ | — | 54 | — |
| T112 | S02 | F1 | 114 | ○ | ○ | — | 18 | — |
| T113 | S02 | F2 | 115 | ○ | ○ | — | 22 | — |
| T114 | S02 | FH2 | 114 | ○ | Δ | — | 56 | — |

TABLE 31

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T93 | S02 | BH2 | 644 | 13.0 | 14.5 | 685 | 699 | 0.38 |
| T94 | S02 | C0 | 588 | 26.4 | 20.8 | 661 | 682 | 0.18 |
| T95 | S02 | C1 | 619 | 27.8 | 21.5 | 700 | 721 | — |
| T96 | S02 | DH1 | 593 | 26.6 | 20.5 | 667 | 688 | 0.18 |
| T97 | S02 | D1 | 629 | 28.8 | 21.4 | 714 | 735 | 0.11 |
| T98 | S02 | D2 | 630 | 28.2 | 20.5 | 713 | 733 | — |
| T99 | S02 | D3 | 617 | 27.0 | 20.1 | 695 | 715 | 0.13 |
| T100 | S02 | DH2 | 603 | 23.4 | 17.1 | 670 | 687 | 0.26 |
| T101 | S02 | D4 | 647 | 25.2 | 19.8 | 724 | 744 | 0.11 |
| T102 | S02 | D5 | 617 | 26.0 | 20.5 | 693 | 713 | — |
| T103 | S02 | DH3 | 602 | 22.4 | 17.8 | 666 | 684 | 0.33 |
| T104 | S02 | DH4 | 608 | 24.4 | 19.5 | 678 | 697 | 0.20 |

TABLE 31-continued

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T105 | S02 | D6 | 612 | 26.0 | 19.6 | 687 | 707 | — |
| T106 | S02 | DH5 | 595 | 26.8 | 21.5 | 669 | 691 | — |
| T107 | S02 | D7 | 626 | 26.6 | 20.4 | 704 | 725 | — |
| T108 | S02 | DH6 | 616 | 21.0 | 18.1 | 678 | 696 | — |
| T109 | S02 | EH1 | 586 | 26.6 | 20.8 | 659 | 680 | 0.19 |
| T110 | S02 | E1 | 618 | 28.4 | 21.1 | 700 | 721 | 0.11 |
| T111 | S02 | FH1 | 592 | 27.0 | 20.3 | 667 | 687 | 0.18 |
| T112 | S02 | F1 | 625 | 28.6 | 20.9 | 709 | 730 | 0.11 |
| T113 | S02 | F2 | 642 | 25.6 | 19.4 | 719 | 739 | — |
| T114 | S02 | FH2 | 604 | 23.0 | 17.8 | 670 | 688 | 0.28 |

TABLE 32

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T121 | S03 | AH1 | 40.4 | 1.2 | 0 | 0 | 98.8 | 100 | 1.2 | 46.9 | 44 | 0 | × |
| T122 | S03 | AH2 | 40.0 | 1.4 | 0 | 0 | 98.6 | 100 | 1.4 | 47.1 | 46 | 0 | × |
| T123 | S03 | A1 | 46.8 | 0 | 0 | 0 | 100 | 100 | 0 | 46.8 | 0 | 0 | ○ |
| T124 | S03 | A2 | 46.6 | 0 | 0 | 0 | 100 | 100 | 0 | 46.6 | 0 | 0 | ○ |
| T125 | S03 | A3 | 46.5 | 0 | 0 | 0 | 100 | 100 | 0 | 46.5 | 0 | 2 | ○ |
| T126 | S03 | A4 | 46.3 | 0 | 0 | 0.3 | 99.7 | 100 | 0.3 | 46.4 | 0 | 14 | ○ |
| T127 | S03 | AH4 | 42.9 | 0 | 0 | 3.8 | 96.2 | 100 | 3.8 | 44.8 | 0 | 40 | ○ |
| T128 | S03 | A5 | 47.0 | 0.1 | 0 | 0 | 99.9 | 100 | 0.1 | 48.9 | 12 | 0 | ○ |
| T129 | S03 | A6 | 45.9 | 0.1 | 0 | 0 | 99.9 | 100 | 0.1 | 48.2 | 14 | 0 | ○ |
| T130 | S03 | AH5 | 45.0 | 0.4 | 0 | 0 | 99.6 | 100 | 0.4 | 49.0 | 30 | 0 | × |
| T131 | S03 | AH6 | 43.4 | 0.5 | 0 | 0 | 99.5 | 100 | 0.5 | 47.8 | 36 | 0 | × |
| T132 | S03 | AH7 | 45.6 | 0.3 | 0 | 0 | 99.7 | 100 | 0.3 | 49.1 | 28 | 0 | Δ |
| T133 | S03 | A7 | 46.0 | 0.1 | 0 | 0 | 99.9 | 100 | 0.1 | 48.3 | 12 | 0 | Δ |
| T134 | S03 | A8 | 46.4 | 0 | 0 | 0 | 100 | 100 | 0 | 46.4 | 0 | 0 | ○ |
| T135 | S03 | AH8 | 43.6 | 0 | 0 | 1.9 | 98.1 | 100 | 1.9 | 44.5 | 0 | 30 | Δ |
| T136 | S03 | A9 | 46.0 | 0 | 0 | 0 | 100 | 100 | 0 | 46.0 | 0 | 0 | ○ |
| T137 | S03 | AH9 | 44.8 | 0.3 | 0 | 0 | 99.7 | 100 | 0.3 | 48.1 | 24 | 0 | ○ |

TABLE 33

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T121 | S03 | AH1 | 114 | ○ | × | ○ | 73 | ○ |
| T122 | S03 | AH2 | 115 | ○ | × | — | 74 | — |
| T123 | S03 | A1 | 116 | ○ | ○ | — | 18 | ○ |
| T124 | S03 | A2 | 117 | ○ | ○ | — | — | — |
| T125 | S03 | A3 | 118 | ○ | ○ | — | — | — |
| T126 | S03 | A4 | 116 | ○ | ○ | — | — | — |
| T127 | S03 | AH4 | 118 | ○ | × | — | — | ○ |
| T128 | S03 | A5 | 116 | ○ | ○ | — | — | — |
| T129 | S03 | A6 | 115 | ○ | ○ | — | — | — |
| T130 | S03 | AH5 | 123 | Δ | Δ | — | 52 | ○ |
| T131 | S03 | AH6 | 119 | ○ | × | — | 60 | ○ |
| T132 | S03 | AH7 | 118 | ○ | ○ | — | 52 | — |
| T133 | S03 | A7 | 117 | ○ | ○ | — | 32 | — |
| T134 | S03 | A8 | 118 | ○ | ○ | — | — | — |
| T135 | S03 | AH8 | 117 | ○ | Δ | — | 50 | — |
| T136 | S03 | A9 | 117 | ○ | ○ | — | 24 | — |
| T137 | S03 | AH9 | 116 | ○ | Δ | — | 50 | — |

TABLE 34

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T121 | S03 | AH1 | 582 | 25.8 | 21.9 | 652 | 674 | 0.42 |
| T122 | S03 | AH2 | 615 | 19.4 | 19.5 | 672 | 692 | — |
| T123 | S03 | A1 | 641 | 25.0 | 22.7 | 716 | 739 | 0.13 |
| T124 | S03 | A2 | 641 | 24.4 | 22.4 | 715 | 737 | — |
| T125 | S03 | A3 | 644 | 23.8 | 22.1 | 716 | 738 | — |
| T126 | S03 | A4 | 629 | 22.4 | 21.2 | 696 | 717 | — |
| T127 | S03 | AH4 | 597 | 17.0 | 17.3 | 646 | 663 | 0.42 |
| T128 | S03 | A5 | 658 | 20.8 | 21.0 | 724 | 745 | — |
| T129 | S03 | A6 | 627 | 21.0 | 22.0 | 690 | 712 | 0.19 |

TABLE 34-continued

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T130 | S03 | AH5 | 582 | 23.2 | 19.4 | 646 | 665 | 0.31 |
| T131 | S03 | AH6 | 623 | 17.2 | 18.2 | 674 | 693 | — |
| T132 | S03 | AH7 | 620 | 20.4 | 20.8 | 680 | 701 | — |
| T133 | S03 | A7 | 622 | 22.0 | 21.8 | 687 | 709 | — |
| T134 | S03 | A8 | 628 | 23.6 | 22.1 | 698 | 721 | — |
| T135 | S03 | AH8 | 607 | 18.2 | 19.2 | 660 | 679 | — |
| T136 | S03 | A9 | 639 | 22.8 | 22.9 | 708 | 731 | — |
| T137 | S03 | AH9 | 622 | 18.2 | 18.9 | 676 | 695 | — |

TABLE 35

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T138 | S03 | AH10 | 45.6 | 0.4 | 0 | 0 | 99.6 | 100 | 0.4 | 49.6 | 30 | 0 | Δ |
| T139 | S03 | AH11 | 44.3 | 0.4 | 0 | 0 | 99.6 | 100 | 0.4 | 48.3 | 32 | 0 | × |
| T140 | S03 | A10 | 46.6 | 0 | 0 | 0 | 100 | 100 | 0 | 46.6 | 0 | 0 | ○ |
| T141 | S03 | A11 | 46.5 | 0 | 0 | 0 | 100 | 100 | 0 | 46.5 | 0 | 0 | ○ |
| T142 | S03 | A12 | 46.2 | 0 | 0 | 0 | 100 | 100 | 0 | 46.2 | 0 | 0 | ○ |
| T143 | S03 | A13 | 43.5 | 0.3 | 0 | 0 | 99.7 | 100 | 0.3 | 47.0 | 22 | 0 | Δ |
| T144 | S03 | A14 | 45.1 | 0.1 | 0 | 0 | 99.9 | 100 | 0.1 | 47.4 | 14 | 0 | ○ |
| T145 | S03 | AH12 | 42.0 | 0.8 | 0 | 0 | 99.2 | 100 | 0.8 | 47.4 | 36 | 0 | Δ |
| T146 | S03 | AH13 | 42.7 | 0.2 | 0 | 2.2 | 97.6 | 100 | 2.4 | 46.8 | 18 | 34 | Δ |
| T147 | S03 | B1 | 46.6 | 0 | 0 | 0 | 100 | 100 | 0 | 46.6 | 0 | 0 | ○ |
| T148 | S03 | B3 | 47.1 | 0 | 0 | 0 | 100 | 100 | 0 | 47.1 | 0 | 2 | ○ |
| T149 | S03 | BH1 | — | — | — | — | — | — | — | — | — | — | — |
| T150 | S03 | BH3 | 44.2 | 0 | 0 | 2.8 | 97.2 | 100 | 2.8 | 45.6 | 0 | 34 | ○ |
| T151 | S03 | CO | 39.8 | 1.4 | 0 | 0 | 98.6 | 100 | 1.4 | 46.9 | 48 | 0 | × |
| T152 | S03 | C1 | 46.5 | 0 | 0 | 0 | 100 | 100 | 0 | 46.5 | 0 | 0 | ○ |
| T153 | S03 | DH1 | 40.2 | 1.2 | 0 | 0 | 98.8 | 100 | 1.2 | 46.7 | 40 | 0 | × |

TABLE 36

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T138 | S03 | AH10 | 117 | ○ | ○ | — | 58 | ○ |
| T139 | S03 | AH11 | 121 | ○ | ○ | — | 60 | — |
| T140 | S03 | A10 | 118 | ○ | ○ | — | 16 | — |
| T141 | S03 | A11 | 120 | ○ | ○ | — | 22 | — |
| T142 | S03 | A12 | 117 | ○ | ○ | — | 16 | — |
| T143 | S03 | A13 | 115 | ○ | ○ | — | 44 | — |
| T144 | S03 | A14 | 114 | ○ | ○ | — | 40 | — |
| T145 | S03 | AH12 | 113 | ○ | Δ | ○ | 62 | ○ |
| T146 | S03 | AH13 | 116 | ○ | × | — | 66 | — |
| T147 | S03 | B1 | 119 | ○ | ○ | — | 24 | — |
| T148 | S03 | E3 | 119 | ○ | ○ | — | 32 | — |
| T149 | S03 | BH1 | — | — | — | — | — | — |
| T150 | S03 | BH3 | 120 | ○ | × | — | 60 | ○ |
| T151 | S03 | C0 | 113 | ○ | × | ○ | — | ○ |
| T152 | S03 | C1 | 116 | ○ | ○ | — | — | — |
| T153 | S03 | DH1 | 114 | ○ | × | — | 74 | ○ |

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T138 | S03 | AH10 | 616 | 20.4 | 20.0 | 676 | 696 | — |
| T139 | S03 | AH11 | 605 | 21.2 | 21.7 | 666 | 688 | — |
| T140 | S03 | A10 | 671 | 21.0 | 20.0 | 738 | 758 | 0.16 |
| T141 | S03 | A11 | 702 | 16.8 | 17.5 | 759 | 776 | 0.18 |
| T142 | S03 | A12 | 652 | 22.0 | 21.7 | 720 | 742 | — |
| T143 | S03 | A13 | 597 | 28.0 | 23.6 | 675 | 699 | — |
| T144 | S03 | A14 | 606 | 29.2 | 23.8 | 688 | 712 | — |
| T145 | S03 | AH12 | 588 | 26.2 | 22.4 | 661 | 683 | — |
| T146 | S03 | AH13 | 593 | 23.2 | 20.1 | 658 | 678 | — |

-continued

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T147 | S03 | B1 | 675 | 20.8 | 19.8 | 741 | 761 | — |
| T148 | S03 | B3 | 676 | 21.0 | 20.2 | 744 | 764 | — |
| T149 | S03 | BH1 | — | — | — | — | — | — |
| T150 | S03 | BH3 | 634 | 14.8 | 16.6 | 679 | 696 | 0.45 |
| T151 | S03 | C0 | 572 | 25.0 | 21.6 | 640 | 662 | — |
| T152 | S03 | C1 | 610 | 30.2 | 25.1 | 696 | 721 | — |
| T153 | S03 | DH1 | 581 | 25.6 | 22.1 | 652 | 674 | 0.42 |

TABLE 38

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T154 | S03 | D1 | 46.8 | 0 | 0 | 0 | 100 | 100 | 0 | 46.8 | 0 | 0 | ○ |
| T155 | S03 | D2 | 46.6 | 0 | 0 | 0 | 100 | 100 | 0 | 46.6 | 0 | 4 | ○ |
| T156 | S03 | D4 | 47.2 | 0 | 0 | 0 | 100 | 100 | 0 | 47.2 | 0 | 0 | ○ |
| T157 | S03 | EH1 | 40.5 | 1.3 | 0 | 0 | 98.7 | 100 | 1.3 | 47.4 | 50 | 0 | × |
| T158 | 503 | E1 | 46.5 | 0.1 | 0 | 0 | 99.9 | 100 | 0.1 | 48.8 | 14 | 0 | ○ |
| T159 | S03 | FH1 | 40.8 | 1.2 | 0 | 0 | 98.8 | 100 | 1.2 | 47.3 | 40 | 0 | × |
| T160 | S03 | F1 | 47.0 | 0 | 0 | 0 | 100 | 100 | 0 | 47.0 | 0 | 0 | ○ |
| T161 | S03 | F2 | 46.9 | 0 | 0 | 0 | 100 | 100 | 0 | 46.9 | 0 | 0 | ○ |
| T162 | S03 | F3 | 46.5 | 0 | 0 | 0 | 100 | 100 | 0 | 46.5 | 0 | 0 | ○ |
| T163 | S03 | F4 | 46.6 | 0.1 | 0 | 0 | 99.9 | 100 | 0.1 | 48.9 | 12 | 0 | ○ |
| T164 | S03 | F5 | 46.5 | 0.1 | 0 | 0 | 99.9 | 100 | 0.1 | 48.8 | 16 | 0 | ○ |
| T165 | S03 | PH1 | 40.2 | 1.6 | 0 | 0 | 98.4 | 100 | 1.6 | 47.8 | 56 | 0 | × |
| T166 | S03 | P1 | 46.2 | 0.2 | 0 | 0 | 99.8 | 100 | 0.2 | 49.2 | 24 | 0 | ○ |
| T167 | S03 | P2 | 47.1 | 0.1 | 0 | 0 | 99.9 | 100 | 0.1 | 49.4 | 16 | 0 | ○ |
| T168 | S03 | P3 | 45.7 | 0.1 | 0 | 0 | 99.9 | 100 | 0.1 | 48.0 | 18 | 0 | ○ |
| T169 | S03 | R1 | 46.7 | 0 | 0 | 0 | 100 | 100 | 0 | 46.7 | 0 | 0 | ○ |

TABLE 39

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T154 | S03 | D1 | 116 | ○ | ○ | — | 22 | ○ |
| T155 | S03 | D2 | 115 | ○ | — | — | — | — |
| T156 | S03 | D4 | 116 | ○ | ○ | — | — | — |
| T157 | S03 | EH1 | 112 | ○ | × | — | 76 | — |
| T158 | S03 | E1 | 114 | ○ | ○ | — | 32 | ○ |
| T159 | S03 | FH1 | 112 | ○ | Δ | — | 68 | ○ |
| T160 | S03 | F1 | 115 | ○ | ○ | — | 18 | — |
| T161 | S03 | F2 | 116 | ○ | ○ | — | 22 | — |
| T162 | S03 | F3 | 115 | ○ | — | — | 22 | — |
| T163 | S03 | F4 | 114 | ○ | ○ | — | 30 | — |
| T164 | S03 | F5 | 115 | ○ | ○ | — | 32 | — |
| T165 | S03 | PH1 | 111 | ○ | — | ○ | 88 | ○ |
| T166 | S03 | P1 | 114 | ○ | — | — | 44 | ○ |
| T167 | S03 | P2 | 113 | ○ | — | — | 34 | — |
| T168 | S03 | P3 | 115 | ○ | — | — | 42 | — |
| T169 | S03 | R1 | — | — | — | — | 18 | — |

| Test No. | Alloy No. | Step No. | Tensile Strength (N/mm$^2$) | Elonga-tion (%) | Impact Value (J/cm$^2$) | Strength Balance Index f8 | Strength Balance Index f9 | 150° C. Creep Strain (%) |
|---|---|---|---|---|---|---|---|---|
| T154 | S03 | D1 | 617 | 30.8 | 24.7 | 705 | 730 | 0.15 |
| T155 | S03 | D2 | 619 | 29.8 | 24.3 | 705 | 730 | — |
| T156 | S03 | D4 | 632 | 26.0 | 22.7 | 710 | 732 | — |
| T157 | S03 | EH1 | 569 | 25.8 | 22.3 | 638 | 661 | 0.43 |
| T158 | S03 | E1 | 606 | 29.4 | 24.5 | 689 | 713 | 0.14 |
| T159 | S03 | FH1 | 577 | 26.2 | 23.2 | 648 | 671 | — |
| T160 | S03 | F1 | 614 | 30.8 | 24.8 | 702 | 727 | — |
| T161 | S03 | F2 | 630 | 27.2 | 23.0 | 710 | 733 | — |
| T162 | S03 | F3 | 610 | 29.0 | 24.1 | 693 | 717 | — |

-continued

| Test No. | Alloy No. | Step No. | Tensile Strength (N/mm$^2$) | Elonga-tion (%) | Impact Value (J/cm$^2$) | Strength Balance Index f8 | Strength Balance Index f9 | 150° C. Creep Strain (%) |
|---|---|---|---|---|---|---|---|---|
| T163 | S03 | F4 | 612 | 28.2 | 23.8 | 692 | 716 | — |
| T164 | S03 | F5 | 606 | 28.0 | 23.4 | 686 | 709 | — |
| T165 | S03 | PH1 | — | — | — | — | — | — |
| T166 | S03 | P1 | — | — | — | — | — | — |
| T167 | S03 | P2 | 608 | 26.8 | 22.9 | 685 | 707 | — |
| T168 | S03 | P3 | 601 | 27.0 | 21.7 | 677 | 699 | 0.19 |
| T169 | S03 | R1 | — | — | — | — | — | — |

TABLE 41

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T201 | S11 | EH1 | 32.3 | 1.7 | 0 | 0 | 98.3 | 100 | 1.7 | 40.1 | 56 | ○ | × |
| T202 | S11 | E1 | 37.5 | 0.2 | 0 | 0 | 99.8 | 100 | 0.2 | 40.2 | 20 | ○ | ○ |
| T203 | S12 | EH1 | 31.7 | 1.9 | 0 | 0 | 98.1 | 100 | 1.9 | 40.0 | 62 | ○ | × |
| T204 | S12 | E1 | 37.0 | 0.3 | 0 | 0 | 99.7 | 100 | 0.3 | 40.3 | 26 | ○ | ○ |
| T205 | S13 | EH1 | 30.3 | 1.6 | 0 | 0 | 98.4 | 100 | 1.6 | 37.9 | 54 | ○ | × |
| T206 | S13 | E1 | 34.9 | 0.2 | 0 | 0 | 99.8 | 100 | 0.2 | 37.6 | 18 | ○ | ○ |
| T207 | S14 | EH1 | 26.8 | 1.4 | 0 | 0 | 98.6 | 100 | 1.4 | 34.0 | 58 | ○ | × |
| T208 | S14 | E1 | 29.7 | 0.1 | 0 | 0 | 99.9 | 100 | 0.1 | 31.6 | 20 | ○ | Δ |

TABLE 42

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T201 | S11 | EH1 | 118 | ○ | × | ○ | 86 | — |
| T202 | S11 | E1 | 120 | ○ | ○ | — | 34 | — |
| T203 | S12 | EH1 | 118 | ○ | × | ○ | 90 | — |
| T204 | S12 | E1 | 120 | ○ | ○ | — | 42 | ○ |
| T205 | S13 | EH1 | 120 | ○ | × | ○ | 92 | — |
| T206 | S13 | E1 | 124 | ○ | ○ | — | 42 | — |
| T207 | S14 | EH1 | 125 | ○ | × | ○ | 95 | — |
| T208 | S14 | E1 | 130 | Δ | Δ | — | 50 | ○ |

TABLE 43

| Test No. | Alloy No. | Step No. | Tensile Strength (N/mm$^2$) | Elongation (%) | Impact Value (J/cm$^2$) | Strength Balance Index f8 | Strength Balance Index f9 | 150° Creep Strain (%) |
|---|---|---|---|---|---|---|---|---|
| T201 | S11 | EH1 | 554 | 28.2 | 27.6 | 627 | 655 | 0.34 |
| T202 | S11 | E1 | 586 | 34.6 | 30.7 | 680 | 711 | 0.15 |
| T203 | S12 | EH1 | 543 | 27.3 | 26.6 | 613 | 640 | 0.36 |
| T204 | S12 | E1 | 575 | 33.0 | 28.1 | 663 | 691 | 0.20 |
| T205 | S13 | EH1 | 555 | 28.4 | 27.9 | 629 | 656 | 0.33 |
| T206 | S13 | E1 | 589 | 34.6 | 30.3 | 683 | 714 | 0.12 |
| T207 | S14 | EH1 | 542 | 29.2 | 27.2 | 616 | 643 | 0.31 |
| T208 | S14 | E1 | 569 | 35.6 | 30.8 | 662 | 693 | 0.12 |

TABLE 44

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T301 | S21 | EH1 | 40.5 | 0.5 | 0 | 0 | 99.5 | 100 | 0.5 | 44.6 | 28 | ○ | × |
| T302 | S21 | E1 | 47.6 | 0 | 0 | 0 | 100 | 100 | 0 | 47.6 | 0 | ○ | ○ |
| T303 | S22 | EH1 | 36.0 | 2.3 | 0 | 0 | 97.7 | 100 | 2.3 | 45.1 | 62 | ○ | × |
| T304 | S22 | E1 | 42.2 | 0.2 | 0 | 0 | 99.8 | 100 | 0.2 | 44.9 | 18 | ○ | ○ |
| T305 | S23 | FH1 | 37.0 | 1.0 | 0 | 0 | 99.0 | 100 | 1.0 | 43.0 | 40 | ○ | × |
| T306 | S23 | F1 | 42.3 | 0 | 0 | 0 | 100 | 100 | 0 | 42.3 | 0 | ○ | ○ |
| T307 | S23 | F2 | 42.7 | 0 | 0 | 0 | 100 | 100 | 0 | 42.7 | 0 | ○ | ○ |
| T308 | S23 | F3 | 41.8 | 0 | 0 | 0 | 100 | 100 | 0 | 41.8 | 0 | ○ | ○ |
| T309 | S24 | EH1 | 46.9 | 0.5 | 0 | 0 | 99.5 | 100 | 0.5 | 51.2 | 30 | ○ | × |
| T310 | S24 | E1 | 55.2 | 0 | 0 | 0 | 100 | 100 | 0 | 55.2 | 0 | ○ | ○ |
| T311 | S25 | EH1 | 42.7 | 0.5 | 0 | 0 | 99.5 | 100 | 0.5 | 47.1 | 32 | ○ | × |
| T312 | S25 | E1 | 50.1 | 0 | 0 | 0 | 100 | 100 | 0 | 50.1 | 0 | ○ | ○ |
| T313 | S26 | EH1 | 27.6 | 2.5 | 0 | 0 | 97.5 | 100 | 2.5 | 37.2 | 62 | ○ | × |
| T314 | S26 | E1 | 31.7 | 0.3 | 0 | 0 | 99.7 | 100 | 0.3 | 35.0 | 20 | ○ | Δ |
| T315 | S27 | P3 | 47.9 | 0.1 | 0 | 0 | 99.9 | 100 | 0.1 | 49.6 | 12 | ○ | ○ |
| T316 | S27 | P2 | 47.2 | 0.1 | 0 | 0 | 99.9 | 100 | 0.1 | 48.9 | 8 | ○ | ○ |
| T317 | S28 | FH1 | 47.6 | 0.4 | 0 | 0 | 99.6 | 100 | 0.4 | 51.2 | 20 | ○ | × |
| T318 | S28 | F1 | 56.1 | 0 | 0 | 0 | 100 | 100 | 0 | 56.1 | 0 | ○ | ○ |
| T319 | S28 | F4 | 56.0 | 0 | 0 | 0 | 100 | 100 | 0 | 56.0 | 0 | ○ | ○ |

TABLE 45

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T301 | S21 | EH1 | 116 | ○ | Δ | ○ | 46 | — |
| T302 | S21 | E1 | 117 | ○ | ○ | — | 20 | — |
| T303 | S22 | EH1 | 111 | ○ | × | ○ | 86 | — |
| T304 | S22 | E1 | 115 | ○ | ○ | — | 44 | — |
| T305 | S23 | FH1 | 116 | ○ | Δ | — | 58 | — |
| T306 | S23 | F1 | 119 | ○ | ○ | — | 18 | — |
| T307 | S23 | F2 | 120 | ○ | ○ | — | 20 | — |
| T308 | S23 | F3 | 118 | ○ | ○ | — | 22 | — |
| T309 | S24 | EH1 | 115 | ○ | × | ○ | 48 | — |
| T310 | S24 | E1 | 116 | ○ | Δ | — | 26 | — |
| T311 | S25 | EH1 | 117 | ○ | Δ | — | 70 | — |
| T312 | S25 | E1 | 118 | ○ | ○ | — | 40 | — |
| T313 | S26 | EH1 | 119 | ○ | × | — | 90 | ○ |
| T314 | S26 | E1 | 125 | ○ | ○ | — | 48 | — |
| T315 | S27 | P3 | 116 | ○ | ○ | — | 26 | — |
| T316 | S27 | P2 | 116 | ○ | ○ | — | 22 | — |
| T317 | S28 | FH1 | 116 | ○ | × | — | 54 | — |
| T318 | S28 | F1 | 118 | ○ | ○ | — | 20 | — |
| T319 | S28 | F4 | 119 | ○ | ○ | — | 22 | — |

TABLE 46

| Test No. | Alloy No. | Step No. | Tensile Strength ($N/mm^2$) | Elonga-tion (%) | Impact Value ($J/cm^2$) | Strength Balance Index f8 | Strength Balance Index f9 | 150° C. Creep Strain (%) |
|---|---|---|---|---|---|---|---|---|
| T301 | S21 | EH1 | 578 | 30.2 | 25.7 | 659 | 685 | — |
| T302 | S21 | E1 | 614 | 31.8 | 27.4 | 705 | 733 | — |
| T303 | S22 | EH1 | 569 | 23.4 | 23.3 | 632 | 655 | — |
| T304 | S22 | E1 | 604 | 31.0 | 27.5 | 691 | 719 | — |
| T305 | S23 | FH1 | 568 | 31.2 | 26.6 | 651 | 677 | 0.26 |
| T306 | S23 | F1 | 611 | 34.6 | 28.6 | 709 | 737 | 0.08 |
| T307 | S23 | F2 | 628 | 31.4 | 27.3 | 720 | 748 | 0.09 |
| T308 | S23 | F3 | 605 | 33.8 | 29.1 | 700 | 729 | 0.10 |
| T309 | S24 | EH1 | 594 | 21.6 | 17.1 | 655 | 672 | — |
| T310 | S24 | E1 | 624 | 22.0 | 17.4 | 689 | 706 | — |
| T311 | S25 | EH1 | 578 | 28.4 | 23.4 | 655 | 679 | — |
| T312 | S25 | E1 | 607 | 30.6 | 26.8 | 693 | 720 | — |
| T313 | S26 | EH1 | 525 | 29.2 | 30.2 | 597 | 627 | 0.44 |
| T314 | S26 | E1 | 560 | 42.8 | 45.2 | 669 | 714 | 0.21 |

TABLE 46-continued

| Test No. | Alloy No. | Step No. | Tensile Strength (N/mm$^2$) | Elonga-tion (%) | Impact Value (J/cm$^2$) | Strength Balance Index f8 | Strength Balance Index f9 | 150° C. Creep Strain (%) |
|---|---|---|---|---|---|---|---|---|
| T315 | S27 | P3 | 606 | 30.0 | 23.8 | 691 | 714 | 0.14 |
| T316 | S27 | P2 | 609 | 30.6 | 23.7 | 696 | 719 | 0.11 |
| T317 | S28 | FH1 | 599 | 24.8 | 20.3 | 669 | 690 | 0.16 |
| T318 | S28 | F1 | 630 | 25.4 | 19.3 | 705 | 724 | 0.08 |
| T319 | S28 | F4 | 627 | 24.8 | 19.2 | 700 | 719 | 0.09 |

TABLE 47

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T320 | S29 | EH1 | 35.9 | 1.7 | 0 | 0 | 98.3 | 100 | 1.7 | 43.6 | 52 | ○ | × |
| T321 | S29 | E1 | 41.7 | 0.1 | 0 | 0 | 99.9 | 100 | 0.1 | 43.7 | 14 | ○ | ○ |
| T322 | S29 | PH1 | 35.7 | 2.1 | 0 | 0 | 97.9 | 100 | 2.1 | 44.3 | 58 | ○ | × |
| T323 | S29 | P1 | 41.8 | 0.2 | 0 | 0 | 99.8 | 100 | 0.2 | 44.6 | 23 | ○ | ○ |
| T324 | S29 | F4 | 41.4 | 0.1 | 0 | 0 | 99.9 | 100 | 0.1 | 43.4 | 16 | ○ | ○ |
| T325 | S30 | EH1 | 49.4 | 0.3 | 0 | 0 | 99.7 | 100 | 0.3 | 52.7 | 20 | ○ | × |
| T326 | S30 | E1 | 57.5 | 0 | 0 | 0 | 100 | 100 | 0 | 58.5 | 0 | ○ | ○ |
| T327 | S31 | EH1 | 27.4 | 1.3 | 0 | 0 | 98.7 | 100 | 1.3 | 34.2 | 46 | ○ | × |
| T328 | S31 | E1 | 31.3 | 0.2 | 0 | 0 | 99.8 | 100 | 0.2 | 33.6 | 20 | ○ | Δ |
| T329 | S41 | EH1 | 38.6 | 1.3 | 0 | 0 | 98.7 | 100 | 1.3 | 45.4 | 48 | ○ | × |
| T330 | S41 | E1 | 44.4 | 0.2 | 0 | 0 | 99.8 | 100 | 0.2 | 47.2 | 16 | ○ | ○ |
| T331 | S42 | EH1 | 44.8 | 0.5 | 0 | 0 | 99.5 | 100 | 0.5 | 49.0 | 30 | ○ | × |
| T332 | S42 | E1 | 52.2 | 0 | 0 | 0 | 100 | 100 | 0 | 52.2 | 0 | ○ | ○ |
| T333 | S51 | EH1 | 36.5 | 1.0 | 0 | 0 | 99.0 | 100 | 1.0 | 42.5 | 40 | ○ | × |
| T334 | S51 | E1 | 42.5 | 0.1 | 0 | 0 | 99.9 | 100 | 0.1 | 44.4 | 12 | ○ | ○ |
| T335 | S51 | F1 | 43.1 | 0.1 | 0 | 0 | 99.9 | 100 | 0.1 | 45.0 | 8 | ○ | ○ |
| T336 | S52 | FH1 | 42.1 | 0.6 | 0 | 0 | 99.4 | 100 | 0.6 | 46.7 | 30 | ○ | × |
| T337 | S52 | F1 | 49.4 | 0.1 | 0 | 0 | 99.9 | 100 | 0.1 | 50.8 | 8 | ○ | ○ |

TABLE 48

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T320 | S29 | EH1 | 114 | ○ | × | ○ | — | — |
| T321 | S29 | E1 | 117 | ○ | ○ | — | — | — |
| T322 | S29 | PH1 | 113 | ○ | × | — | 80 | — |
| T323 | S29 | P1 | 115 | ○ | — | — | 42 | — |
| T324 | S29 | F4 | 117 | ○ | ○ | — | 32 | — |
| T325 | S30 | EH1 | 119 | ○ | × | ○ | 36 | — |
| T326 | S30 | E1 | 125 | ○ | Δ | — | 16 | — |
| T327 | S31 | EH1 | 125 | ○ | — | ○ | 68 | — |
| T328 | S31 | E1 | 128 | Δ | — | — | 32 | — |
| T329 | S41 | EH1 | 113 | ○ | × | — | 60 | ○ |
| T330 | S41 | E1 | 114 | ○ | ○ | — | 34 | ○ |
| T331 | S42 | EH1 | 117 | ○ | × | ○ | 64 | — |
| T332 | S42 | E1 | 118 | ○ | ○ | — | 20 | — |
| T333 | S51 | EH1 | 116 | ○ | × | ○ | 54 | — |
| T334 | S51 | E1 | 118 | ○ | ○ | — | 18 | — |
| T335 | S51 | F1 | 118 | ○ | ○ | — | 14 | — |
| T336 | S52 | FH1 | 116 | ○ | × | ○ | 40 | — |
| T337 | S52 | F1 | 117 | ○ | ○ | — | 16 | — |

TABLE 49

| Test No. | Alloy No. | Step No. | Tensile Strength (N/mm$^2$) | Elonga-tion (%) | Impact Value (J/cm$^2$) | Strength Balance Index f8 | Strength Balance Index f9 | 150° C. Creep Strain (%) |
|---|---|---|---|---|---|---|---|---|
| T320 | S29 | EH1 | 565 | 27.2 | 25.1 | 637 | 662 | — |
| T321 | S29 | E1 | 602 | 33.0 | 28.7 | 695 | 723 | 0.08 |
| T322 | S29 | PH1 | — | — | — | — | — | — |
| T323 | S29 | P1 | — | — | — | — | — | — |
| T324 | S29 | F4 | 602 | 33.0 | 28.9 | 695 | 724 | — |
| T325 | S30 | EH1 | 602 | 24.2 | 19.6 | 671 | 691 | — |

TABLE 49-continued

| Test No. | Alloy No. | Step No. | Tensile Strength (N/mm$^2$) | Elonga-tion (%) | Impact Value (J/cm$^2$) | Strength Balance Index f8 | Strength Balance Index f9 | 150° C. Creep Strain (%) |
|---|---|---|---|---|---|---|---|---|
| T326 | S30 | E1 | 632 | 24.4 | 18.0 | 705 | 723 | — |
| T327 | S31 | EH1 | 535 | 35.4 | 35.0 | 622 | 657 | 0.23 |
| T328 | S31 | E1 | 555 | 43.6 | 46.1 | 666 | 712 | 0.10 |
| T329 | S41 | EH1 | 565 | 28.4 | 22.9 | 640 | 663 | 0.49 |
| T330 | S41 | E1 | 597 | 32.4 | 25.9 | 687 | 712 | 0.20 |
| T331 | S42 | EH1 | 590 | 24.2 | 20.2 | 658 | 678 | 0.19 |
| T332 | S42 | E1 | 621 | 26.0 | 20.5 | 697 | 718 | 0.10 |
| T333 | S51 | EH1 | 570 | 30.0 | 27.5 | 650 | 677 | — |
| T334 | S51 | E1 | 604 | 34.0 | 28.4 | 699 | 728 | — |
| T335 | S51 | F1 | 610 | 34.8 | 29.1 | 708 | 737 | — |
| T336 | S52 | FH1 | 571 | 26.4 | 23.0 | 641 | 664 | 0.25 |
| T337 | S52 | F1 | 613 | 28.6 | 24.2 | 696 | 720 | 0.14 |

TABLE 50

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T501 | S101 | EH1 | 25.1 | 2.7 | 0 | 0 | 97.3 | 100 | 2.7 | 34.9 | 66 | 0 | × |
| T502 | S101 | E1 | 29.2 | 0.2 | 0 | 0 | 99.8 | 100 | 0.2 | 32.1 | 24 | 0 | × |
| T503 | S101 | FH1 | 25.5 | 2.3 | 0 | 0 | 97.7 | 100 | 2.3 | 34.5 | 60 | 0 | × |
| T504 | S101 | F1 | 29.4 | 0.3 | 0 | 0 | 99.7 | 100 | 0.3 | 33.0 | 24 | 0 | × |
| T505 | S102 | E1 | 10.7 | 8.3 | 0 | 0 | 91.7 | 100 | 8.3 | 28.0 | 116 | 0 | × |
| T506 | S103 | EH1 | 10.4 | 21.4 | 5 | 0 | 73.6 | 95 | 21.4 | 38.2 | 150 | 0 | × |
| T507 | S103 | E1 | 19.4 | 15.0 | 0 | 0 | 85.0 | 100 | 15.0 | 42.6 | 150 | 0 | Δ |
| T508 | S104 | E1 | 67.3 | 0 | 0 | 0.2 | 99.8 | 100 | 0.2 | 67.4 | 0 | 10 | ○ |
| T509 | S105 | FH1 | 26.6 | 1.1 | 0 | 0 | 98.9 | 100 | 1.1 | 33.0 | 52 | 0 | × |
| T510 | S105 | F1 | 29.2 | 0 | 0 | 0 | 100 | 100 | 0 | 29.2 | 0 | 0 | × |
| T511 | S106 | EH1 | 30.0 | 0.3 | 0 | 0 | 99.7 | 100 | 0.3 | 33.2 | 41 | 0 | × |
| T512 | S106 | E1 | 34.0 | 0 | 0 | 0 | 100 | 100 | 0 | 34.0 | 0 | 0 | × |
| T513 | S107 | EH1 | 35.6 | 0.2 | 0 | 0 | 99.8 | 100 | 0.2 | 38.3 | 26 | 0 | × |
| T514 | S107 | E1 | 39.1 | 0 | 0 | 0 | 100 | 100 | 0 | 39.1 | 0 | 0 | Δ |
| T515 | S108 | EH1 | 27.1 | 1.8 | 0 | 0 | 98.2 | 100 | 1.8 | 35.1 | 54 | 0 | × |
| T516 | S108 | E1 | 30.7 | 0.1 | 0 | 0 | 99.9 | 100 | 0.1 | 32.8 | 14 | 0 | × |
| T517 | S109 | EH1 | 37.5 | 5.6 | 2.8 | 0 | 91.6 | 97.2 | 5.6 | 51.7 | 100 | 0 | ○ |
| T518 | S109 | E1 | 48.0 | 2.0 | 0 | 0 | 98.0 | 100 | 2.0 | 56.5 | 70 | 0 | ○ |
| T519 | S109 | PH1 | 32.2 | 7.1 | 3.5 | 0 | 89.4 | 96.5 | 7.1 | 48.1 | 120 | 0 | ○ |

TABLE 51

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T501 | S101 | EH1 | 125 | ○ | Δ | ○ | 94 | ○ |
| T502 | S101 | E1 | 133 | × | ○ | — | 44 | — |
| T503 | S101 | FH1 | 125 | ○ | Δ | — | 86 | — |
| T504 | S101 | F1 | 132 | Δ | ○ | — | 40 | — |
| T505 | S102 | E1 | 111 | ○ | × | — | 160 | Δ |
| T506 | S103 | EH1 | 109 | ○ | × | Δ | 180 | × |
| T507 | S103 | E1 | 107 | ○ | × | — | 170 | × |
| T508 | S104 | E1 | 131 | Δ | × | — | 30 | — |
| T509 | S105 | FH1 | 127 | ○ | Δ | ▲ | 72 | — |
| T510 | S105 | F1 | 136 | × | ○ | — | 36 | — |
| T511 | S106 | EH1 | 130 | Δ | ○ | ▲ | 58 | — |
| T512 | S106 | E1 | 133 | Δ | ○ | — | 20 | — |
| T513 | S107 | EH1 | 129 | Δ | Δ | ▲ | 56 | — |
| T514 | S107 | E1 | 131 | Δ | ○ | — | 28 | — |
| T515 | S108 | EH1 | 126 | ○ | Δ | ○ | 76 | — |
| T516 | S108 | E1 | 132 | Δ | ○ | — | 54 | — |
| T517 | S109 | EH1 | 108 | ○ | × | Δ | 150 | × |
| T518 | S109 | E1 | 111 | ○ | × | — | 96 | — |
| T519 | S109 | PH1 | 108 | ○ | — | Δ | 160 | × |

TABLE 52

| Test No. | Alloy No. | Step No. | Tensile Strength ($N/mm^2$) | Elonga-tion (%) | Impact Value ($J/cm^2$) | Strength Balance Index f8 | Strength Balance Index f9 | 150° C. Creep Strain (%) |
|---|---|---|---|---|---|---|---|---|
| T501 | S101 | EH1 | 511 | 35.2 | 31.5 | 594 | 625 | 0.50 |
| T502 | S101 | E1 | 532 | 47.2 | 52.0 | 646 | 698 | 0.24 |
| T503 | S101 | FH1 | 520 | 38.2 | 34.1 | 611 | 645 | 0.46 |
| T504 | S101 | F1 | 534 | 46.4 | 50.6 | 647 | 697 | 0.23 |
| T505 | S102 | E1 | 465 | 6.0 | 6.9 | 479 | 485 | 0.72 |
| T506 | S103 | EH1 | 439 | 2.8 | 3.6 | 445 | 449 | 3.36 |
| T507 | S103 | E1 | 474 | 4.6 | 5.3 | 484 | 490 | 1.11 |
| T508 | S104 | E1 | 626 | 16.0 | 13.1 | 674 | 687 | 0.26 |
| T509 | S105 | FH1 | 522 | 39.2 | 36.9 | 616 | 652 | — |
| T510 | S105 | F1 | 534 | 46.2 | 50.2 | 646 | 696 | — |
| T511 | S106 | EH1 | 538 | 37.4 | 36.6 | 630 | 667 | — |
| T512 | S106 | E1 | 549 | 40.4 | 39.4 | 650 | 689 | — |
| T513 | S107 | EH1 | 550 | 36.0 | 28.8 | 641 | 670 | — |
| T514 | S107 | E1 | 566 | 35.8 | 28.5 | 660 | 688 | — |
| T515 | S108 | EH1 | 530 | 33.2 | 35.8 | 612 | 648 | — |
| T516 | S108 | E1 | 543 | 45.0 | 43.2 | 654 | 697 | — |
| T517 | S109 | EH1 | 514 | 4.6 | 9.2 | 526 | 535 | — |
| T518 | S109 | E1 | 548 | 12.4 | 12.8 | 581 | 594 | 0.41 |
| T519 | S109 | PH1 | — | — | — | — | — | — |

TABLE 53

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase |
|---|---|---|---|---|---|---|---|---|---|---|---|---|---|
| T520 | S109 | P1 | 46.7 | 2.3 | 0.5 | 0 | 97.2 | 99.5 | 2.3 | 55.8 | 74 | 0 | ○ |
| T521 | S109 | F4 | 48.3 | 1.6 | 0 | 0 | 98.4 | 100 | 1.6 | 56.0 | 64 | 0 | ○ |
| T522 | S110 | EH1 | 50.2 | 0.1 | 0 | 0 | 99.9 | 100 | 0.1 | 52.1 | 12 | 0 | × |
| T523 | S110 | E1 | 56.8 | 0 | 0 | 0 | 100 | 100 | 0 | 58.0 | 0 | 0 | ○ |
| T524 | 5111 | EH1 | 26.8 | 2.1 | 0 | 0 | 97.9 | 100 | 2.1 | 35.4 | 60 | 0 | × |
| T525 | S111 | E1 | 29.9 | 0.2 | 0 | 0 | 99.8 | 100 | 0.2 | 32.4 | 16 | 0 | Δ |
| T526 | S112 | E1 | 57.9 | 0 | 0 | 0.5 | 99.5 | 100 | 0.5 | 58.6 | 0 | 14 | ○ |
| T527 | S113 | EH1 | 20.5 | 3.3 | 0 | 0 | 96.7 | 100 | 3.3 | 31.4 | 80 | 0 | × |
| T528 | S113 | E1 | 23.4 | 0.5 | 0 | 0 | 99.5 | 100 | 0.5 | 27.6 | 58 | 0 | × |
| T529 | S114 | EH1 | 31.0 | 2.0 | 0 | 0 | 98.0 | 100 | 2.0 | 39.5 | 56 | 0 | × |
| T530 | S114 | E1 | 36.5 | 0.3 | 0 | 0 | 99.7 | 100 | 0.3 | 39.7 | 26 | 0 | ○ |
| T531 | S115 | EH1 | 29.4 | 2.1 | 0 | 0 | 97.9 | 100 | 2.1 | 38.1 | 58 | 0 | × |
| T532 | S115 | E1 | 34.7 | 0.4 | 0 | 0 | 99.6 | 100 | 0.4 | 38.5 | 30 | 0 | Δ |
| T533 | S116 | EH1 | 30.3 | 2.1 | 0 | 0 | 97.9 | 100 | 2.1 | 39.1 | 58 | 0 | × |
| T534 | S116 | E1 | 35.7 | 0.3 | 0 | 0 | 99.7 | 100 | 0.3 | 39.2 | 24 | 0 | ○ |
| T535 | S117 | EH1 | 27.8 | 1.3 | 0 | 0 | 98.7 | 100 | 1.3 | 34.8 | 50 | 0 | × |
| T536 | S117 | E1 | 30.2 | 0.1 | 0 | 0 | 99.9 | 100 | 0.1 | 32.2 | 12 | 0 | × |
| T537 | S118 | E1 | 37.0 | 0.1 | 0 | 0 | 99.9 | 100 | 0.1 | 39.2 | 14 | 0 | ○ |

TABLE 54

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T520 | S109 | P1 | 110 | ○ | — | — | 114 | Δ |
| T521 | S109 | F4 | 112 | ○ | × | — | 84 | — |
| T522 | S110 | EH1 | 112 | ○ | × | — | 32 | — |
| T523 | S110 | E1 | 113 | ○ | × | — | 22 | ○ |
| T524 | S111 | EH1 | — | — | — | — | — | — |
| T525 | S111 | E1 | 133 | Δ | ○ | — | 40 | — |
| T526 | S112 | E1 | 131 | Δ | × | ▲ | 38 | — |
| T527 | S113 | EH1 | — | — | — | — | — | — |
| T528 | S113 | E1 | 133 | × | ○ | — | 68 | — |
| T529 | S114 | EH1 | 117 | ○ | × | — | 74 | — |
| T530 | S114 | E1 | 120 | ○ | Δ | — | 44 | — |
| T531 | S115 | EH1 | 119 | ○ | × | — | 78 | — |
| T532 | S115 | E1 | 121 | ○ | ○ | — | 46 | — |
| T533 | S116 | EH1 | 117 | ○ | × | — | 70 | — |
| T534 | S116 | E1 | 120 | ○ | Δ | — | 28 | — |

TABLE 54-continued

| Test No. | Alloy No. | Step No. | Cutting Resistance (N) | Chip Shape | Bending Workability | Hot Workability | Corrosion Test 1 (μm) | Corrosion Test 2 (ISO 6509) |
|---|---|---|---|---|---|---|---|---|
| T535 | S117 | EH1 | 125 | Δ | × | — | 92 | — |
| T536 | S117 | E1 | 131 | Δ | Δ | — | 50 | — |
| T537 | S118 | E1 | 114 | ○ | Δ | — | — | — |

TABLE 55

| Test No. | Alloy No. | Step No. | Tensile Strength ($N/mm^2$) | Elongation (%) | Impact Value ($J/cm^2$) | Strength Balance Index f8 | Strength Balance Index f9 | 150° C. Creep Strain (%) |
|---|---|---|---|---|---|---|---|---|
| T520 | S109 | P1 | — | — | — | — | — | — |
| T521 | S109 | F4 | 551 | 13.6 | 13.9 | 587 | 601 | — |
| T522 | S110 | EH1 | 591 | 17.8 | 13.2 | 641 | 654 | 0.59 |
| T523 | S110 | E1 | 607 | 20.0 | 13.8 | 665 | 678 | 0.34 |
| T524 | S111 | EH1 | — | — | — | — | — | — |
| T525 | S111 | E1 | 554 | 41.6 | 41.5 | 659 | 701 | — |
| T526 | S112 | E1 | 611 | 19.0 | 13.6 | 666 | 680 | — |
| T527 | S113 | EH1 | — | — | — | — | — | — |
| T528 | S113 | E1 | 510 | 49.0 | 50.5 | 623 | 673 | 0.32 |
| T529 | S114 | EH1 | 549 | 25.8 | 26.3 | 616 | 643 | 0.40 |
| T530 | S114 | E1 | 574 | 32.0 | 29.3 | 660 | 689 | 0.26 |
| T531 | S115 | EH1 | 550 | 26.2 | 27.2 | 618 | 645 | 0.39 |
| T532 | S115 | E1 | 576 | 31.4 | 29.8 | 660 | 690 | 0.24 |
| T533 | S116 | EH1 | 551 | 25.0 | 26.0 | 617 | 643 | 0.38 |
| T534 | S116 | E1 | 579 | 32.2 | 29.3 | 666 | 695 | 0.20 |
| T535 | S117 | EH1 | 541 | 29.2 | 27.9 | 615 | 643 | 0.31 |
| T536 | S117 | E1 | 560 | 35.0 | 30.7 | 650 | 681 | 0.14 |
| T537 | S118 | E1 | 579 | 30.6 | 25.0 | 662 | 687 | 0.33 |

The above-described experiment results are summarized as follows.

1) It was able to be verified that, by satisfying the composition according to the embodiment, the composition relational expressions f1 and f2, the requirements of the metallographic structure, and the metallographic structure relational expressions f3, f4, f5, and f6, excellent machinability can be obtained with addition of a small amount of Pb, and a hot extruded material or a hot forged material having excellent hot workability and excellent corrosion resistance in a harsh environment and having high strength and excellent ductility, impact resistance, bending workability, and high temperature properties can be obtained (for example, Alloy Nos. S01, S02, and S13 and Step Nos. A1, C1, D1, E1, F1, and F4).

2) It was able to be verified that addition of Sb and As improves corrosion resistance under harsher conditions (Alloy Nos. S51 and S52). However, when an excessive amount of Sb and As were contained, the effect of improving corrosion resistance was saturated, and ductility (elongation), impact resistance, and high temperature properties deteriorated instead (Alloy Nos. S51, S52, and S116).

3) It was able to be verified that the cutting resistance further lowers by containing Bi (Alloy No. S51).

4) It was able to be verified that, due to the presence of acicular κ phase, that is, κ1 phase in α phase, strength increases, the balance between strength and elongation which is represented by f8 and the balance between strength, elongation, and impact resistance which is represented by f9 increase, excellent machinability is maintained, and corrosion resistance, and high temperature properties improve. In particular, when the amount of κ1 phase increased, the improvement of strength was significant. Even when the proportion of γ phase was 0%, excellent machinability was able to be secured (for example, Alloy Nos. S01, S02, and S03).

5) When the Cu content was low, the amount of γ phase increased, and machinability was excellent. However, corrosion resistance, ductility, impact resistance, bending workability, and high temperature properties deteriorated. Conversely, when the Cu content was high, machinability deteriorated. In addition, ductility, impact resistance, and bending workability also deteriorated (Alloy Nos. S102, S103, and S112).

6) When the Si content was lower than 3.05 mass %, κ1 phase was not sufficiently present. Therefore, tensile strength was low, machinability was poor, and high temperature properties was also poor. When the Si content was higher than 3.55 mass %, the amount of κ phase was excessive, and κ1 phase was also excessively present. As a result, elongation was low, workability, impact resistance, and machinability were poor, and also, tensile strength was saturated (Alloy Nos. S102, S104, and S113).

7) When the P content was high, impact resistance, ductility, tensile strength, and bending workability deteriorated. On the other hand, when the P content was low, the dezincification corrosion depth in a harsh environment was large, strength was low, and machinability was poor. The values of f8 and f9 were low. When the Pb content was high, machinability was improved, but high temperature properties, ductility, and impact resistance deteriorated. When the Pb content was low, cutting resistance was high, and the shape of chips deteriorated (Alloy Nos. S108, S110, S118, and Sill).

8) When a small amount of Sn or A1 was contained, an increase in the amount of γ phase was small. However, impact resistance and high temperature properties were slightly deteriorated, and elongation slightly lowered. It is presumed that concentration of Sn or A1 became higher at α phase boundary or the like. Further, as the content of Sn or A1 was increased to exceed 0.05 mass % or when the total content of Sn and Al exceeded 0.06 mass %, the amount of γ phase increased, influence on impact resistance, elongation, and high temperature properties became clear, corrosion resistance deteriorated, and tensile strength also decreased (Alloy Nos. S01, S11, S12, S41, S114, and S115).

9) It was able to be verified that, even if inevitable impurities are contained to the extent contained in alloys manufactured in the actual production, there is not much influence on the properties (Alloy Nos. S01, S02, and S03). With respect to alloys containing inevitable impurities in the amount close to the boundary value of the alloys according to the embodiments, it is presumed that, when Fe or Cr is contained in the amount exceeding the preferable range of the inevitable impurities, an intermetallic compound of Fe and Si or an intermetallic compound of Fe and P is formed. As a result, the effective range of concentration of Si and P decreased, the amount of κ1 phase decreased, corrosion resistance slightly deteriorated, and strength slightly decreased. Machinability, impact resistance, and cold workability slightly deteriorated due to the formation of the intermetallic compound (Alloy Nos. S01, S13, S14, and S117).

10) When the value of the composition relational expression f1 was low, and the amount of γ phase increased, β phase may appear, and machinability was excellent. However, corrosion resistance, impact resistance, cold workability, and high temperature properties deteriorated. When the value of the composition relational expression f1 was high, the amount of κ phase increased, μ phase may appear, and machinability, cold workability, hot workability, and impact resistance deteriorated (Alloys No. S103, S104, and S112).

11) When the value of the composition relational expression f2 was low, the amount of γ phase increased, β phase appeared in some cases, and machinability was excellent. However, hot workability, corrosion resistance, ductility, impact resistance, cold workability, and high temperature properties deteriorated. In particular, in Alloy No. S109, all the requirements of the composition were satisfied except for f2, but hot workability, corrosion resistance, ductility, impact resistance, cold workability, and high temperature properties deteriorated. When the value of the composition relational expression f2 was high, κ1 phase was not sufficiently present or the amount thereof was small irrespective of the Si content. Therefore, tensile strength was low, and hot workability deteriorated. The main reason for this is presumed to be the formation of coarse α phase and a small amount of κ1 phase. However, cutting resistance was high, and chip partibility was also poor. In particular, in Alloys No. S105 to S107, all the requirements of the composition and most of the relational expressions f3 and f6 were satisfied except for f2. However, tensile strength was low, and machinability was poor (Alloys No. S109 and S105 to S107).

12) When the proportion of γ phase in the metallographic structure was higher than 0.3%, or when the length of the long side of γ phase was longer than 25 μm, machinability was excellent, but strength was low and corrosion resistance, ductility, cold workability, impact resistance, and high temperature properties deteriorated (Alloys No. S101 and S102). When the proportion of γ phase was 0.1% or lower and further 0%, corrosion resistance, impact resistance, cold workability, and normal-temperature and high-temperature strength were excellent (Alloys No. S01, S02, and S03).

When the area ratio of μ phase was higher than 1.0%, or when the length of the long side of μ phase exceeded 20 μm, corrosion resistance, ductility, impact resistance, cold workability, and high temperature properties deteriorated (Alloy No. S01 and Steps No. AH4, BH2, and DH2). When the proportion of μ phase was 0.5% or lower and the length of the long side of μ phase was 15 μm or less, corrosion resistance, ductility, impact resistance, and normal temperature and high temperature properties were excellent (Alloys No. S01 and S11).

When the area ratio of κ phase was higher than 60%, machinability, ductility, bending workability, and impact resistance deteriorated. On the other hand, when the area ratio of κ phase was lower than 29%, tensile strength was low, and machinability deteriorated (Alloys No. S104 and S113).

13) When the value of the metallographic structure relational expression $f5-(\gamma)+(\mu)$ exceeded 1.2%, or when the value of $f3=(\alpha)+(\kappa)$ was lower than 98.6%, corrosion resistance, ductility, impact resistance, bending workability, and normal temperature and high temperature properties deteriorated. When the metallographic structure relational expression f5 was 0.5% or lower, corrosion resistance, ductility, impact resistance, and normal temperature and high temperature properties were improved (Alloy No. S01 and Steps No. AH2, FH1, A1, and F1).

When the value of the metallographic structure relational expression $f6=(\kappa)+6\times(\gamma)^{1/2}+0.5\times(\mu)$ was higher than 62 or was lower than 30, machinability deteriorated. In an alloy having the same composition that was manufactured through a different process, even if the value of f6 was the same or high, when the amount of κ1 phase was small, cutting resistance was high or the same, and chip partibility deteriorated in some cases (Alloys No. S01, S02, S104, and S113 and Steps No. A1, AH5 to AH7, and AH9 to AH11).

14) In hot extruded materials or forged materials that satisfied all the requirements of the composition and all the requirements of the metallographic structure and did not undergo cold working, the Charpy impact test value of a U-notched shape was 15 J/cm$^2$ or higher, and most values thereof were 16 J/cm$^2$ or higher. Regarding the tensile strength, all the values were 550 N/mm$^2$ or higher, most values were 580 N/mm$^2$ or higher. When the proportion of κ phase was about 33% or higher and a large amount of κ1 phase was present, the tensile strength was about 590 N/mm$^2$ or higher, and a hot forged product having a tensile strength of 620 N/mm$^2$ or higher was present. The strength-elongation balance index f8 was 675 or higher, and most values thereof were 690 or higher. The strength-elongation-impact balance index f9 exceeded 700, most values thereof exceeded 715, and strength and ductility were well-balanced (Alloys No. S01, S02, S03, S23, and S27).

15) When the requirements of the composition and the requirements of the metallographic structure were satisfied, in combination with cold working, the Charpy impact test value I (J/cm$^2$) of a U-notched specimen was secured to be 12 J/cm$^2$ or higher, and the tensile strength was high at 600 N/mm$^2$ or higher. The balance index f8 was 690 or higher, and most values thereof were 700 or higher. In addition, the value f9 was 715 or higher, and most values thereof were 725 or higher (Alloys No. S01 and S03 and Steps No. A1 and A10 to A12).

16) Regarding the relation between tensile strength and hardness, in the alloys in which Step No. F1 was performed on the compositions of Alloys No. S01, S03, and S101, the values of tensile strength were 602 N/mm$^2$, 625 N/mm$^2$, and 534 N/mm$^2$, respectively, and the values of hardness HRB were 84, 88, and 68, respectively.

17) When the amount of Si was about 3.05% or higher, acicular κ1 phase started to be present in α phase (Δ), and when the amount of Si was about 3.15% or higher, the amount of κ1 phase significantly increased (○). The relational expression f2 was affected by the amount of κ1 phase, and when the value of f2 was 61.0 or lower, the amount of κ1 phase increased.

When the amount of κ1 phase increased, machinability, tensile strength, high temperature properties, and a balance between strength, elongation, and impact were improved. The main reason for this is presumed to be the strengthening of α phase and the improvement of machinability (for example, Alloys No. S01, S02, S26, and S29).

18) In the test method according to ISO 6509, an alloy including about 1% or higher of β phase, an alloy including about 5% or higher of γ phase was evaluated as fail (evaluation: Δ, X). However, an alloy including 3% of γ phase or about 3% of μ phase was evaluated as pass (evaluation: ○). This shows that the corrosion environment used in the embodiment simulated a harsh environment (for example, Alloys No. S01, S26, S103, and S109).

19) In the evaluation of the materials prepared using the mass-production facility and the materials prepared in the laboratory, substantially the same results were obtained (Alloys No. S01 and S02 and Steps No. C1, E1, and F1).

20) Regarding Manufacturing Conditions:

When the hot extruded material, the extruded and drawn material, or the hot forged material was held in a temperature range of 525° C. to 575° C. for 15 minutes or longer, was held in a temperature range of 505° C. or higher and lower than 525° C. for 100 minutes or longer, or was cooled in a temperature range of 525° C. to 575° C. at a cooling rate of 3° C./min or lower and subsequently was cooled in a temperature range from 450° C. to 400° C. at a cooling rate of 3° C./min or higher in the continuous furnace, a material was obtained in which the amount of γ phase significantly decreased, substantially no μ phase was present, and corrosion resistance, ductility, high temperature properties, impact resistance, cold workability, and mechanical strength were excellent (Steps No. A1, A5, and A8).

In the step of performing a heat treatment on a hot worked material or a cold worked material, when the heat treatment temperature was low (490° C.) or when the holding time in the heat treatment at 505° C. or higher and lower than 525° C., a decrease in the amount of γ phase was small, the amount of κ1 phase was small, and corrosion resistance, impact resistance, ductility, cold workability, high temperature properties, and strength-ductility-impact balances deteriorated (Steps No. AH6, AH9, and DH6). When the heat treatment temperature was high, crystal grains of α phase were coarsened, the amount of κ1 phase was small, and a decrease in the amount of γ phase was small. Therefore, corrosion resistance and cold workability were poor, machinability was also poor, tensile strength was also low, and the values of f8 and f9 were also low (Steps No. AH11 and AH6).

When a heat treatment was performed on a hot forged material or an extruded material at a temperature of 515° C. or 520° C. for 120 minutes or longer, the amount of γ phase significantly decreased, the amount of κ1 phase was also large, a decrease in elongation or impact value was minimized, tensile strength increased, and high temperature properties, f8, and f9 were also improved. Therefore, this material is optimum for a valve requiring pressure resistance (Steps No. A5, D4, and F2).

When the cooling rate in a temperature range from 450° C. to 400° C. in the process of cooling after the heat treatment was low, μ phase was present, corrosion resistance, ductility, impact resistance, and high temperature properties were poor, and tensile strength was also low (Steps No. A1 to A4, AH8, DH2, and DH3).

As the heat treatment method, by increasing the temperature in a temperature range of 525° C. to 620° C. and adjusting the cooling rate in a temperature range from 575° C. to 525° C. to be low in the process of cooling, the amount of γ phase was significantly reduced or was 0%, excellent corrosion resistance, impact resistance, cold workability, and high temperature properties were obtained. It was able to be verified that, even with the continuous heat treatment method, the properties were improved (Steps No. A7 to A9 and D5).

By controlling the cooling rate in a temperature range from 575° C. to 525° C. to be 1.6° C./min in the process of cooling after hot forging or hot extrusion, a forged product in which the proportion of γ phase after hot forging was low was obtained (Step No. D6). In addition, even when the casting was used as a material for hot forging, excellent properties were obtained as in the case of use of the extruded material (Steps No. F4 and F5). When a heat treatment was performed on the casting under appropriate conditions, a casting in which the proportion of γ phase was low was obtained (Steps No. P1 to P3).

When a heat treatment was performed on the hot rolled material under appropriate conditions, a rolled material in which the proportion of γ phase was low was obtained (Step No. R1).

When cold working was performed on the extruded material at a working ratio of about 5% or about 8% and then a predetermined heat treatment was performed, as compared to the case of the hot extruded material, corrosion resistance, impact resistance, high temperature properties, and tensile strength were improved, in particular, the tensile strength was improved by about 60 N/mm$^2$ or about 70 N/mm$^2$, and the balance indices f8 and f9 were also improved by about 70 to about 80 (Steps No. AH1, A1, and A12).

When cold working was performed on the heat treated material at a cold working ratio of 5%, as compared to the extruded material, the tensile strength was improved by about 90 N/mm$^2$, the values of f8 and f9 were improved by about 100, and corrosion resistance and high temperature properties were also improved. When the cold working ratio was about 8%, the tensile strength was improved by about 120 N/mm$^2$, and the values of f8 and f9 were improved by about 120 (Steps No. AH1, A10, and A11).

When an appropriate heat treatment was performed, acicular κ phase was present in α phase (Steps No. A1, D7, C1, E1, and F1). It is presumed that, due to the presence of κ1 phase, tensile strength was improved, machinability was excellent, and a significant decrease in the amount of γ phase was compensated for.

It was able to be verified that, during low-temperature annealing after cold working or hot working, when a heat treatment was performed under conditions of temperature: 240° C. to 350° C., heating time: 10 minutes to 300 minutes, and $150 \leq (T-220) \times (t)^{1/2} \leq 1200$ (where T° C. represents the heating temperature and t min represents the heating time), a cold worked material or a hot worked material having excellent corrosion resistance in a harsh environment and having excellent impact resistance and high temperature properties was obtained (Alloy No. S01 and Steps No. B1 to B3).

Regarding the samples obtained by performing Step No. AH14 on Alloys No. S01 and S02, extrusion was not able to be performed to the end due to high deformation resistance. Therefore, the subsequent evaluation was discontinued.

In Step No. BH1, quality problem occurred due to insufficient straightness correction and inappropriate low-temperature annealing.

As described above, in the alloy according to the embodiment in which the contents of the respective additive elements, the respective composition relational expressions, the metallographic structure, and the respective metallographic structure relational expressions are in the appropriate ranges, hot workability (hot extrusion, hot forging) is excellent, and corrosion resistance and machinability are also excellent. In addition, the alloy according to the embodiment can obtain excellent properties by adjusting the manufacturing conditions in hot extrusion and hot forging and the conditions in the heat treatment so that they fall in the appropriate ranges.

INDUSTRIAL APPLICABILITY

The free-cutting copper alloy according to the embodiment has excellent hot workability (hot extrudability and hot forgeability), machinability, high-temperature properties, and corrosion resistance, high strength, and excellent strength-ductility-impact resistance balance. Therefore, the free-cutting copper alloy according to the embodiment is suitable for devices used for drinking water consumed by a person or an animal every day such as faucets, valves, or fittings, members for electrical uses, automobiles, machines and industrial plumbing such as valves or fittings, valves, fittings, devices and components that come in contact with high-pressure gas or liquid at normal temperature, high temperature, or low temperature, and for valves, fittings, devices, or components that come in contact with hydrogen.

Specifically, the free-cutting copper alloy according to the embodiment is suitable to be applied as a material that composes faucet fittings, water mixing faucet fittings, drainage fittings, faucet bodies, water heater components, EcoCute components, hose fittings, sprinklers, water meters, water shut-off valves, fire hydrants, hose nipples, water supply and drainage cocks, pumps, headers, pressure reducing valves, valve seats, gate valves, valves, valve stems, unions, flanges, branch faucets, water faucet valves, ball valves, various other valves, and fittings for plumbing, through which drinking water, drained water, or industrial water flows, for example, components called elbows, sockets, bends, connectors, adaptors, tees, or joints.

In addition, the free-cutting copper alloy according to the embodiment is suitable for solenoid valves, control valves, various valves, radiator components, oil cooler components, and cylinders used as automobile components, and is suitable for pipe fittings, valves, valve stems, heat exchanger components, water supply and drainage cocks, cylinders, or pumps used as mechanical members, and is suitable for pipe fittings, valves, or valve stems used as industrial plumbing members.

Further, the alloy is suitable for valves, fittings, pressure-resistant vessels, and pressure vessels involving hydrogen such as hydrogen station and hydrogen power generation.

The invention claimed is:

1. A method of manufacturing a free-cutting copper alloy, the method comprising:

any one or both of a cold working step and a hot working step; and an annealing step that is performed after the cold working step or the hot working step, wherein in the annealing step, the copper alloy is heated or cooled under any one of the following conditions (1) to (4):

(1) the copper alloy is held at a temperature of 525° C. to 575° C. for 15 minutes to 8 hours;

(2) the copper alloy is held at a temperature of 505° C. or higher and lower than 525° C. for 100 minutes to 8 hours;

(3) the maximum reaching temperature is 525° C. to 620° C. and the copper alloy is held in a temperature range from 575° C. to 525° C. for 15 minutes or longer; or (4) the copper alloy is cooled in a temperature range from 575° C. to 525° C. at an average cooling rate of 0.1° C./min to 3° C./min, and subsequently, the copper alloy is cooled in a temperature range from 450° C. to 400° C. at an average cooling rate of 3° C./min to 500° C./min, the manufactured free-cutting copper alloy comprises:

75.4 mass % to 78.0 mass % of Cu;

3.05 mass % to 3.55 mass % of Si;

0.05 mass % to 0.13 mass % of P;

0.005 mass % to 0.070 mass % of Pb; and a balance including Zn and inevitable impurities, a total amount of Fe, Mn, Co, and Cr as the inevitable impurities is lower than 0.08 mass %, a content of Sn present as inevitable impurity is 0.05 mass % or lower, a content of Al present as inevitable impurity is 0.05 mass % or lower, a total content of Sn and Al present as inevitable impurity is 0.06 mass % or lower, when a Cu content is represented by [Cu] mass %, a Si content is represented by [Si] mass %, a Pb content is represented by [Pb] mass %, and a P content is represented by [P] mass %, the relations of $$78.0 \le f1 = [Cu] + 0.8 \times [Si] + [P] + [Pb] \le 80.8 \text{ and}$$

$$60.2 \le f2 = [Cu] - 4.7 \times [Si] - [P] + 0.5 \times [Pb] \le 61.5$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$29 \le (\kappa) \le 60,$$

$$0 \le (\gamma) \le 0.3,$$

$$(\beta) = 0,$$

$$0 \le (\mu) \le 1.0,$$

$$98.6 \le f3 = (\alpha) + (\kappa),$$

$$99.7 \le f4 = (\alpha) + (\kappa) + (\gamma) + (\mu),$$

$$0 \le f5 = (\gamma) + (\mu) \le 1.2, \text{ and}$$

$$30 \le f6 = (\kappa) + 6 \times (\gamma)^{1/2} + 0.5 \times (\mu) \le 62$$

are satisfied, the length of the long side of γ phase is 25 μm or less, the length of the long side of μ phase is 20 μm or less, and acicular κ phase is present in α phase, wherein the acicular κ phase is present in α phase in an amount such that when micrographs of arbitrarily selected five visual fields of a cross-section of the copper alloy are taken at a magnification of 500-fold using a metallographic microscope, and the micrograph of each of the visual fields is presented as an image of dimensions of 70 mm in length and 90 mm in width for a visual field size of 220 μm in length and 276 μm in width, an average number of the acicular κ phases counted in the images of the five visual fields is 20 or more.

2. The method of manufacturing a free-cutting copper alloy according to claim 1, wherein the manufactured free-cutting copper alloy further comprises:

one or more element(s) selected from the group consisting of 0.01 mass % to 0.07 mass % of Sb, 0.02 mass % to 0.07 mass % of As, and 0.005 mass % to 0.10 mass % of Bi.

3. A method of manufacturing a free-cutting copper alloy, the method comprising:

a hot working step, wherein the material's temperature during hot working is 600° C. to 740° C., and in the process of cooling after hot working, the material is cooled in a temperature range from 575° C. to 525° C. at an average cooling rate of 0.1° C./min to 3° C./min and subsequently is cooled in a temperature range from 450° C. to 400° C. at an average cooling rate of 3° C./min to 500° C./min, the manufactured free-cutting copper alloy comprises:

75.4 mass % to 78.0 mass % of Cu;

3.05 mass % to 3.55 mass % of Si;

0.05 mass % to 0.13 mass % of P;

0.005 mass % to 0.070 mass % of Pb; and a balance including Zn and inevitable impurities, a total amount of Fe, Mn, Co, and Cr as the inevitable impurities is lower than 0.08 mass %, a content of Sn present as inevitable impurity is 0.05 mass % or lower, a content of Al present as inevitable impurity is 0.05 mass % or lower, a total content of Sn and Al present as inevitable impurity is 0.06 mass % or lower, when a Cu content is represented by [Cu] mass %, a Si content is represented by [Si] mass %, a Pb content is represented by [Pb] mass %, and a P content is represented by [P] mass %, the relations of $$78.0 \le f1 = [Cu] + 0.8 \times [Si] + [P] + [Pb] \le 80.8 \text{ and}$$

$$60.2 \le f2 = [Cu] - 4.7 \times [Si] - [P] + 0.5 \times [Pb] \le 61.5$$

are satisfied, in constituent phases of metallographic structure, when an area ratio of a phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$29 \le (\kappa) \le 60,$$

$$0 \le (\gamma) \le 0.3,$$

$$(\beta) = 0,$$

$$0 \le (\mu) \le 1.0,$$

$$98.6 \le f3 = (\alpha) + (\kappa),$$

$$99.7 \le f4 = (\alpha) + (\kappa) + (\gamma) + (\mu),$$

$$0 \le f5 = (\gamma) + (\mu) \le 1.2, \text{ and}$$

$$30 \le f6 = (\kappa) + 6 \times (\gamma)^{1/2} + 0.5 \times (\mu) \le 62$$

are satisfied, the length of the long side of γ phase is 25 μm or less, the length of the long side of μ phase is 20 μm or less, and acicular κ phase is present in α phase, wherein the acicular κ phase is present in α phase in an amount such that when micrographs of arbitrarily selected five visual fields of a cross-section of the copper alloy are taken at a magnification of 500-fold using a metallographic microscope, and the micrograph of each of the visual fields is presented as an image of dimensions of 70 mm in length and 90 mm in width for a visual field size of 220 μm in length and 276 μm in width, an average number of the acicular κ phases counted in the images of the five visual fields is 20 or more.

4. The method of manufacturing a free-cutting copper alloy according to claim 3, wherein the manufactured free-cutting copper alloy further comprises:

one or more element(s) selected from the group consisting of 0.01 mass % to 0.07 mass % of Sb, 0.02 mass % to 0.07 mass % of As, and 0.005 mass % to 0.10 mass % of Bi.

* * * * *